US011512571B2

(12) United States Patent
Yeung et al.

(10) Patent No.: US 11,512,571 B2
(45) **Date of Patent: *Nov. 29, 2022**

(54) AUTOMATED DIAGNOSTICS OF ELECTRONIC INSTRUMENTATION IN A SYSTEM FOR FRACTURING A WELL AND ASSOCIATED METHODS

(71) Applicant: BJ Energy Solutions, LLC, Houston, TX (US)

(72) Inventors: Tony Yeung, Houston, TX (US); Ricardo Rodriguez-Ramon, Houston, TX (US); Andres Alvarez, Houston, TX (US)

(73) Assignee: BJ Energy Solutions, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/810,877

(22) Filed: Jul. 6, 2022

(65) Prior Publication Data

US 2022/0349290 A1 Nov. 3, 2022

Related U.S. Application Data

(63) Continuation of application No. 17/551,359, filed on Dec. 15, 2021, which is a continuation of application (Continued)

(51) Int. Cl.
*E21B 43/26* (2006.01)
*E21B 47/07* (2012.01)

(52) U.S. Cl.
CPC ..... *E21B 43/2607* (2020.05); *E21B 47/07* (2020.05)

(58) Field of Classification Search
CPC .... E21B 43/26; E21B 43/2607; E21B 43/267; E21B 47/07
See application file for complete search history.

(56) References Cited

U.S. PATENT DOCUMENTS 1,716,049 A 6/1929 Greve
1,726,633 A 9/1929 Smith
(Continued)

FOREIGN PATENT DOCUMENTS

AU 9609498 7/1999
AU 737970 9/2001
(Continued)

OTHER PUBLICATIONS

De Gevigney et al., "Analysis of no-load dependent power losses in a planetary gear train by using thermal network method", International Gear Conference 2014: Aug. 26-28, 2014, Lyon, pp. 615-624.
(Continued)

*Primary Examiner* — Brad Harcourt
(74) *Attorney, Agent, or Firm* — Womble Bond Dickinson (US) LLP

(57) ABSTRACT

Systems and methods for identifying a status of components of hydraulic fracturing units including a prime mover and a hydraulic fracturing pump to pump fracturing fluid into a wellhead via a manifold may include a diagnostic control assembly. The diagnostic control assembly may include sensors associated with the hydraulic fracturing units or the manifold, and a supervisory control unit to determine whether the sensors are generating signals outside a calibration range, determine whether a fluid parameter associated with an auxiliary system of the hydraulic fracturing units is indicative of a fluid-related problem, determine whether lubrication associated with the prime mover, the hydraulic fracturing pump, or a transmission of the hydraulic fracturing units has a lubrication fluid temperature greater than a maximum lubrication temperature, or determine an extent to which a heat exchanger assembly associated with the hydraulic fracturing units is cooling fluid passing through the heat exchanger assembly.

18 Claims, 10 Drawing Sheets

Related U.S. Application Data

No. 17/395,298, filed on Aug. 5, 2021, now Pat. No. 11,255,174, which is a continuation of application No. 17/301,247, filed on Mar. 30, 2021, now Pat. No. 11,220,895.

(60) Provisional application No. 62/705,375, filed on Jun. 24, 2020.

(56) References Cited

U.S. PATENT DOCUMENTS 2,178,662 A 11/1939 Lars
2,427,638 A 9/1947 Vilter
2,498,229 A 2/1950 Adler
2,535,703 A 12/1950 Smith et al.
2,572,711 A 10/1951 Fischer
2,820,341 A 1/1958 Amann
2,868,004 A 1/1959 Runde
2,940,377 A 6/1960 Darnell et al.
2,947,141 A 8/1960 Russ
2,956,738 A 10/1960 Rosenschold
3,068,796 A 12/1962 Pfluger et al.
3,191,517 A 6/1965 Solzman
3,257,031 A 6/1966 Dietz
3,274,768 A 9/1966 Klein
3,378,074 A 4/1968 Kiel
3,382,671 A 5/1968 Ehni, III
3,401,873 A 9/1968 Privon
3,463,612 A 8/1969 Whitsel
3,496,880 A 2/1970 Wolff
3,550,696 A 12/1970 Kenneday
3,586,459 A 6/1971 Zerlauth
3,632,222 A 1/1972 Cronstedt
3,656,582 A 4/1972 Alcock
3,667,868 A 6/1972 Brunner
3,692,434 A 9/1972 Schnear
3,739,872 A 6/1973 McNair
3,757,581 A 9/1973 Mankin
3,759,063 A 9/1973 Bendall
3,765,173 A 10/1973 Harris
3,771,916 A 11/1973 Flanigan et al.
3,773,438 A 11/1973 Hall et al.
3,786,835 A 1/1974 Finger
3,791,682 A 2/1974 Mitchell
3,796,045 A 3/1974 Foster
3,814,549 A 6/1974 Cronstedt
3,820,922 A 6/1974 Buse et al.
3,963,372 A 6/1976 McLain et al.
4,010,613 A 3/1977 McInerney
4,019,477 A 4/1977 Overton
4,031,407 A 6/1977 Reed
4,050,862 A 9/1977 Buse
4,059,045 A 11/1977 McClain
4,086,976 A 5/1978 Holm et al.
4,117,342 A 9/1978 Melley, Jr.
4,173,121 A 11/1979 Yu
4,204,808 A 5/1980 Reese et al.
4,209,079 A 6/1980 Marchal et al.
4,209,979 A 7/1980 Woodhouse et al.
4,222,229 A 9/1980 Uram
4,269,569 A 5/1981 Hoover
4,311,395 A 1/1982 Douthitt et al.
4,330,237 A 5/1982 Battah
4,341,508 A 7/1982 Rambin, Jr.
4,357,027 A 11/1982 Zeitlow
4,383,478 A 5/1983 Jones
4,402,504 A 9/1983 Christian
4,457,325 A 7/1984 Green
4,470,771 A 9/1984 Hall et al.
4,483,684 A 11/1984 Black
4,505,650 A 3/1985 Hannett et al.
4,574,880 A 3/1986 Handke
4,584,654 A 4/1986 Crane
4,672,813 A 6/1987 David
4,754,607 A 7/1988 Mackay
4,782,244 A 11/1988 Wakimoto
4,796,777 A 1/1989 Keller
4,869,209 A 9/1989 Young
4,913,625 A 4/1990 Gerlowski
4,983,259 A 1/1991 Duncan
4,990,058 A 2/1991 Eslinger
5,032,065 A 7/1991 Yamamuro
5,135,361 A 8/1992 Dion
5,167,493 A 12/1992 Kobari
5,245,970 A 9/1993 Iwaszkiewicz et al.
5,291,842 A 3/1994 Sallstrom et al.
5,326,231 A 7/1994 Pandeya
5,362,219 A 11/1994 Paul et al.
5,511,956 A 4/1996 Hasegawa
5,537,813 A 7/1996 Davis et al.
5,553,514 A 9/1996 Walkowc
5,560,195 A 10/1996 Anderson et al.
5,586,444 A 12/1996 Fung
5,622,245 A 4/1997 Reik
5,626,103 A 5/1997 Haws et al.
5,634,777 A 6/1997 Albertin
5,651,400 A 7/1997 Corts et al.
5,678,460 A 10/1997 Walkowc
5,717,172 A 2/1998 Griffin, Jr. et al.
5,720,598 A 2/1998 de Chizzelle
5,839,888 A 11/1998 Harrison
5,846,062 A 12/1998 Yanagisawa et al.
5,875,744 A 3/1999 Vallejos
5,983,962 A 11/1999 Gerardot
5,992,944 A 11/1999 Hara
6,041,856 A 3/2000 Thrasher et al.
6,050,080 A 4/2000 Horner
6,067,962 A 5/2000 Bartley et al.
6,071,188 A 6/2000 O'Neill et al.
6,074,170 A 6/2000 Bert et al.
6,123,751 A 9/2000 Nelson et al.
6,129,335 A 10/2000 Yokogi
6,145,318 A 11/2000 Kaplan et al.
6,230,481 B1 5/2001 Jahr
6,279,309 B1 8/2001 Lawlor, II et al.
6,321,860 B1 11/2001 Reddoch
6,334,746 B1 1/2002 Nguyen et al.
6,401,472 B2 6/2002 Pollrich
6,530,224 B1 3/2003 Conchier
6,543,395 B2 4/2003 Green
6,655,922 B1 12/2003 Flek
6,669,453 B1 12/2003 Breeden
6,765,304 B2 7/2004 Baten et al.
6,786,051 B2 9/2004 Kristich et al.
6,832,900 B2 12/2004 Leu
6,851,514 B2 2/2005 Han et al.
6,859,740 B2 2/2005 Stephenson et al.
6,901,735 B2 6/2005 Lohn
6,962,057 B2 11/2005 Kurokawa et al.
7,007,966 B2 3/2006 Campion
7,065,953 B1 6/2006 Kopko
7,143,016 B1 11/2006 Discenzo et al.
7,222,015 B2 5/2007 Davis et al.
7,281,519 B2 10/2007 Schroeder
7,388,303 B2 6/2008 Seiver
7,404,294 B2 7/2008 Sundin
7,442,239 B2 10/2008 Armstrong et al.
7,545,130 B2 6/2009 Latham
7,552,903 B2 6/2009 Dunn et al.
7,563,076 B2 7/2009 Brunet et al.
7,563,413 B2 7/2009 Naets et al.
7,574,325 B2 8/2009 Dykstra
7,594,424 B2 9/2009 Fazekas
7,614,239 B2 11/2009 Herzog et al.
7,627,416 B2 12/2009 Batenburg et al.
7,677,316 B2 3/2010 Butler et al.
7,721,521 B2 5/2010 Kunkle et al.
7,730,711 B2 6/2010 Kunkle et al.
7,779,961 B2 8/2010 Matte
7,789,452 B2 9/2010 Dempsey et al.
7,836,949 B2 11/2010 Dykstra
7,841,394 B2 11/2010 McNeel et al.
7,845,413 B2 12/2010 Shampine et al.
7,886,702 B2 2/2011 Jerrell et al.

(56) References Cited

U.S. PATENT DOCUMENTS

| | | | |
|---|---|---|---|
| 7,900,724 | B2 | 3/2011 | Promersberger et al. |
| 7,921,914 | B2 | 4/2011 | Bruins et al. |
| 7,938,151 | B2 | 5/2011 | Höckner |
| 7,980,357 | B2 | 7/2011 | Edwards |
| 8,056,635 | B2 | 11/2011 | Shampine et al. |
| 8,083,504 | B2 | 12/2011 | Williams et al. |
| 8,186,334 | B2 | 5/2012 | Ooyama |
| 8,196,555 | B2 | 6/2012 | Ikeda et al. |
| 8,202,354 | B2 | 6/2012 | Iijima |
| 8,316,936 | B2 | 11/2012 | Roddy et al. |
| 8,336,631 | B2 | 12/2012 | Shampine et al. |
| 8,388,317 | B2 | 3/2013 | Sung |
| 8,414,673 | B2 | 4/2013 | Raje et al. |
| 8,469,826 | B2 | 6/2013 | Brosowske |
| 8,500,215 | B2 | 8/2013 | Gastauer |
| 8,506,267 | B2 | 8/2013 | Gambier et al. |
| 8,575,873 | B2 | 11/2013 | Peterson et al. |
| 8,616,005 | B1 | 12/2013 | Cousino, Sr. et al. |
| 8,621,873 | B2 | 1/2014 | Robertson et al. |
| 8,641,399 | B2 | 2/2014 | Mucibabic |
| 8,656,990 | B2 | 2/2014 | Kajaria et al. |
| 8,672,606 | B2 | 3/2014 | Glynn et al. |
| 8,707,853 | B1 | 4/2014 | Dille et al. |
| 8,714,253 | B2 | 5/2014 | Sherwood et al. |
| 8,757,918 | B2 | 6/2014 | Ramnarain et al. |
| 8,770,329 | B2 | 7/2014 | Spitler |
| 8,784,081 | B1 | 7/2014 | Blume |
| 8,789,601 | B2 | 7/2014 | Broussard et al. |
| 8,794,307 | B2 | 8/2014 | Coquilleau et al. |
| 8,801,394 | B2 | 8/2014 | Anderson |
| 8,851,186 | B2 | 10/2014 | Shampine et al. |
| 8,851,441 | B2 | 10/2014 | Acuna et al. |
| 8,905,056 | B2 | 12/2014 | Kendrick |
| 8,951,019 | B2 | 2/2015 | Hains et al. |
| 8,973,560 | B2 | 3/2015 | Krug |
| 8,997,904 | B2 | 4/2015 | Cryer et al. |
| 9,016,383 | B2 | 4/2015 | Shampine et al. |
| 9,032,620 | B2 | 5/2015 | Frassinelli et al. |
| 9,057,247 | B2 | 6/2015 | Kumar et al. |
| 9,097,249 | B2 | 8/2015 | Petersen |
| 9,103,193 | B2 | 8/2015 | Coli et al. |
| 9,121,257 | B2 | 9/2015 | Coli et al. |
| 9,140,110 | B2 | 9/2015 | Coli et al. |
| 9,187,982 | B2 | 11/2015 | Dehring et al. |
| 9,206,667 | B2 | 12/2015 | Khvoshchev et al. |
| 9,212,643 | B2 | 12/2015 | Deliyski |
| 9,222,346 | B1 | 12/2015 | Walls |
| 9,324,049 | B2 | 4/2016 | Thomeer et al. |
| 9,341,055 | B2 | 5/2016 | Weightman et al. |
| 9,346,662 | B2 | 5/2016 | Van Vliet et al. |
| 9,366,114 | B2 | 6/2016 | Coli et al. |
| 9,376,786 | B2 | 6/2016 | Numasawa |
| 9,394,829 | B2 | 7/2016 | Cabeen et al. |
| 9,395,049 | B2 | 7/2016 | Vicknair et al. |
| 9,401,670 | B2 | 7/2016 | Minato et al. |
| 9,410,410 | B2 | 8/2016 | Broussard et al. |
| 9,410,546 | B2 | 8/2016 | Jaeger et al. |
| 9,429,078 | B1 | 8/2016 | Crowe et al. |
| 9,435,333 | B2 | 9/2016 | McCoy et al. |
| 9,488,169 | B2 | 11/2016 | Cochran et al. |
| 9,493,997 | B2 | 11/2016 | Liu et al. |
| 9,512,783 | B2 | 12/2016 | Veilleux et al. |
| 9,534,473 | B2 | 1/2017 | Morris et al. |
| 9,546,652 | B2 | 1/2017 | Yin |
| 9,550,501 | B2 | 1/2017 | Ledbetter |
| 9,556,721 | B2 | 1/2017 | Jang et al. |
| 9,562,420 | B2 | 2/2017 | Morris et al. |
| 9,570,945 | B2 | 2/2017 | Fischer |
| 9,579,980 | B2 | 2/2017 | Cryer et al. |
| 9,587,649 | B2 | 3/2017 | Oehring |
| 9,611,728 | B2 | 4/2017 | Oehring |
| 9,617,808 | B2 | 4/2017 | Liu et al. |
| 9,638,101 | B1 | 5/2017 | Crowe et al. |
| 9,638,194 | B2 | 5/2017 | Wiegman et al. |
| 9,650,871 | B2 | 5/2017 | Oehring et al. |
| 9,656,762 | B2 | 5/2017 | Kamath et al. |
| 9,689,316 | B1 | 6/2017 | Crom |
| 9,739,130 | B2 | 8/2017 | Young |
| 9,764,266 | B1 | 9/2017 | Carter |
| 9,777,748 | B2 | 10/2017 | Lu et al. |
| 9,803,467 | B2 | 10/2017 | Tang et al. |
| 9,803,793 | B2 | 10/2017 | Davi et al. |
| 9,809,308 | B2 | 11/2017 | Aguilar et al. |
| 9,829,002 | B2 | 11/2017 | Crom |
| 9,840,897 | B2 | 12/2017 | Larson |
| 9,840,901 | B2 | 12/2017 | Oering et al. |
| 9,845,730 | B2 | 12/2017 | Betti et al. |
| 9,850,422 | B2 | 12/2017 | Lestz et al. |
| 9,856,131 | B1 | 1/2018 | Moffitt |
| 9,863,279 | B2 | 1/2018 | Laing et al. |
| 9,869,305 | B1 | 1/2018 | Crowe et al. |
| 9,879,609 | B1 | 1/2018 | Crowe et al. |
| RE46,725 | E | 2/2018 | Case et al. |
| 9,893,500 | B2 | 2/2018 | Oehring et al. |
| 9,893,660 | B2 | 2/2018 | Peterson et al. |
| 9,897,003 | B2 | 2/2018 | Motakef et al. |
| 9,920,615 | B2 | 3/2018 | Zhang et al. |
| 9,945,365 | B2 | 4/2018 | Hernandez et al. |
| 9,964,052 | B2 | 5/2018 | Millican et al. |
| 9,970,278 | B2 | 5/2018 | Broussard et al. |
| 9,981,840 | B2 | 5/2018 | Shock |
| 9,995,102 | B2 | 6/2018 | Dillie et al. |
| 9,995,218 | B2 | 6/2018 | Oehring et al. |
| 10,008,880 | B2 | 6/2018 | Vicknair et al. |
| 10,008,912 | B2 | 6/2018 | Davey et al. |
| 10,018,096 | B2 | 7/2018 | Wallimann et al. |
| 10,020,711 | B2 | 7/2018 | Oehring et al. |
| 10,024,123 | B2 | 7/2018 | Steflenhagen et al. |
| 10,029,289 | B2 | 7/2018 | Wendorski et al. |
| 10,030,579 | B2 | 7/2018 | Austin et al. |
| 10,036,238 | B2 | 7/2018 | Oehring |
| 10,040,541 | B2 | 8/2018 | Wilson et al. |
| 10,060,293 | B2 | 8/2018 | Del Bono |
| 10,060,349 | B2 | 8/2018 | Álvarez et al. |
| 10,077,933 | B2 | 9/2018 | Nelson et al. |
| 10,082,137 | B2 | 9/2018 | Graham et al. |
| 10,094,366 | B2 | 10/2018 | Marica |
| 10,100,827 | B2 | 10/2018 | Devan et al. |
| 10,107,084 | B2 | 10/2018 | Coli et al. |
| 10,107,085 | B2 | 10/2018 | Coli et al. |
| 10,114,061 | B2 | 10/2018 | Frampton et al. |
| 10,119,381 | B2 | 11/2018 | Oehring et al. |
| 10,125,750 | B2 | 11/2018 | Pfaff |
| 10,134,257 | B2 | 11/2018 | Zhang et al. |
| 10,138,098 | B2 | 11/2018 | Sorensen et al. |
| 10,151,244 | B2 | 12/2018 | Giancotti et al. |
| 10,161,423 | B2 | 12/2018 | Rampen |
| 10,174,599 | B2 | 1/2019 | Shampine et al. |
| 10,184,397 | B2 | 1/2019 | Austin et al. |
| 10,196,258 | B2 | 2/2019 | Kalala et al. |
| 10,221,856 | B2 | 3/2019 | Hernandez et al. |
| 10,227,854 | B2 | 3/2019 | Glass |
| 10,227,855 | B2 | 3/2019 | Coli et al. |
| 10,246,984 | B2 | 4/2019 | Payne et al. |
| 10,247,182 | B2 | 4/2019 | Zhang et al. |
| 10,254,732 | B2 | 4/2019 | Oehring et al. |
| 10,267,439 | B2 | 4/2019 | Pryce et al. |
| 10,280,724 | B2 | 5/2019 | Hinderliter |
| 10,287,943 | B1 | 5/2019 | Schiltz |
| 10,288,519 | B2 | 5/2019 | De La Cruz |
| 10,303,190 | B2 | 5/2019 | Shock |
| 10,305,350 | B2 | 5/2019 | Johnson et al. |
| 10,316,832 | B2 | 6/2019 | Byrne |
| 10,317,875 | B2 | 6/2019 | Pandurangan et al. |
| 10,337,402 | B2 | 7/2019 | Austin et al. |
| 10,358,035 | B2 | 7/2019 | Cryer |
| 10,371,012 | B2 | 8/2019 | Davis et al. |
| 10,374,485 | B2 | 8/2019 | Morris et al. |
| 10,378,326 | B2 | 8/2019 | Morris et al. |
| 10,393,108 | B2 | 8/2019 | Chong et al. |
| 10,407,990 | B2 | 9/2019 | Oehring et al. |
| 10,408,031 | B2 | 9/2019 | Oehring et al. |
| 10,415,348 | B2 | 9/2019 | Zhang et al. |
| 10,415,557 | B1 | 9/2019 | Crowe et al. |

(56) References Cited

U.S. PATENT DOCUMENTS

| | | | |
|---|---|---|---|
| 10,415,562 | B2 | 9/2019 | Kajita et al. |
| RE47,695 | E | 11/2019 | Case et al. |
| 10,465,689 | B2 | 11/2019 | Crom |
| 10,478,753 | B1 | 11/2019 | Elms et al. |
| 10,526,882 | B2 | 1/2020 | Oehring et al. |
| 10,563,649 | B2 | 2/2020 | Zhang et al. |
| 10,577,910 | B2 | 3/2020 | Stephenson |
| 10,584,645 | B2 | 3/2020 | Nakagawa et al. |
| 10,590,867 | B2 | 3/2020 | Thomassin et al. |
| 10,598,258 | B2 | 3/2020 | Oehring et al. |
| 10,610,842 | B2 | 4/2020 | Chong |
| 10,662,749 | B1 | 5/2020 | Hill et al. |
| 10,711,787 | B1 | 7/2020 | Darley |
| 10,738,580 | B1 | 8/2020 | Fischer et al. |
| 10,753,153 | B1 | 8/2020 | Fischer et al. |
| 10,753,165 | B1 | 8/2020 | Fischer et al. |
| 10,760,556 | B1 | 9/2020 | Crom et al. |
| 10,794,165 | B2 | 10/2020 | Fischer et al. |
| 10,794,166 | B2 | 10/2020 | Reckels et al. |
| 10,801,311 | B1 | 10/2020 | Cui et al. |
| 10,815,764 | B1 | 10/2020 | Yeung et al. |
| 10,815,978 | B2 | 10/2020 | Glass |
| 10,830,032 | B1 | 11/2020 | Zhang et al. |
| 10,830,225 | B2 | 11/2020 | Repaci |
| 10,859,203 | B1 | 12/2020 | Cui et al. |
| 10,864,487 | B1 | 12/2020 | Han et al. |
| 10,865,624 | B1 | 12/2020 | Cui et al. |
| 10,865,631 | B1 | 12/2020 | Zhang et al. |
| 10,870,093 | B1 | 12/2020 | Zhong et al. |
| 10,871,045 | B2 | 12/2020 | Fischer et al. |
| 10,907,459 | B1 | 2/2021 | Yeung et al. |
| 10,927,774 | B2 | 2/2021 | Cai et al. |
| 10,954,770 | B1 | 3/2021 | Yeung et al. |
| 10,954,855 | B1 | 3/2021 | Ji et al. |
| 10,961,614 | B1 | 3/2021 | Yeung et al. |
| 10,961,908 | B1 | 3/2021 | Yeung et al. |
| 10,961,912 | B1 | 3/2021 | Yeung et al. |
| 10,961,914 | B1 | 3/2021 | Yeung et al. |
| 10,961,993 | B1 | 3/2021 | Ji et al. |
| 10,961,995 | B2 | 3/2021 | Mayorca |
| 10,892,596 | B2 | 4/2021 | Yeung et al. |
| 10,968,837 | B1 | 4/2021 | Yeung et al. |
| 10,982,523 | B1 | 4/2021 | Hill et al. |
| 10,989,019 | B2 | 4/2021 | Cai et al. |
| 10,989,180 | B2 | 4/2021 | Yeung et al. |
| 10,995,564 | B2 | 5/2021 | Miller et al. |
| 11,002,189 | B2 | 5/2021 | Yeung et al. |
| 11,008,950 | B2 | 5/2021 | Ethier et al. |
| 11,015,423 | B1 | 5/2021 | Yeung et al. |
| 11,015,536 | B2 | 5/2021 | Yeung et al. |
| 11,015,594 | B2 | 5/2021 | Yeung et al. |
| 11,022,526 | B1 | 6/2021 | Yeung et al. |
| 11,028,677 | B1 | 6/2021 | Yeung et al. |
| 11,035,213 | B2 | 6/2021 | Dusterhoft et al. |
| 11,035,214 | B2 | 6/2021 | Cui et al. |
| 11,047,379 | B1 | 6/2021 | Li et al. |
| 10,895,202 | B1 | 7/2021 | Yeung et al. |
| 11,053,853 | B2 | 7/2021 | Li et al. |
| 11,060,455 | B1 | 7/2021 | Yeung et al. |
| 11,085,281 | B1 | 8/2021 | Yeung et al. |
| 11,085,282 | B2 | 8/2021 | Mazrooee et al. |
| 11,092,152 | B2 | 8/2021 | Yeung et al. |
| 11,098,651 | B1 | 8/2021 | Yeung et al. |
| 11,105,250 | B1 | 8/2021 | Zhang et al. |
| 11,105,266 | B2 | 8/2021 | Zhou et al. |
| 11,109,508 | B1 | 8/2021 | Yeung et al. |
| 11,111,768 | B1 | 9/2021 | Yeung et al. |
| 11,125,066 | B1 | 9/2021 | Yeung et al. |
| 11,125,156 | B2 | 9/2021 | Zhang et al. |
| 11,129,295 | B1 | 9/2021 | Yeung et al. |
| 11,143,000 | B2 | 10/2021 | Li et al. |
| 11,143,006 | B1 | 10/2021 | Zhang et al. |
| 11,149,533 | B1 | 10/2021 | Yeung et al. |
| 11,149,726 | B1 | 10/2021 | Yeung et al. |
| 11,156,159 | B1 | 10/2021 | Yeung et al. |
| 11,168,681 | B2 | 11/2021 | Boguski |
| 11,174,716 | B1 | 11/2021 | Yeung et al. |
| 11,193,360 | B1 | 12/2021 | Yeung et al. |
| 11,193,361 | B1 | 12/2021 | Yeung et al. |
| 11,205,880 | B1 | 12/2021 | Yeung et al. |
| 11,205,881 | B2 | 12/2021 | Yeung et al. |
| 11,208,879 | B1 | 12/2021 | Yeung et al. |
| 11,208,953 | B1 | 12/2021 | Yeung et al. |
| 11,220,895 | B1 | 1/2022 | Yeung et al. |
| 11,236,739 | B2 | 2/2022 | Yeung et al. |
| 11,242,737 | B2 | 2/2022 | Zhang et al. |
| 11,243,509 | B2 | 2/2022 | Cai et al. |
| 11,251,650 | B1 | 2/2022 | Liu et al. |
| 11,268,346 | B2 | 3/2022 | Yeung et al. |
| 11,280,266 | B2 | 3/2022 | Yeung et al. |
| RE49,083 | E | 5/2022 | Case et al. |
| 11,346,200 | B2 | 5/2022 | Cai et al. |
| 11,373,058 | B2 | 6/2022 | Jaaskelainen et al. |
| RE49,140 | E | 7/2022 | Case et al. |
| 11,377,943 | B2 | 7/2022 | Kriebel et al. |
| RE49,155 | E | 8/2022 | Case et al. |
| RE49,156 | E | 8/2022 | Case et al. |
| 11,401,927 | B2 | 8/2022 | Li et al. |
| 11,441,483 | B2 | 9/2022 | Li et al. |
| 11,448,122 | B2 | 9/2022 | Feng et al. |
| 2002/0126922 | A1 | 9/2002 | Cheng et al. |
| 2002/0197176 | A1 | 12/2002 | Kondo |
| 2003/0031568 | A1 | 2/2003 | Stiefel |
| 2003/0061819 | A1 | 4/2003 | Kuroki et al. |
| 2004/0016245 | A1 | 1/2004 | Pierson |
| 2004/0074238 | A1 | 4/2004 | Wantanabe et al. |
| 2004/0076526 | A1 | 4/2004 | Fukano et al. |
| 2004/0187950 | A1 | 9/2004 | Cohen et al. |
| 2004/0219040 | A1 | 11/2004 | Kugelev et al. |
| 2005/0051322 | A1 | 3/2005 | Speer |
| 2005/0056081 | A1 | 3/2005 | Gocho |
| 2005/0139286 | A1 | 6/2005 | Poulter |
| 2005/0196298 | A1 | 9/2005 | Manning |
| 2005/0226754 | A1 | 10/2005 | Orr et al. |
| 2005/0274134 | A1 | 12/2005 | Ryu et al. |
| 2006/0061091 | A1 | 3/2006 | Osterloh |
| 2006/0062914 | A1 | 3/2006 | Garg et al. |
| 2006/0196251 | A1 | 9/2006 | Richey |
| 2006/0211356 | A1 | 9/2006 | Grassman |
| 2006/0260331 | A1 | 11/2006 | Andreychuk |
| 2006/0272333 | A1 | 12/2006 | Sundin |
| 2007/0029090 | A1 | 2/2007 | Andreychuk et al. |
| 2007/0066406 | A1 | 3/2007 | Keller et al. |
| 2007/0098580 | A1 | 5/2007 | Petersen |
| 2007/0107981 | A1 | 5/2007 | Sicotte |
| 2007/0125544 | A1 | 6/2007 | Robinson et al. |
| 2007/0169543 | A1 | 7/2007 | Fazekas |
| 2007/0181212 | A1 | 8/2007 | Fell |
| 2007/0277982 | A1 | 12/2007 | Shampine et al. |
| 2007/0295569 | A1 | 12/2007 | Manzoor et al. |
| 2008/0006089 | A1 | 1/2008 | Adnan et al. |
| 2008/0098891 | A1 | 5/2008 | Feher |
| 2008/0161974 | A1 | 7/2008 | Alston |
| 2008/0264625 | A1 | 10/2008 | Ochoa |
| 2008/0264649 | A1 | 10/2008 | Crawford |
| 2008/0298982 | A1 | 12/2008 | Pabst |
| 2009/0064685 | A1 | 3/2009 | Busekros et al. |
| 2009/0068031 | A1 | 3/2009 | Gambier et al. |
| 2009/0092510 | A1 | 4/2009 | Williams et al. |
| 2009/0124191 | A1 | 5/2009 | Van Becelaere et al. |
| 2009/0178412 | A1 | 7/2009 | Spytek |
| 2009/0249794 | A1 | 10/2009 | Wilkes et al. |
| 2009/0252616 | A1 | 10/2009 | Brunet et al. |
| 2009/0308602 | A1 | 12/2009 | Bruins et al. |
| 2010/0019626 | A1 | 1/2010 | Stout et al. |
| 2010/0071899 | A1 | 3/2010 | Coquilleau et al. |
| 2010/0218508 | A1 | 9/2010 | Brown et al. |
| 2010/0300683 | A1 | 12/2010 | Looper et al. |
| 2010/0310384 | A1 | 12/2010 | Stephenson et al. |
| 2011/0041681 | A1 | 2/2011 | Duerr |
| 2011/0052423 | A1 | 3/2011 | Gambier et al. |
| 2011/0054704 | A1 | 3/2011 | Karpman et al. |
| 2011/0085924 | A1 | 4/2011 | Shampine et al. |
| 2011/0146244 | A1 | 6/2011 | Farman et al. |

(56) References Cited

U.S. PATENT DOCUMENTS

2011/0146246 A1 6/2011 Farman et al.
2011/0173991 A1 7/2011 Dean
2011/0197988 A1 8/2011 Van Vliet et al.
2011/0241888 A1 10/2011 Lu et al.
2011/0265443 A1 11/2011 Ansari
2011/0272158 A1 11/2011 Neal
2012/0023973 A1 2/2012 Mayorca
2012/0048242 A1 3/2012 Surnilla et al.
2012/0085541 A1 4/2012 Love et al.
2012/0137699 A1 6/2012 Montagne et al.
2012/0179444 A1 7/2012 Ganguly et al.
2012/0192542 A1 8/2012 Chillar et al.
2012/0199001 A1 8/2012 Chillar et al.
2012/0204627 A1 8/2012 Anderl et al.
2012/0255734 A1 10/2012 Coli et al.
2012/0310509 A1 12/2012 Pardo et al.
2012/0324903 A1 12/2012 Dewis et al.
2013/0068307 A1 3/2013 Hains et al.
2013/0087045 A1 4/2013 Sullivan et al.
2013/0087945 A1 4/2013 Kusters et al.
2013/0134702 A1 5/2013 Boraas et al.
2013/0189915 A1 7/2013 Hazard
2013/0255953 A1 10/2013 Tudor
2013/0259707 A1 10/2013 Yin
2013/0284455 A1 10/2013 Kajaria et al.
2013/0300341 A1 11/2013 Gillette
2013/0306322 A1 11/2013 Sanborn
2014/0010671 A1 1/2014 Cryer et al.
2014/0013768 A1 1/2014 Laing et al.
2014/0032082 A1 1/2014 Gehrke et al.
2014/0044517 A1 2/2014 Saha et al.
2014/0048253 A1 2/2014 Andreychuk
2014/0090729 A1 4/2014 Coulter et al.
2014/0090742 A1 4/2014 Coskrey et al.
2014/0094105 A1 4/2014 Lundh et al.
2014/0095114 A1 4/2014 Thomeer et al.
2014/0095554 A1 4/2014 Thomeer et al.
2014/0123621 A1 5/2014 Driessens et al.
2014/0130422 A1 5/2014 Laing et al.
2014/0138079 A1 5/2014 Broussard et al.
2014/0144641 A1 5/2014 Chandler
2014/0147291 A1 5/2014 Burnette
2014/0158345 A1 6/2014 Jang et al.
2014/0196459 A1 7/2014 Futa et al.
2014/0216736 A1 8/2014 Leugemors et al.
2014/0219824 A1 8/2014 Burnette
2014/0250845 A1 9/2014 Jackson et al.
2014/0251623 A1 9/2014 Lestz et al.
2014/0277772 A1 9/2014 Lopez et al.
2014/0290266 A1 10/2014 Veilleux, Jr. et al.
2014/0318638 A1 10/2014 Harwood et al.
2015/0027730 A1 1/2015 Hall et al.
2015/0078924 A1 3/2015 Zhang et al.
2015/0101344 A1 4/2015 Jarrier et al.
2015/0114652 A1 4/2015 Lestz et al.
2015/0129210 A1 5/2015 Chong et al.
2015/0135659 A1 5/2015 Jarrier et al.
2015/0159553 A1 6/2015 Kippel et al.
2015/0192117 A1 7/2015 Bridges
2015/0204148 A1 7/2015 Liu et al.
2015/0204322 A1 7/2015 Iund et al.
2015/0211512 A1 7/2015 Wiegman et al.
2015/0214816 A1 7/2015 Raad
2015/0217672 A1 8/2015 Shampine et al.
2015/0226140 A1 8/2015 Zhang et al.
2015/0252661 A1 9/2015 Glass
2015/0275891 A1 10/2015 Chong et al.
2015/0337730 A1 11/2015 Kupiszewski et al.
2015/0340864 A1 11/2015 Compton
2015/0345385 A1 12/2015 Santini
2015/0369351 A1 12/2015 Hermann et al.
2016/0032703 A1 2/2016 Broussard et al.
2016/0032836 A1 2/2016 Hawkinson et al.
2016/0102581 A1 4/2016 Del Bono
2016/0105022 A1 4/2016 Oehring et al.
2016/0108713 A1 4/2016 Dunaeva et al.
2016/0168979 A1 6/2016 Zhang et al.
2016/0177675 A1 6/2016 Morris et al.
2016/0177945 A1 6/2016 Byrne et al.
2016/0186671 A1 6/2016 Austin et al.
2016/0195082 A1 7/2016 Wiegman et al.
2016/0215774 A1 7/2016 Oklejas et al.
2016/0230525 A1 8/2016 Lestz et al.
2016/0244314 A1 8/2016 Van Vliet et al.
2016/0248230 A1 8/2016 Tawy et al.
2016/0253634 A1 9/2016 Thomeer et al.
2016/0258267 A1 9/2016 Payne et al.
2016/0273328 A1 9/2016 Oehring
2016/0273346 A1 9/2016 Tang et al.
2016/0290114 A1 10/2016 Oehring et al.
2016/0319650 A1 11/2016 Oehring et al.
2016/0326845 A1 11/2016 Djikpesse et al.
2016/0348479 A1 12/2016 Oehring et al.
2016/0369609 A1 12/2016 Morris et al.
2017/0009905 A1 1/2017 Arnold
2017/0016433 A1 1/2017 Chong et al.
2017/0030177 A1 2/2017 Oehring et al.
2017/0038137 A1 2/2017 Turney
2017/0045055 A1 2/2017 Hoefel et al.
2017/0074074 A1 3/2017 Joseph et al.
2017/0074076 A1 3/2017 Joseph et al.
2017/0074089 A1 3/2017 Agarwal et al.
2017/0082110 A1 3/2017 Lammers
2017/0089189 A1 3/2017 Norris et al.
2017/0114613 A1 4/2017 Lecerf et al.
2017/0114625 A1 4/2017 Norris et al.
2017/0122310 A1 5/2017 Ladron de Guevara
2017/0131174 A1 5/2017 Enev et al.
2017/0145918 A1 5/2017 Oehring et al.
2017/0191350 A1 7/2017 Johns et al.
2017/0218727 A1 8/2017 Oehring et al.
2017/0226839 A1 8/2017 Broussard et al.
2017/0226998 A1 8/2017 Zhang et al.
2017/0227002 A1 8/2017 Mikulski et al.
2017/0233103 A1 8/2017 Teicholz et al.
2017/0234165 A1 8/2017 Kersey et al.
2017/0234308 A1 8/2017 Buckley
2017/0241336 A1 8/2017 Jones et al.
2017/0248034 A1 8/2017 Dzieciol et al.
2017/0248308 A1 8/2017 Makarychev-Mikhailov et al.
2017/0275149 A1 9/2017 Schmidt
2017/0288400 A1 10/2017 Williams
2017/0292409 A1 10/2017 Aguilar et al.
2017/0302135 A1 10/2017 Cory
2017/0305736 A1 10/2017 Haile et al.
2017/0306847 A1 10/2017 Suciu et al.
2017/0306936 A1 10/2017 Dole
2017/0322086 A1 11/2017 Luharuka
2017/0333086 A1 11/2017 Jackson
2017/0334448 A1 11/2017 Schwunk
2017/0335842 A1 11/2017 Robinson et al.
2017/0350471 A1 12/2017 Steidl et al.
2017/0370199 A1 12/2017 Witkowski et al.
2017/0370480 A1 12/2017 Witkowski et al.
2018/0034280 A1 2/2018 Pedersen
2018/0038328 A1 2/2018 Louven et al.
2018/0041093 A1 2/2018 Miranda
2018/0045202 A1 2/2018 Crom
2018/0038216 A1 3/2018 Zhang et al.
2018/0058171 A1 3/2018 Roesner et al.
2018/0087499 A1 3/2018 Zhang et al.
2018/0087996 A1 3/2018 De La Cruz
2018/0156210 A1 6/2018 Oehring et al.
2018/0172294 A1 6/2018 Owen
2018/0183219 A1 6/2018 Oehring et al.
2018/0186442 A1 7/2018 Maier
2018/0187662 A1 7/2018 Hill et al.
2018/0209415 A1 7/2018 Zhang et al.
2018/0223640 A1 8/2018 Keihany et al.
2018/0224044 A1 8/2018 Penney
2018/0229998 A1 8/2018 Shock
2018/0258746 A1 9/2018 Broussard et al.
2018/0266412 A1 9/2018 Stokkevag et al.
2018/0278124 A1 9/2018 Oehring et al.

(56) References Cited

U.S. PATENT DOCUMENTS

| | | | |
|---|---|---|---|
| 2018/0283102 | A1 | 10/2018 | Cook |
| 2018/0283618 | A1 | 10/2018 | Cook |
| 2018/0284817 | A1 | 10/2018 | Cook et al. |
| 2018/0290877 | A1 | 10/2018 | Shock |
| 2018/0291781 | A1 | 10/2018 | Pedrini |
| 2018/0298731 | A1 | 10/2018 | Bishop |
| 2018/0298735 | A1 | 10/2018 | Conrad |
| 2018/0307255 | A1 | 10/2018 | Bishop |
| 2018/0313456 | A1 | 11/2018 | Bayyouk et al. |
| 2018/0328157 | A1 | 11/2018 | Bishop |
| 2018/0334893 | A1 | 11/2018 | Oehring |
| 2018/0363435 | A1 | 12/2018 | Coli et al. |
| 2018/0363436 | A1 | 12/2018 | Coli et al. |
| 2018/0363437 | A1 | 12/2018 | Coli et al. |
| 2018/0363438 | A1 | 12/2018 | Coli et al. |
| 2019/0003272 | A1 | 1/2019 | Morris et al. |
| 2019/0003329 | A1 | 1/2019 | Morris et al. |
| 2019/0010793 | A1 | 1/2019 | Hinderliter |
| 2019/0011051 | A1 | 1/2019 | Yeung |
| 2019/0048993 | A1 | 2/2019 | Akiyama et al. |
| 2019/0063263 | A1 | 2/2019 | Davis et al. |
| 2019/0063341 | A1 | 2/2019 | Davis |
| 2019/0067991 | A1 | 2/2019 | Davis et al. |
| 2019/0071992 | A1 | 3/2019 | Feng |
| 2019/0072005 | A1 | 3/2019 | Fisher et al. |
| 2019/0078471 | A1 | 3/2019 | Braglia et al. |
| 2019/0091619 | A1 | 3/2019 | Huang |
| 2019/0106316 | A1 | 4/2019 | Van Vliet et al. |
| 2019/0106970 | A1 | 4/2019 | Oehring |
| 2019/0112908 | A1 | 4/2019 | Coli et al. |
| 2019/0112910 | A1 | 4/2019 | Oehring et al. |
| 2019/0119096 | A1 | 4/2019 | Haile et al. |
| 2019/0120024 | A1 | 4/2019 | Oehring et al. |
| 2019/0120031 | A1 | 4/2019 | Gilje |
| 2019/0120134 | A1 | 4/2019 | Goleczka et al. |
| 2019/0128247 | A1 | 5/2019 | Douglas, III |
| 2019/0128288 | A1 | 5/2019 | Konada et al. |
| 2019/0131607 | A1 | 5/2019 | Gillette |
| 2019/0136677 | A1 | 5/2019 | Shampine et al. |
| 2019/0153843 | A1 | 5/2019 | Headrick |
| 2019/0153938 | A1 | 5/2019 | Hammoud |
| 2019/0154020 | A1 | 5/2019 | Glass |
| 2019/0155318 | A1 | 5/2019 | Meunier |
| 2019/0264667 | A1 | 5/2019 | Byrne |
| 2019/0178234 | A1 | 6/2019 | Beisel |
| 2019/0178235 | A1 | 6/2019 | Coskrey et al. |
| 2019/0185312 | A1 | 6/2019 | Bush et al. |
| 2019/0203572 | A1 | 7/2019 | Morris et al. |
| 2019/0204021 | A1 | 7/2019 | Morris et al. |
| 2019/0211661 | A1 | 7/2019 | Reckies et al. |
| 2019/0211814 | A1 | 7/2019 | Weightman et al. |
| 2019/0217258 | A1 | 7/2019 | Bishop |
| 2019/0226317 | A1 | 7/2019 | Payne et al. |
| 2019/0245348 | A1 | 8/2019 | Hinderliter et al. |
| 2019/0249652 | A1 | 8/2019 | Stephenson et al. |
| 2019/0249754 | A1 | 8/2019 | Oehring et al. |
| 2019/0257297 | A1 | 8/2019 | Botting et al. |
| 2019/0277279 | A1 | 9/2019 | Byrne et al. |
| 2019/0277295 | A1 | 9/2019 | Clyburn et al. |
| 2019/0309585 | A1 | 10/2019 | Miller et al. |
| 2019/0316447 | A1 | 10/2019 | Oehring et al. |
| 2019/0316456 | A1 | 10/2019 | Beisel et al. |
| 2019/0323337 | A1 | 10/2019 | Glass et al. |
| 2019/0330923 | A1 | 10/2019 | Gable et al. |
| 2019/0331117 | A1 | 10/2019 | Gable et al. |
| 2019/0337392 | A1 | 11/2019 | Joshi et al. |
| 2019/0338762 | A1 | 11/2019 | Curry et al. |
| 2019/0345920 | A1 | 11/2019 | Suijaatmadja et al. |
| 2019/0353103 | A1 | 11/2019 | Roberge |
| 2019/0356199 | A1 | 11/2019 | Morris et al. |
| 2019/0376449 | A1 | 12/2019 | Carrell |
| 2019/0383123 | A1 | 12/2019 | Hinderliter |
| 2020/0003205 | A1 | 1/2020 | Stokkevåg et al. |
| 2020/0011165 | A1 | 1/2020 | George et al. |
| 2020/0040878 | A1 | 2/2020 | Morris |
| 2020/0049136 | A1 | 2/2020 | Stephenson |
| 2020/0049153 | A1 | 2/2020 | Headrick et al. |
| 2020/0071998 | A1 | 3/2020 | Oehring et al. |
| 2020/0072201 | A1 | 3/2020 | Marica |
| 2020/0088202 | A1 | 3/2020 | Sigmar et al. |
| 2020/0095854 | A1 | 3/2020 | Hinderliter |
| 2020/0109610 | A1 | 4/2020 | Husoy et al. |
| 2020/0132058 | A1 | 4/2020 | Mollatt |
| 2020/0141219 | A1 | 5/2020 | Oehring et al. |
| 2020/0141907 | A1 | 5/2020 | Meck et al. |
| 2020/0166026 | A1 | 5/2020 | Marica |
| 2020/0206704 | A1 | 7/2020 | Chong |
| 2020/0208733 | A1 | 7/2020 | Kim |
| 2020/0223648 | A1 | 7/2020 | Herman et al. |
| 2020/0224645 | A1 | 7/2020 | Buckley |
| 2020/0232454 | A1 | 7/2020 | Chretien et al. |
| 2020/0256333 | A1 | 8/2020 | Suijaatmadja |
| 2020/0263498 | A1 | 8/2020 | Fischer et al. |
| 2020/0263525 | A1 | 8/2020 | Reid |
| 2020/0263526 | A1 | 8/2020 | Fischer et al. |
| 2020/0263527 | A1 | 8/2020 | Fischer et al. |
| 2020/0263528 | A1 | 8/2020 | Fischer et al. |
| 2020/0267888 | A1 | 8/2020 | Putz |
| 2020/0291731 | A1 | 9/2020 | Haiderer et al. |
| 2020/0295574 | A1 | 9/2020 | Batsch-Smith |
| 2020/0309113 | A1 | 10/2020 | Hunter et al. |
| 2020/0325752 | A1 | 10/2020 | Clark et al. |
| 2020/0325760 | A1 | 10/2020 | Markham |
| 2020/0325761 | A1 | 10/2020 | Williams |
| 2020/0325893 | A1 | 10/2020 | Kraige et al. |
| 2020/0332784 | A1 | 10/2020 | Zhang et al. |
| 2020/0332788 | A1 | 10/2020 | Cui et al. |
| 2020/0340313 | A1 | 10/2020 | Fischer et al. |
| 2020/0340340 | A1 | 10/2020 | Oehring et al. |
| 2020/0340344 | A1 | 10/2020 | Reckels et al. |
| 2020/0340404 | A1 | 10/2020 | Stockstill |
| 2020/0347725 | A1 | 11/2020 | Morris et al. |
| 2020/0354928 | A1 | 11/2020 | Wehler et al. |
| 2020/0362760 | A1 | 11/2020 | Morenko et al. |
| 2020/0362764 | A1 | 11/2020 | Saintignan et al. |
| 2020/0370394 | A1 | 11/2020 | Cai et al. |
| 2020/0370408 | A1 | 11/2020 | Cai et al. |
| 2020/0370429 | A1 | 11/2020 | Cai et al. |
| 2020/0371490 | A1 | 11/2020 | Cai et al. |
| 2020/0340322 | A1 | 12/2020 | Sizemore et al. |
| 2020/0386222 | A1 | 12/2020 | Pham et al. |
| 2020/0392826 | A1 | 12/2020 | Cui et al. |
| 2020/0392827 | A1 | 12/2020 | George et al. |
| 2020/0393088 | A1 | 12/2020 | Sizemore et al. |
| 2020/0398238 | A1 | 12/2020 | Zhong et al. |
| 2020/0400000 | A1 | 12/2020 | Ghasripoor et al. |
| 2020/0400005 | A1 | 12/2020 | Han et al. |
| 2020/0407625 | A1 | 12/2020 | Stephenson |
| 2020/0408071 | A1 | 12/2020 | Li et al. |
| 2020/0408144 | A1 | 12/2020 | Feng et al. |
| 2020/0408147 | A1 | 12/2020 | Zhang et al. |
| 2020/0408149 | A1 | 12/2020 | Li et al. |
| 2021/0025324 | A1 | 1/2021 | Morris et al. |
| 2021/0025383 | A1 | 1/2021 | Bodishbaugh et al. |
| 2021/0032961 | A1 | 2/2021 | Hinderliter et al. |
| 2021/0054727 | A1 | 2/2021 | Floyd |
| 2021/0071503 | A1 | 3/2021 | Ogg et al. |
| 2021/0071574 | A1 | 3/2021 | Feng et al. |
| 2021/0071579 | A1 | 3/2021 | Li et al. |
| 2021/0071654 | A1 | 3/2021 | Brunson |
| 2021/0071752 | A1 | 3/2021 | Cui et al. |
| 2021/0079758 | A1 | 3/2021 | Yeung et al. |
| 2021/0079851 | A1 | 3/2021 | Yeung et al. |
| 2021/0086851 | A1 | 3/2021 | Zhang et al. |
| 2021/0087883 | A1 | 3/2021 | Zhang et al. |
| 2021/0087916 | A1 | 3/2021 | Zhang et al. |
| 2021/0087925 | A1 | 3/2021 | Heidari et al. |
| 2021/0087943 | A1 | 3/2021 | Cui et al. |
| 2021/0088042 | A1 | 3/2021 | Zhang et al. |
| 2021/0123425 | A1 | 4/2021 | Cui et al. |
| 2021/0123434 | A1 | 4/2021 | Cui et al. |
| 2021/0123435 | A1 | 4/2021 | Cui et al. |
| 2021/0131409 | A1 | 5/2021 | Cui et al. |
| 2021/0156240 | A1 | 5/2021 | Cicci et al. |

(56) References Cited

U.S. PATENT DOCUMENTS

| | | | |
|---|---|---|---|
| 2021/0156241 | A1 | 5/2021 | Cook |
| 2021/0172282 | A1 | 6/2021 | Wang et al. |
| 2021/0180517 | A1 | 6/2021 | Zhou et al. |
| 2021/0199110 | A1 | 7/2021 | Albert et al. |
| 2021/0222690 | A1 | 7/2021 | Beisel |
| 2021/0239112 | A1 | 8/2021 | Buckley |
| 2021/0246774 | A1 | 8/2021 | Cui et al. |
| 2021/0270264 | A1 | 9/2021 | Byrne |
| 2021/0285311 | A1 | 9/2021 | Ji et al. |
| 2021/0285432 | A1 | 9/2021 | Ji et al. |
| 2021/0301807 | A1 | 9/2021 | Cui et al. |
| 2021/0306720 | A1 | 9/2021 | Sandoval et al. |
| 2021/0308638 | A1 | 10/2021 | Zhong et al. |
| 2021/0348475 | A1 | 11/2021 | Yeung et al. |
| 2021/0348476 | A1 | 11/2021 | Yeung et al. |
| 2021/0348477 | A1 | 11/2021 | Yeung et al. |
| 2021/0355927 | A1 | 11/2021 | Jian et al. |
| 2021/0372395 | A1 | 12/2021 | Li et al. |
| 2021/0388760 | A1 | 12/2021 | Feng et al. |
| 2022/0082007 | A1 | 3/2022 | Zhang et al. |
| 2022/0090476 | A1 | 3/2022 | Zhang et al. |
| 2022/0090477 | A1 | 3/2022 | Zhang et al. |
| 2022/0090478 | A1 | 3/2022 | Zhang et al. |
| 2022/0112892 | A1 | 4/2022 | Cui et al. |
| 2022/0120262 | A1 | 4/2022 | Ji et al. |
| 2022/0145740 | A1 | 5/2022 | Yuan et al. |
| 2022/0154775 | A1 | 5/2022 | Liu et al. |
| 2022/0155373 | A1 | 5/2022 | Liu et al. |
| 2022/0162931 | A1 | 5/2022 | Zhong et al. |
| 2022/0162991 | A1 | 5/2022 | Zhang et al. |
| 2022/0181859 | A1 | 6/2022 | Ji et al. |
| 2022/0186724 | A1 | 6/2022 | Chang et al. |
| 2022/0213777 | A1 | 7/2022 | Cui et al. |
| 2022/0220836 | A1 | 7/2022 | Zhang et al. |
| 2022/0224087 | A1 | 7/2022 | Ji et al. |
| 2022/0228468 | A1 | 7/2022 | Cui et al. |
| 2022/0228469 | A1 | 7/2022 | Zhang et al. |
| 2022/0235639 | A1 | 7/2022 | Zhang et al. |
| 2022/0235640 | A1 | 7/2022 | Mao et al. |
| 2022/0235641 | A1 | 7/2022 | Zhang et al. |
| 2022/0235642 | A1 | 7/2022 | Zhang et al. |
| 2022/0235802 | A1 | 7/2022 | Jiang et al. |
| 2022/0242297 | A1 | 8/2022 | Tian et al. |
| 2022/0243613 | A1 | 8/2022 | Ji et al. |
| 2022/0243724 | A1 | 8/2022 | Li et al. |
| 2022/0250000 | A1 | 8/2022 | Zhang et al. |
| 2022/0255319 | A1 | 8/2022 | Liu et al. |
| 2022/0258659 | A1 | 8/2022 | Cui et al. |
| 2022/0259947 | A1 | 8/2022 | Li et al. |
| 2022/0259964 | A1 | 8/2022 | Zhang et al. |
| 2022/0268201 | A1 | 8/2022 | Feng et al. |
| 2022/0282606 | A1 | 9/2022 | Zhong et al. |
| 2022/0282726 | A1 | 9/2022 | Zhang et al. |
| 2022/0290549 | A1 | 9/2022 | Zhang et al. |
| 2022/0294194 | A1 | 9/2022 | Cao et al. |
| 2022/0298906 | A1 | 9/2022 | Zhong et al. |

FOREIGN PATENT DOCUMENTS

| | | | |
|---|---|---|---|
| CA | 2043184 | | 8/1994 |
| CA | 2829762 | | 9/2012 |
| CA | 2876687 | A1 | 5/2014 |
| CA | 2693567 | | 9/2014 |
| CA | 2964597 | | 10/2017 |
| CA | 2876687 | C | 4/2019 |
| CA | 2919175 | | 3/2021 |
| CN | 2622404 | | 6/2004 |
| CN | 2779054 | | 5/2006 |
| CN | 2890325 | | 4/2007 |
| CN | 200964929 | Y | 10/2007 |
| CN | 101323151 | A | 12/2008 |
| CN | 201190660 | Y | 2/2009 |
| CN | 201190892 | Y | 2/2009 |
| CN | 201190893 | Y | 2/2009 |
| CN | 101414171 | A | 4/2009 |
| CN | 201215073 | Y | 4/2009 |
| CN | 201236650 | Y | 5/2009 |
| CN | 201275542 | Y | 7/2009 |
| CN | 201275801 | Y | 7/2009 |
| CN | 201333385 | Y | 10/2009 |
| CN | 201443300 | U | 4/2010 |
| CN | 201496415 | U | 6/2010 |
| CN | 201501365 | U | 6/2010 |
| CN | 201507271 | U | 6/2010 |
| CN | 101323151 | B | 7/2010 |
| CN | 201560210 | U | 8/2010 |
| CN | 201581862 | U | 9/2010 |
| CN | 201610728 | U | 10/2010 |
| CN | 201610751 | U | 10/2010 |
| CN | 201618530 | U | 11/2010 |
| CN | 201661255 | U | 12/2010 |
| CN | 101949382 | | 1/2011 |
| CN | 201756927 | U | 3/2011 |
| CN | 101414171 | B | 5/2011 |
| CN | 102128011 | A | 7/2011 |
| CN | 102140898 | A | 8/2011 |
| CN | 102155172 | A | 8/2011 |
| CN | 102182904 | | 9/2011 |
| CN | 202000930 | U | 10/2011 |
| CN | 202055781 | U | 11/2011 |
| CN | 202082265 | U | 12/2011 |
| CN | 202100216 | U | 1/2012 |
| CN | 202100217 | U | 1/2012 |
| CN | 202100815 | U | 1/2012 |
| CN | 202124340 | U | 1/2012 |
| CN | 202140051 | U | 2/2012 |
| CN | 202140080 | U | 2/2012 |
| CN | 202144789 | U | 2/2012 |
| CN | 202144943 | U | 2/2012 |
| CN | 202149354 | U | 2/2012 |
| CN | 102383748 | A | 3/2012 |
| CN | 202156297 | U | 3/2012 |
| CN | 202158355 | U | 3/2012 |
| CN | 202163504 | U | 3/2012 |
| CN | 202165236 | U | 3/2012 |
| CN | 202180866 | U | 4/2012 |
| CN | 202181875 | U | 4/2012 |
| CN | 202187744 | U | 4/2012 |
| CN | 202191854 | U | 4/2012 |
| CN | 202250008 | U | 5/2012 |
| CN | 101885307 | | 7/2012 |
| CN | 102562020 | A | 7/2012 |
| CN | 202326156 | U | 7/2012 |
| CN | 202370773 | U | 8/2012 |
| CN | 202417397 | U | 9/2012 |
| CN | 202417461 | U | 9/2012 |
| CN | 102729335 | A | 10/2012 |
| CN | 202463955 | U | 10/2012 |
| CN | 202463957 | U | 10/2012 |
| CN | 202467739 | U | 10/2012 |
| CN | 202467801 | U | 10/2012 |
| CN | 202531016 | U | 11/2012 |
| CN | 202544794 | U | 11/2012 |
| CN | 102825039 | A | 12/2012 |
| CN | 202578592 | U | 12/2012 |
| CN | 202579164 | U | 12/2012 |
| CN | 202594808 | U | 12/2012 |
| CN | 202594928 | U | 12/2012 |
| CN | 202596615 | U | 12/2012 |
| CN | 202596616 | U | 12/2012 |
| CN | 102849880 | A | 1/2013 |
| CN | 102889191 | A | 1/2013 |
| CN | 202641535 | U | 1/2013 |
| CN | 202645475 | U | 1/2013 |
| CN | 202666716 | U | 1/2013 |
| CN | 202669645 | U | 1/2013 |
| CN | 202669944 | U | 1/2013 |
| CN | 202671336 | U | 1/2013 |
| CN | 202673269 | U | 1/2013 |
| CN | 202751982 | U | 2/2013 |
| CN | 102963629 | A | 3/2013 |
| CN | 202767964 | U | 3/2013 |
| CN | 202789791 | U | 3/2013 |
| CN | 202789792 | U | 3/2013 |

(56) References Cited

FOREIGN PATENT DOCUMENTS

| | | | |
|---|---|---|---|
| CN | 202810717 | U | 3/2013 |
| CN | 202827276 | U | 3/2013 |
| CN | 202833093 | U | 3/2013 |
| CN | 202833370 | U | 3/2013 |
| CN | 102140898 | B | 4/2013 |
| CN | 202895467 | U | 4/2013 |
| CN | 202926404 | U | 5/2013 |
| CN | 202935216 | U | 5/2013 |
| CN | 202935798 | U | 5/2013 |
| CN | 202935816 | U | 5/2013 |
| CN | 202970631 | U | 6/2013 |
| CN | 103223315 | A | 7/2013 |
| CN | 203050598 | U | 7/2013 |
| CN | 103233714 | A | 8/2013 |
| CN | 103233715 | A | 8/2013 |
| CN | 103245523 | A | 8/2013 |
| CN | 103247220 | A | 8/2013 |
| CN | 103253839 | A | 8/2013 |
| CN | 103277290 | A | 9/2013 |
| CN | 103321782 | A | 9/2013 |
| CN | 203170270 | U | 9/2013 |
| CN | 203172509 | U | 9/2013 |
| CN | 203175778 | U | 9/2013 |
| CN | 203175787 | U | 9/2013 |
| CN | 102849880 | B | 10/2013 |
| CN | 203241231 | U | 10/2013 |
| CN | 203244941 | U | 10/2013 |
| CN | 203244942 | U | 10/2013 |
| CN | 203303798 | U | 11/2013 |
| CN | 102155172 | B | 12/2013 |
| CN | 102729335 | B | 12/2013 |
| CN | 103420532 | A | 12/2013 |
| CN | 203321792 | U | 12/2013 |
| CN | 203412658 | | 1/2014 |
| CN | 203420697 | U | 2/2014 |
| CN | 203480755 | U | 3/2014 |
| CN | 103711437 | A | 4/2014 |
| CN | 203531815 | U | 4/2014 |
| CN | 203531871 | U | 4/2014 |
| CN | 203531883 | U | 4/2014 |
| CN | 203556164 | U | 4/2014 |
| CN | 203558809 | U | 4/2014 |
| CN | 203559861 | U | 4/2014 |
| CN | 203559893 | U | 4/2014 |
| CN | 203560189 | U | 4/2014 |
| CN | 102704870 | B | 5/2014 |
| CN | 203611843 | U | 5/2014 |
| CN | 203612531 | U | 5/2014 |
| CN | 203612843 | U | 5/2014 |
| CN | 203614062 | U | 5/2014 |
| CN | 203614388 | U | 5/2014 |
| CN | 203621045 | U | 6/2014 |
| CN | 203621046 | U | 6/2014 |
| CN | 203621051 | U | 6/2014 |
| CN | 203640993 | U | 6/2014 |
| CN | 203655221 | U | 6/2014 |
| CN | 103899280 | A | 7/2014 |
| CN | 103923670 | A | 7/2014 |
| CN | 203685052 | U | 7/2014 |
| CN | 203716936 | U | 7/2014 |
| CN | 103990410 | A | 8/2014 |
| CN | 103993869 | A | 8/2014 |
| CN | 203754009 | U | 8/2014 |
| CN | 203754025 | U | 8/2014 |
| CN | 203754341 | U | 8/2014 |
| CN | 203756614 | U | 8/2014 |
| CN | 203770264 | U | 8/2014 |
| CN | 203784519 | U | 8/2014 |
| CN | 203784520 | U | 8/2014 |
| CN | 104057864 | A | 9/2014 |
| CN | 203819819 | U | 9/2014 |
| CN | 203823431 | U | 9/2014 |
| CN | 203835337 | U | 9/2014 |
| CN | 104074500 | A | 10/2014 |
| CN | 203876633 | U | 10/2014 |
| CN | 203876636 | U | 10/2014 |
| CN | 203877364 | U | 10/2014 |
| CN | 203877365 | U | 10/2014 |
| CN | 203877375 | U | 10/2014 |
| CN | 203877424 | U | 10/2014 |
| CN | 203879476 | U | 10/2014 |
| CN | 203879479 | U | 10/2014 |
| CN | 203890292 | U | 10/2014 |
| CN | 203899476 | U | 10/2014 |
| CN | 203906206 | U | 10/2014 |
| CN | 104150728 | A | 11/2014 |
| CN | 104176522 | A | 12/2014 |
| CN | 104196464 | A | 12/2014 |
| CN | 104234651 | A | 12/2014 |
| CN | 203971841 | U | 12/2014 |
| CN | 203975450 | U | 12/2014 |
| CN | 204020788 | U | 12/2014 |
| CN | 204021980 | U | 12/2014 |
| CN | 204024625 | U | 12/2014 |
| CN | 204051401 | U | 12/2014 |
| CN | 204060661 | U | 12/2014 |
| CN | 104260672 | A | 1/2015 |
| CN | 104314512 | A | 1/2015 |
| CN | 204077478 | U | 1/2015 |
| CN | 204077526 | U | 1/2015 |
| CN | 204078307 | U | 1/2015 |
| CN | 204083051 | U | 1/2015 |
| CN | 204113168 | U | 1/2015 |
| CN | 104340682 | A | 2/2015 |
| CN | 104358536 | A | 2/2015 |
| CN | 104369687 | A | 2/2015 |
| CN | 104402178 | A | 3/2015 |
| CN | 104402185 | A | 3/2015 |
| CN | 104402186 | A | 3/2015 |
| CN | 204209819 | U | 3/2015 |
| CN | 204224560 | U | 3/2015 |
| CN | 204225813 | U | 3/2015 |
| CN | 204225839 | U | 3/2015 |
| CN | 104533392 | A | 4/2015 |
| CN | 104563938 | A | 4/2015 |
| CN | 104563994 | A | 4/2015 |
| CN | 104563995 | A | 4/2015 |
| CN | 104563998 | A | 4/2015 |
| CN | 104564033 | A | 4/2015 |
| CN | 204257122 | U | 4/2015 |
| CN | 204283610 | U | 4/2015 |
| CN | 204283782 | U | 4/2015 |
| CN | 204297682 | U | 4/2015 |
| CN | 204299810 | U | 4/2015 |
| CN | 103223315 | B | 5/2015 |
| CN | 104594857 | A | 5/2015 |
| CN | 104595493 | A | 5/2015 |
| CN | 104612647 | A | 5/2015 |
| CN | 104612928 | A | 5/2015 |
| CN | 104632126 | A | 5/2015 |
| CN | 204325094 | U | 5/2015 |
| CN | 204325098 | U | 5/2015 |
| CN | 204326983 | U | 5/2015 |
| CN | 204326985 | U | 5/2015 |
| CN | 204344040 | U | 5/2015 |
| CN | 204344095 | U | 5/2015 |
| CN | 104727797 | A | 6/2015 |
| CN | 204402414 | U | 6/2015 |
| CN | 204402423 | U | 6/2015 |
| CN | 204402450 | U | 6/2015 |
| CN | 103247220 | B | 7/2015 |
| CN | 104803568 | A | 7/2015 |
| CN | 204436360 | U | 7/2015 |
| CN | 204457524 | U | 7/2015 |
| CN | 204472485 | U | 7/2015 |
| CN | 204473625 | U | 7/2015 |
| CN | 204477303 | U | 7/2015 |
| CN | 204493095 | U | 7/2015 |
| CN | 204493309 | U | 7/2015 |
| CN | 103253839 | B | 8/2015 |
| CN | 104820372 | A | 8/2015 |
| CN | 104832093 | A | 8/2015 |
| CN | 104863523 | A | 8/2015 |
| CN | 204552723 | U | 8/2015 |

(56) References Cited

FOREIGN PATENT DOCUMENTS

| | | | |
|---|---|---|---|
| CN | 204553866 | U | 8/2015 |
| CN | 204571831 | U | 8/2015 |
| CN | 204703814 | U | 10/2015 |
| CN | 204703833 | U | 10/2015 |
| CN | 204703834 | U | 10/2015 |
| CN | 105092401 | A | 11/2015 |
| CN | 103233715 | B | 12/2015 |
| CN | 103790927 | | 12/2015 |
| CN | 105207097 | | 12/2015 |
| CN | 204831952 | U | 12/2015 |
| CN | 204899777 | U | 12/2015 |
| CN | 102602323 | | 1/2016 |
| CN | 105240064 | A | 1/2016 |
| CN | 204944834 | | 1/2016 |
| CN | 205042127 | U | 2/2016 |
| CN | 205172478 | U | 4/2016 |
| CN | 103993869 | B | 5/2016 |
| CN | 105536299 | A | 5/2016 |
| CN | 105545207 | A | 5/2016 |
| CN | 205260249 | | 5/2016 |
| CN | 103233714 | B | 6/2016 |
| CN | 104340682 | B | 6/2016 |
| CN | 205297518 | U | 6/2016 |
| CN | 205298447 | U | 6/2016 |
| CN | 205391821 | U | 7/2016 |
| CN | 205400701 | U | 7/2016 |
| CN | 103277290 | B | 8/2016 |
| CN | 104260672 | B | 8/2016 |
| CN | 205477370 | U | 8/2016 |
| CN | 205479153 | U | 8/2016 |
| CN | 205503058 | U | 8/2016 |
| CN | 205503068 | U | 8/2016 |
| CN | 205503089 | U | 8/2016 |
| CN | 105958098 | A | 9/2016 |
| CN | 205599180 | | 9/2016 |
| CN | 205599180 | U | 9/2016 |
| CN | 106121577 | A | 11/2016 |
| CN | 205709587 | | 11/2016 |
| CN | 104612928 | B | 12/2016 |
| CN | 106246120 | A | 12/2016 |
| CN | 205805471 | | 12/2016 |
| CN | 106321045 | A | 1/2017 |
| CN | 205858306 | | 1/2017 |
| CN | 106438310 | A | 2/2017 |
| CN | 205937833 | | 2/2017 |
| CN | 104563994 | B | 3/2017 |
| CN | 206129196 | | 4/2017 |
| CN | 104369687 | B | 5/2017 |
| CN | 106715165 | | 5/2017 |
| CN | 106761561 | A | 5/2017 |
| CN | 105240064 | B | 6/2017 |
| CN | 206237147 | | 6/2017 |
| CN | 206287832 | | 6/2017 |
| CN | 206346711 | | 7/2017 |
| CN | 104563995 | B | 9/2017 |
| CN | 107120822 | | 9/2017 |
| CN | 107143298 | A | 9/2017 |
| CN | 107159046 | A | 9/2017 |
| CN | 107188018 | A | 9/2017 |
| CN | 206496016 | | 9/2017 |
| CN | 104564033 | B | 10/2017 |
| CN | 107234358 | A | 10/2017 |
| CN | 107261975 | A | 10/2017 |
| CN | 206581929 | | 10/2017 |
| CN | 104820372 | B | 12/2017 |
| CN | 105092401 | B | 12/2017 |
| CN | 107476769 | A | 12/2017 |
| CN | 107520526 | A | 12/2017 |
| CN | 206754664 | | 12/2017 |
| CN | 107605427 | A | 1/2018 |
| CN | 106438310 | B | 2/2018 |
| CN | 107654196 | A | 2/2018 |
| CN | 107656499 | A | 2/2018 |
| CN | 107728657 | A | 2/2018 |
| CN | 206985503 | | 2/2018 |
| CN | 207017968 | | 2/2018 |
| CN | 107859053 | A | 3/2018 |
| CN | 207057867 | | 3/2018 |
| CN | 207085817 | | 3/2018 |
| CN | 105545207 | B | 4/2018 |
| CN | 107883091 | A | 4/2018 |
| CN | 107902427 | A | 4/2018 |
| CN | 107939290 | A | 4/2018 |
| CN | 107956708 | | 4/2018 |
| CN | 207169595 | | 4/2018 |
| CN | 207194873 | | 4/2018 |
| CN | 207245674 | | 4/2018 |
| CN | 108034466 | A | 5/2018 |
| CN | 108036071 | A | 5/2018 |
| CN | 108087050 | A | 5/2018 |
| CN | 207380566 | | 5/2018 |
| CN | 108103483 | A | 6/2018 |
| CN | 108179046 | A | 6/2018 |
| CN | 108254276 | A | 7/2018 |
| CN | 108311535 | A | 7/2018 |
| CN | 207583576 | | 7/2018 |
| CN | 207634064 | | 7/2018 |
| CN | 207648054 | | 7/2018 |
| CN | 207650621 | | 7/2018 |
| CN | 108371894 | A | 8/2018 |
| CN | 207777153 | | 8/2018 |
| CN | 108547601 | A | 9/2018 |
| CN | 108547766 | A | 9/2018 |
| CN | 108555826 | A | 9/2018 |
| CN | 108561098 | A | 9/2018 |
| CN | 108561750 | A | 9/2018 |
| CN | 108590617 | A | 9/2018 |
| CN | 207813495 | | 9/2018 |
| CN | 207814698 | | 9/2018 |
| CN | 207862275 | | 9/2018 |
| CN | 108687954 | A | 10/2018 |
| CN | 207935270 | | 10/2018 |
| CN | 207961582 | | 10/2018 |
| CN | 207964530 | | 10/2018 |
| CN | 108789848 | A | 11/2018 |
| CN | 108799473 | | 11/2018 |
| CN | 108868675 | A | 11/2018 |
| CN | 208086829 | | 11/2018 |
| CN | 208089263 | | 11/2018 |
| CN | 208169068 | | 11/2018 |
| CN | 108979569 | A | 12/2018 |
| CN | 109027662 | A | 12/2018 |
| CN | 109058092 | A | 12/2018 |
| CN | 208179454 | | 12/2018 |
| CN | 208179502 | | 12/2018 |
| CN | 208253147 | | 12/2018 |
| CN | 208260574 | | 12/2018 |
| CN | 109114418 | A | 1/2019 |
| CN | 109141990 | A | 1/2019 |
| CN | 208313120 | | 1/2019 |
| CN | 208330319 | | 1/2019 |
| CN | 208342730 | | 1/2019 |
| CN | 208430982 | | 1/2019 |
| CN | 208430986 | | 1/2019 |
| CN | 109404274 | A | 3/2019 |
| CN | 109429610 | A | 3/2019 |
| CN | 109491318 | A | 3/2019 |
| CN | 109515177 | A | 3/2019 |
| CN | 109526523 | A | 3/2019 |
| CN | 109534737 | A | 3/2019 |
| CN | 208564504 | | 3/2019 |
| CN | 208564516 | | 3/2019 |
| CN | 208564525 | | 3/2019 |
| CN | 208564918 | | 3/2019 |
| CN | 208576026 | | 3/2019 |
| CN | 208576042 | | 3/2019 |
| CN | 208650818 | | 3/2019 |
| CN | 208669244 | | 3/2019 |
| CN | 109555484 | A | 4/2019 |
| CN | 109682881 | A | 4/2019 |
| CN | 208730959 | | 4/2019 |
| CN | 208735264 | | 4/2019 |
| CN | 208746733 | | 4/2019 |
| CN | 208749529 | | 4/2019 |

(56) References Cited

FOREIGN PATENT DOCUMENTS

| | | | |
|---|---|---|---|
| CN | 208750405 | | 4/2019 |
| CN | 208764658 | | 4/2019 |
| CN | 109736740 | A | 5/2019 |
| CN | 109751007 | A | 5/2019 |
| CN | 208868428 | | 5/2019 |
| CN | 208870761 | | 5/2019 |
| CN | 109869294 | A | 6/2019 |
| CN | 109882144 | A | 6/2019 |
| CN | 109882372 | A | 6/2019 |
| CN | 209012047 | | 6/2019 |
| CN | 209100025 | | 7/2019 |
| CN | 110080707 | A | 8/2019 |
| CN | 110118127 | A | 8/2019 |
| CN | 110124574 | A | 8/2019 |
| CN | 110145277 | A | 8/2019 |
| CN | 110145399 | A | 8/2019 |
| CN | 110152552 | A | 8/2019 |
| CN | 110155193 | A | 8/2019 |
| CN | 110159225 | A | 8/2019 |
| CN | 110159432 | | 8/2019 |
| CN | 110159432 | A | 8/2019 |
| CN | 110159433 | A | 8/2019 |
| CN | 110208100 | A | 9/2019 |
| CN | 110252191 | A | 9/2019 |
| CN | 110284854 | A | 9/2019 |
| CN | 110284972 | A | 9/2019 |
| CN | 209387358 | | 9/2019 |
| CN | 110374745 | A | 10/2019 |
| CN | 209534736 | | 10/2019 |
| CN | 110425105 | A | 11/2019 |
| CN | 110439779 | A | 11/2019 |
| CN | 110454285 | A | 11/2019 |
| CN | 110454352 | A | 11/2019 |
| CN | 110467298 | A | 11/2019 |
| CN | 110469312 | A | 11/2019 |
| CN | 110469314 | A | 11/2019 |
| CN | 110469405 | A | 11/2019 |
| CN | 110469654 | A | 11/2019 |
| CN | 110485982 | A | 11/2019 |
| CN | 110485983 | A | 11/2019 |
| CN | 110485984 | A | 11/2019 |
| CN | 110486249 | A | 11/2019 |
| CN | 110500255 | A | 11/2019 |
| CN | 110510771 | A | 11/2019 |
| CN | 110513097 | A | 11/2019 |
| CN | 209650738 | | 11/2019 |
| CN | 209653968 | | 11/2019 |
| CN | 209654004 | | 11/2019 |
| CN | 209654022 | | 11/2019 |
| CN | 209654128 | | 11/2019 |
| CN | 209656622 | | 11/2019 |
| CN | 107849130 | B | 12/2019 |
| CN | 108087050 | B | 12/2019 |
| CN | 110566173 | A | 12/2019 |
| CN | 110608030 | A | 12/2019 |
| CN | 110617187 | A | 12/2019 |
| CN | 110617188 | A | 12/2019 |
| CN | 110617318 | A | 12/2019 |
| CN | 209740823 | | 12/2019 |
| CN | 209780827 | | 12/2019 |
| CN | 209798631 | | 12/2019 |
| CN | 209799942 | | 12/2019 |
| CN | 209800178 | | 12/2019 |
| CN | 209855723 | | 12/2019 |
| CN | 209855742 | | 12/2019 |
| CN | 209875063 | | 12/2019 |
| CN | 110656919 | A | 1/2020 |
| CN | 107520526 | B | 2/2020 |
| CN | 110787667 | A | 2/2020 |
| CN | 110821464 | A | 2/2020 |
| CN | 110833665 | A | 2/2020 |
| CN | 110848028 | A | 2/2020 |
| CN | 210049880 | | 2/2020 |
| CN | 210049882 | | 2/2020 |
| CN | 210097596 | | 2/2020 |
| CN | 210105817 | | 2/2020 |
| CN | 210105818 | | 2/2020 |
| CN | 210105993 | | 2/2020 |
| CN | 110873093 | A | 3/2020 |
| CN | 210139911 | | 3/2020 |
| CN | 110947681 | A | 4/2020 |
| CN | 111058810 | A | 4/2020 |
| CN | 111075391 | A | 4/2020 |
| CN | 210289931 | | 4/2020 |
| CN | 210289932 | | 4/2020 |
| CN | 210289933 | | 4/2020 |
| CN | 210303516 | | 4/2020 |
| CN | 211412945 | | 4/2020 |
| CN | 111089003 | A | 5/2020 |
| CN | 111151186 | A | 5/2020 |
| CN | 111167769 | A | 5/2020 |
| CN | 111169833 | A | 5/2020 |
| CN | 111173476 | A | 5/2020 |
| CN | 111185460 | A | 5/2020 |
| CN | 111185461 | A | 5/2020 |
| CN | 111188763 | A | 5/2020 |
| CN | 111206901 | A | 5/2020 |
| CN | 111206992 | A | 5/2020 |
| CN | 111206994 | A | 5/2020 |
| CN | 210449044 | | 5/2020 |
| CN | 210460875 | | 5/2020 |
| CN | 210522432 | | 5/2020 |
| CN | 210598943 | | 5/2020 |
| CN | 210598945 | | 5/2020 |
| CN | 210598946 | | 5/2020 |
| CN | 210599194 | | 5/2020 |
| CN | 210599303 | | 5/2020 |
| CN | 210600110 | | 5/2020 |
| CN | 111219326 | A | 6/2020 |
| CN | 111350595 | A | 6/2020 |
| CN | 210660319 | | 6/2020 |
| CN | 210714569 | | 6/2020 |
| CN | 210769168 | | 6/2020 |
| CN | 210769169 | | 6/2020 |
| CN | 210769170 | | 6/2020 |
| CN | 210770133 | | 6/2020 |
| CN | 210825844 | | 6/2020 |
| CN | 210888904 | | 6/2020 |
| CN | 210888905 | | 6/2020 |
| CN | 210889242 | | 6/2020 |
| CN | 111397474 | A | 7/2020 |
| CN | 111412064 | A | 7/2020 |
| CN | 111441923 | A | 7/2020 |
| CN | 111441925 | A | 7/2020 |
| CN | 111503517 | A | 8/2020 |
| CN | 111515898 | A | 8/2020 |
| CN | 111594059 | A | 8/2020 |
| CN | 111594062 | A | 8/2020 |
| CN | 111594144 | A | 8/2020 |
| CN | 211201919 | | 8/2020 |
| CN | 211201920 | | 8/2020 |
| CN | 211202218 | | 8/2020 |
| CN | 111608965 | A | 9/2020 |
| CN | 111664087 | A | 9/2020 |
| CN | 111677476 | A | 9/2020 |
| CN | 111677647 | A | 9/2020 |
| CN | 111692064 | A | 9/2020 |
| CN | 111692065 | A | 9/2020 |
| CN | 211384571 | | 9/2020 |
| CN | 211397553 | | 9/2020 |
| CN | 211397677 | | 9/2020 |
| CN | 211500955 | | 9/2020 |
| CN | 211524765 | | 9/2020 |
| DE | 4004854 | | 8/1991 |
| DE | 4241614 | | 6/1994 |
| DE | 102012018825 | | 3/2014 |
| DE | 102013111655 | | 12/2014 |
| DE | 102015103872 | | 10/2015 |
| DE | 102013114335 | | 12/2020 |
| EP | 0835983 | | 4/1998 |
| EP | 1378683 | | 1/2004 |
| EP | 2143916 | | 1/2010 |
| EP | 2613023 | | 7/2013 |
| EP | 3095989 | | 11/2016 |

(56) References Cited

FOREIGN PATENT DOCUMENTS

| | | |
|---|---|---|
| EP | 3211766 | 8/2017 |
| EP | 3049642 | 4/2018 |
| EP | 3354866 | 8/2018 |
| EP | 3075946 | 5/2019 |
| FR | 2795774 | 6/1999 |
| GB | 474072 | 10/1937 |
| GB | 1438172 | 6/1976 |
| JP | S57135212 | 2/1984 |
| KR | 20020026398 | 4/2002 |
| RU | 13562 | 4/2000 |
| WO | 1993020328 | 10/1993 |
| WO | 2006025886 | 3/2006 |
| WO | 2009023042 | 2/2009 |
| WO | 20110133821 | 10/2011 |
| WO | 2012139380 | 10/2012 |
| WO | 2013158822 | 10/2013 |
| WO | PCT/CN2012/074945 | 11/2013 |
| WO | 2013185399 | 12/2013 |
| WO | 2015158020 | 10/2015 |
| WO | 2016014476 | 1/2016 |
| WO | 2016033983 | 3/2016 |
| WO | 2016078181 | 5/2016 |
| WO | 2016101374 | 6/2016 |
| WO | 2016112590 | 7/2016 |
| WO | 2017123656 A | 7/2017 |
| WO | 2017146279 | 8/2017 |
| WO | 2017213848 | 12/2017 |
| WO | 2018031029 | 2/2018 |
| WO | 2018038710 | 3/2018 |
| WO | 2018044293 | 3/2018 |
| WO | 2018044307 | 3/2018 |
| WO | 2018071738 | 4/2018 |
| WO | 2018101909 | 6/2018 |
| WO | 2018101912 | 6/2018 |
| WO | 2018106210 | 6/2018 |
| WO | 2018106225 | 6/2018 |
| WO | 2018106252 | 6/2018 |
| WO | 2018/132106 | 7/2018 |
| WO | 2018156131 | 8/2018 |
| WO | 2018075034 | 10/2018 |
| WO | 2018187346 | 10/2018 |
| WO | 2018031031 | 2/2019 |
| WO | 2019045691 | 3/2019 |
| WO | 2019046680 | 3/2019 |
| WO | 2019060922 | 3/2019 |
| WO | 2019117862 | 6/2019 |
| WO | 2019126742 | 6/2019 |
| WO | 2019147601 | 8/2019 |
| WO | 2019169366 | 9/2019 |
| WO | 2019195651 | 10/2019 |
| WO | 2019200510 | 10/2019 |
| WO | 2019210417 | 11/2019 |
| WO | 2020018068 | 1/2020 |
| WO | 2020046866 | 3/2020 |
| WO | 2020072076 | 4/2020 |
| WO | 2020076569 | 4/2020 |
| WO | 2020097060 | 5/2020 |
| WO | 2020104088 | 5/2020 |
| WO | 2020131085 | 6/2020 |
| WO | 2020211083 | 10/2020 |
| WO | 2020211086 | 10/2020 |
| WO | 2021/038604 | 3/2021 |
| WO | 2021038604 | 3/2021 |
| WO | 2021041783 | 3/2021 |

OTHER PUBLICATIONS

Special-Purpose Couplings for Petroleum, Chemical, and Gas Industry Services, API Standard 671 (4th Edition) (2010).

The Application of Flexible Couplings for Turbomachinery, Jon R Mancuso et al., Proceedings of the Eighteenthturbomachinery Symposium (1989).

Pump Control With Variable Frequency Drives, Kevin Tory, Pumps & Systems: Advances in Motors and Drives, Reprint from Jun. 2008.

Fracture Design and Stimulation, Mike Eberhard, P.E., Wellconstruction & Operations Technical Workshop Insupport of the EPA Hydraulic Fracturing Study, Mar. 10-11, 2011.

General Purpose vs. Special Purpose Couplings, Jon Mancuso, Proceedings of the Twenty-Third Turbomachinerysymposium (1994).

Overview of Industry Guidance/Best Practices on Hydraulic Fracturing (HF), American Petroleum Institute, © 2012.

API Member Companies, American Petroleum Institute, WaybackMachine Capture, https://web.archive.org/web/20130424080625/http://api.org/globalitems/globalheaderpages/membership/api-member-companies, accessed Jan. 4, 2021.

API's Global Industry Services, American Petroleum Institute, © Aug. 2020.

About API, American Petroleum Institute, https://www.api.org /about, accessed Dec. 30, 2021.

About API, American Petroleum Institute, WaybackMachine Capture, https://web.archive.org/web/20110422104346 /http://api.org/aboutapi/, captured Apr. 22, 2011.

Publications, American Petroleum Institute, WaybackMachine Capture, https://web.archive.org/web/20110427043936 /http://www.api.org:80/Publications/, captured Apr. 27, 2011.

Procedures for Standards Development, American Petroleum Institute, Third Edition (2006).

WorldCat Library Collections Database Records for API Standard 671 and API Standard 674, https://www.worldcat.org/title/positive-displacement-pumps-reciprocating/oclc/ 858692269&referer=brief_results, accessed Dec. 30, 2021; and https://www.worldcat.org/title/special-purpose-couplings-for-petroleum-chemical-and-gas-industry-services/oclc/871254217&referer=brief_results, accessed Dec. 22, 2021.

2011 Publications and Services, American Petroleum Institute (2011).

Standards, American Petroleum Institute, WaybackMachine Capture, https://web.archive.org/web/20110207195046/http:/www.api.org/Standards/, captured Feb. 7, 2011; and https://web.archive.org/web/20110204112554/http://global.ihs.com/?RID=API1, captured Feb. 4, 2011.

IHS Markit Standards Store, https://global.ihs.com/doc_ detail.cfm?document_name=API%20STD% 20674&item_s_key=00010672#doc-detail-history-anchor, accessed Dec. 30, 2021; and https://global.ihs.com/doc_detail.cfm?&input_doc _number=671 &input_doc_title=&document_name=API%20STD%20671&item_s_key=00010669&item_key_date=890331&origin=DSSC, accessed Dec. 30, 2021.

Europump and Hydrualic Institute, Variable Speed Pumping: A Guide to Successful Applications, Elsevier Ltd, 2004.

Capstone Turbine Corporation, Capstone Receives Three Megawatt Order from Large Independent Oil & Gas Company in Eagle Ford Shale Play, Dec. 7, 2010.

Wikipedia, Westinghouse Combustion Turbine Systems Division, https://en.wikipedia.org/wiki/Westinghouse_Combustion_Turbine_Systems_Division, circa 1960.

Wikipedia,Union Pacific GTELs, https://en.wikipedia.org/wiki/Union_Pacific_GTELs, circa 1950.

HCI JET Frac, Screenshots from YouTube, Dec. 11, 2010. https://www.youtube.com/watch?v=6HjXkdbFaFQ.

AFD Petroleum Ltd., Automated Hot Zone, Frac Refueling System, Dec. 2018.

Eygun, Christiane, et al., URTeC: 2687987, Mitigating Shale Gas Developments Carbon Footprint: Evaluating and Implementing Solutions in Argentina, Copyright 2017, Unconventional Resources Technology Conference.

Walzel, Brian, Hart Energy, Oil, Gas Industry Discovers Innovative Solutions to Environmental Concerns, Dec. 10, 2018.

Frac Shack, Bi-Fuel FracFueller brochure, 2011.

Pettigrew, Dana, et al., High Pressure Multi-Stage Centrifugal Pump for 10,000 psi Frac Pump—HPHPS FRAC Pump, Copyright 2013, Society of Petroleum Engineers, SPE 166191.

Elle Seybold, et al., Evolution of Dual Fuel Pressure Pumping for Fracturing: Methods, Economics, Field Trial Results and Improvements in Availability of Fuel, Copyright 2013, Society of Petroleum Engineers, SPE 166443.

(56) References Cited

OTHER PUBLICATIONS

Wallace, E.M., Associated Shale Gas: From Flares to Rig Power, Copyright 2015, Society of Petroleum Engineers, SPE-173491-MS.
Williams, C.W. (Gulf Oil Corp. Odessa Texas), The Use of Gas-turbine Engines in an Automated High-Pressure Water-Injection Stations; American Petroleum Institute; API-63-144 (Jan. 1, 1963).
Neal, J.C. (Gulf Oil Corp. Odessa Texas), Gas Turbine Driven Centrifugal Pumps for High Pressure Water Injection American Institute of Mining, Metallurgical and Petroleum Engineers, Inc.; SPE-1888 (1967).
Porter, John A. (Solar Division International Harvester Co.), Modem Industrial Gas Turbines for the Oil Field American Petroleum Institute; Drilling and Production Practice; API-67-243 (Jan. 1, 1967).
Cooper et al., Jet Frac Porta-Skid—A New Concept in Oil Field Service Pump Equipments[sic]; Halliburton Services; SPE-2706 (1969).
Ibragimov, É.S., Use of gas-turbine engines in oil field pumping units; Chem Petrol Eng; (1994) 30: 530. https://doi.org/10.1007/BF01154919. (Translated from Khimicheskaya i Neftyanoe Mashinostroenie, No. 11, pp. 24-26, (Nov. 1994.).
Kas'yanov et al., Application of gas-turbine engines in pumping units complexes of hydraulic fracturing of oil and gas reservoirs; Exposition Oil & Gas; (Oct. 2012) (published in Russian).
American Petroleum Institute. API 674: Positive Displacement Pumps—Reciprocating. 3rd ed. Washington, DC: API Publishing Services, 2010.
American Petroleum Institute. API 616: Gas Turbines for the Petroleum, Chemical, and Gas Industry Services. 5th ed. Washington, DC: API Publishing Services, 2011.
Karassik, Igor, Joseph Messina, Paul Cooper, and Charles Heald. Pump Handbook. 4th ed. New York: McGraw-Hill Education, 2008.
Weir SPM. Weir SPM General Catalog: Well Service Pumps, Flow Control Products, Manifold Trailers, Safety Products, Post Sale Services. Ft. Worth, TX: Weir Oil & Gas. May 28, 2016. https://www.pumpfundamentals.com/pumpdatabase2/weir-spm-generaL.pdf.
The Weir Group, Inc. Weir SPM Pump Product Catalog. Ft. Worth, TX: S.P.M. Flow Control, Inc. Oct. 30, 2017. https://manage.global.weir/assets/files/product%20brochures/SPM_2P140706_Pump_Product_Catalogue_View.pdf.
Shandong Saigao Group Corporation. Q4 (5W115) Quintuplex Plunger Pump. Jinan City, Shandong Province, China: Saigao. Oct. 20, 2014. https://www.saigaogroup.com/product/q400-5w115-quintuplex-plunger-pump.html.
Marine Turbine. Turbine Powered Frac Units. Franklin, Louisiana: Marine Turbine Technologies, 2020.
Rotating Right. Quintuplex Power Pump Model Q700. Edmonton, Alberta, Canada: Weatherford International Ltd. https://www.rotatingright.com/pdf/weatherford/RR%2026-Weatherford%20Model%20Q700.pdf, 2021.
CanDyne Pump Services, Inc. Weatherford Q700 Pump. Calgary, Alberta, Canada: CanDyne Pump Services. Aug. 15, 2015. http://candyne.com/wp-content/uploads/2014/10/181905-94921.q700-quintuplex-pump.pdf.
Arop, Julius Bankong. Geomechanical review of hydraulic fracturing technology. Thesis (M. Eng.). Cambridge, MA: Massachusetts Institute of Technology, Dept. of Civil and Environmental Engineering. Oct. 29, 2013. https://dspace.mit.edu/handle/1721.1/82176.
Ziubak, Tadeusz, "Experimental Studies of Dust Suction Irregularity from Multi-Cyclone Dust Collector of Two-Stage Air Filter", Energies 2021, 14, 3577, 28 pages.
AFGlobal Corporation, Durastim Hydraulic Fracturing Pump, A Revolutionary Design for Continuous Duty Hydraulic Fracturing, 2018.
SPM® OEM 5000 E-Frac Pump Specification Sheet, Weir Group (2019) ("Weir 5000").
Green Field Energy Services Natural Gas Driven Turbine Frac Pumps HHP Summit Presentation, Yumpu (Sep. 2012), https://www.yumpu.com/en/document/read/49685291/turbine-frac-pump-assembly-hhp ("Green Field").
Dowell B908 "Turbo-Jet" Operator's Manual.
Jereh Debut's Super power Turbine Fracturing Pump, Leading the Industrial Revolution, Jereh Oilfield Services Group (Mar. 19, 2014), https://www.prnewswire.com/news-releases/jereh-debuts-super-power-turbine-fracturing-pump-leading-the-industrial-revolution-250992111.html.
Jereh Apollo 4500 Turbine Frac Pumper Finishes Successful Field Operation in China, Jereh Group (Feb. 13, 2015), as available on Apr. 20, 2015, https://web.archive.org/web/20150420220625/https://www. prnewswire.com/news-releases/jereh-apollo-4500-turbine-frac-pumper-finishes-successful-field-operation-in-china-300035829.html.
35% Economy Increase, Dual-fuel System Highlighting Jereh Apollo Frac Pumper, Jereh Group (Apr. 13, 2015), https://www.jereh.com/en/news/press-release/news-detail-7345.htm.
Hydraulic Fracturing: Gas turbine proves successful in shale gasfield operations, Vericor (2017), https://www.vericor.com/wp-content/uploads/2020/02/7.-Fracing-4500hp-Pump-China-En.pdf ("Vericor Case Study").
Jereh Apollo Turbine Fracturing Pumper Featured on China Central Television, Jereh Group (Mar. 9, 2018), https://www.jereh.com/en/news/press-release/news-detail-7267.htm.
Jereh Unveiled New Electric Fracturing Solution at OTC 2019, Jereh Group (May 7, 2019), as available on May 28, 2019, https://web.archive.org/web/20190528183906/https://www.prnewswire .com/news-releases/jereh-unveiled-new-electric-fracturing-solution-at-otc-2019-300845028.html.
Jereh Group, Jereh Fracturing Unit, Fracturing Spread, YouTube (Mar. 30, 2015), https://www.youtube.com/watch?v=PIkDbU5dEOo.
Transcript of Jereh Group, Jereh Fracturing Unit, Fracturing Spread, YouTube (Mar. 30, 2015).
Jereh Group, Jereh Fracturing Equipment. YouTube (Jun. 8, 2015), https://www.youtube.com/watch?v=m0vMiq84P4Q.
Transcript of Jereh Group, Jereh Fracturing Equipment, YouTube (Jun. 8, 2015), https://www.youtube.com/watch?v=m0vMiq84P4Q.
Ferdinand P. Beer et al., Mechanics of Materials (6th ed. 2012).
Weir Oil & Gas Introduces Industry's First Continuous Duty 5000-Horsepower Pump, Weir Group (Jul. 25, 2019), https://www.global. weir/newsroom/news-articles/weir-oil-and-gas-introduces-industrys-first-continuous-duty-5000-horsepower-pump/.
2012 High Horsepower Summit Agenda, Natural Gas for High Horsepower Applications (Sep. 5, 2012).
Review of HHP Summit 2012, Gladstein, Neandross & Associates https://www.gladstein.org/gna-conferences/high-horsepower-summit-2012/.
"Green Field Energy Services Deploys Third New Hydraulic Fracturing System," Green Field Energy Services, Inc. (Jul. 11, 2012), https://www.prnewswire.com/news-releases/green-field-energy-services-deploys-third-new-hydraulic-fracturing-spread-162113425.
Karen Boman, Turbine Technology Powers Green Field Multi-Fuel Frack Pump, Rigzone (Mar. 7, 2015), as available on Mar. 14, 2015, https://web.archive.org/web/20150314203227/https://www.rigzone.co m/news/oil-gas/a/124883/Turbine_Technology_Powers_Green_Field_ MultiFuel_Frack_Pump.
"Turbine Frac Units," WMD Squared (2012), https://wmdsquared.com/work/gfes-turbine-frac-units/.
Leslie Turj, Green Field asset sale called 'largest disposition industry has seen,' The INDsider Media (Mar. 19, 2014), http://theind.com/ article-16497-green-field-asset-sale-called-%E2%80%98largest-disposition-industry-has-seen%60.html.
"Honghua developing new-generation shale-drilling rig, plans testing of frac pump"; Katherine Scott; Drilling Contractor; May 23, 2013; accessed at https://www.drillingcontractor.org/honghua-developing-new-generation-shale-drilling-rig-plans-testing-of-frac-pump-23278.
Researchgate, Answer by Byron Woolridge, found at https://www.researchgate.net/post/How_can_we_improve_the_efficiency_of_the_gas_turbine_cycles, Jan. 1, 2013.

(56) References Cited

OTHER PUBLICATIONS

Filipović, Ivan, Preliminary Selection of Basic Parameters of Different Torsional Vibration Dampers Intended for use in Medium-Speed Diesel Engines, Transactions of Famena XXXVI-3 (2012).
Marine Turbine Technologies, 1 MW Power Generation Package, http://marineturbine.com/power-generation, 2017.
Business Week: Fiber-optic cables help fracking, cablinginstall.com. Jul. 12, 2013. https://www.cablinginstall.com/cable/article/16474208/businessweek-fiberoptic-cables-help-fracking.
Fracking companies switch to electric motors to power pumps, iadd-intl.org. Jun. 27, 2019. https://www.iadd-intl.org/articles/fracking-companies-switch-to-electric-motors-to-power-pumps/.
The Leader in Frac Fueling, suncoastresources.com. Jun. 29, 2015. https://web.archive.org/web/20150629220609/https://www.suncoastresources.com/oilfield/fueling-services/.
Mobile Fuel Delivery, atlasoil.com. Mar. 6, 2019. https://www.atlasoil.com/nationwide-fueling/onsite-and-mobile-fueling.
Frac Tank Hose (FRAC), 4starhose.com. Accessed: Nov. 10, 2019. http://www.4starhose.com/product/frac_tank_hose_frac.aspx.
Plos One, Dynamic Behavior of Reciprocating Plunger Pump Discharge Valve Based on Fluid Structure Interaction and Experimental Analysis. Oct. 21, 2015.
FMC Technologies, Operation and Maintenance Manual, L06 Through L16 Triplex Pumps Doc No. OMM50000903 Rev: E p. 1 of 66. Aug. 27, 2009.
Gardner Denver Hydraulic Fracturing Pumps GD 3000 https://www.gardnerdenver.com/en-us/pumps/triplex-fracking-pump-gd-3000.
Lekontsev, Yu M., et al. "Two-side sealer operation." Journal of Mining Science 49.5 (2013): 757-762.
Tom Hausfeld, GE Power & Water, and Eldon Schelske, Evolution Well Services, TM2500+ Power for Hydraulic Fracturing.
FTS International's Dual Fuel Hydraulic Fracturing Equipment Increases Operational Efficiencies, Provides Cost Benefits, Jan. 3, 2018.
CNG Delivery, Fracturing with natural gas, dual-fuel drilling with CNG, Aug. 22, 2019.
PbNG, Natural Gas Fuel for Drilling and Hydraulic Fracturing, Diesel Displacement / Dual Fuel & Bi-Fuel, May 2014.
Integrated Flow, Skid-mounted Modular Process Systems, Jul. 15, 2017, https://ifsolutions.com/why-modular/.
Cameron, A Schlumberger Company, Frac Manifold Systems, 2016.
ZSi-Foster, Energy | Solar | Fracking | Oil and Gas, Aug. 2020, https://www.zsi-foster.com/energy-solar-fracking-oil-and-gas.html.
JBG Enterprises, Inc., WS-Series Blowout Prevention Safety Coupling—Quick Release Couplings, Sep. 11, 2015, http://www.jgbhose.com/products/WS-Series-Blowout-Prevention-Sarety-Coupling.asp.
Halliburton, Vessel-based Modular Solution (VMS), 2015.
Chun, M. K., H. K. Song, and R. Lallemand. "Heavy duty gas turbines in petrochemical plants: Samsung's Daesan plant (Korea) beats fuel flexibility records with over 95% hydrogen in process gas." Proceedings of PowerGen Asia Conference, Singapore. 1999.
Wolf, Jürgen J., and Marko A. Perkavec. "Safety Aspects and Environmental Considerations for a 10 MW Cogeneration Heavy Duty Gas Turbine Burning Coke Oven Gas with 60% Hydrogen Content." ASME 1992 International Gas Turbine and Aeroengine Congress and Exposition. American Society of Mechanical Engineers Digital Collection, 1992.
Ginter, Timothy, and Thomas Bouvay. "Uprate options for the MS7001 heavy duty gas turbine." GE paper GER-3808C, GE Energy 12 (2006).
Chaichan, Miqdam Tariq. "The impact of equivalence ratio on performance and emissions of a hydrogen-diesel dual fuel engine with cooled exhaust gas recirculation." International Journal of Scientific & Engineering Research 6.6 (2015): 938-941.
Ecob, David J., et al. "Design and Development of a Landfill Gas Combustion System for the Typhoon Gas Turbine." ASME 1996 International Gas Turbine and Aeroengine Congress and Exhibition. American Society of Mechanical Engineers Digital Collection, 1996.
II-VI Marlow Industries, Thermoelectric Technologies in Oil, Gas, and Mining Industries, blog.marlow.com (Jul. 24, 2019).
B.M. Mahlalela, et al., Electric Power Generation Potential Based on Waste Heat and Geothermal Resources in South Africa, pangea.stanford.edu (Feb. 11, 2019).
"Department of Energy, United States of America, The Water-Energy Nexus: Challenges and Opportunities" purenergypolicy.org (Jun. 2014).
Ankit Tiwari, Design of a Cooling System for a Hydraulic Fracturing Equipment, The Pennsylvania State University, The Graduate School, College of Engineering, 2015.
Jp Yadav et al., Power Enhancement of Gas Turbine Plant by Intake Air Fog Cooling, Jun. 2015.
Mee Industries: Inlet Air Fogging Systems for Oil, Gas and Petrochemical Processing, Verdict Media Limited Copyright 2020.
M. Ahmadzadehtalatapeh et al.Performance enhancement of gas turbine units by retrofitting with inlet air cooling technologies (IACTs): an hour-by-hour simulation study, Journal of the Brazilian Society of Mechanical Sciences and Engineering, Mar. 2020.
Advances in Popular Torque-Link Solution Offer OEMs Greater Benefit, Jun. 21, 2018.
Emmanuel Akita et al., Mewbourne College of Earth & Energy, Society of Petroleum Engineers; Drilling Systems Automation Technical Section (DSATS); 2019.
PowerShelter Kit II, nooutage.com, Sep. 6, 2019.
EMPengineering.com, HEMP Resistant Electrical Generators / Hardened Structures HEMP/GMD Shielded Generators, Virginia, Nov. 3, 2012.
Blago Minovski, Coupled Simulations of Cooling and Engine Systems for Unsteady Analysis of the Benefits of Thermal Engine Encapsulation, Department of Applied Mechanics, Chalmers University of Technology Goteborg, Sweden 2015.
J. Porteiro et al., Feasibility of a new domestic CHP trigeneration with heat pump: II. Availability analysis. Design and development, Applied Thermal Engineering 24 (2004) 1421-1429.
ISM, What is Cracking Pressure, 2019.
Swagelok, The right valve for controlling flow direction? Check, 2016.
Technology.org, Check valves how do they work and what are the main type, 2018.

AUTOMATED DIAGNOSTICS OF ELECTRONIC INSTRUMENTATION IN A SYSTEM FOR FRACTURING A WELL AND ASSOCIATED METHODS

PRIORITY CLAIM

This is a continuation of U.S. Non-Provisional application Ser. No. 17/551,359, filed Dec. 15, 2021, titled "AUTOMATED DIAGNOSTICS OF ELECTRONIC INSTRUMENTATION IN A SYSTEM FOR FRACTURING A WELL AND ASSOCIATED METHODS," which is a continuation of U.S. Non-Provisional application Ser. No. 17/395,298, filed Aug. 5, 2021, titled "AUTOMATED DIAGNOSTICS OF ELECTRONIC INSTRUMENTATION IN A SYSTEM FOR FRACTURING A WELL AND ASSOCIATED METHODS," now U.S. Pat. No. 11,255,174, issued Feb. 22, 2022, which is a continuation of U.S. Non-Provisional application Ser. No. 17/301,247, filed Mar. 30, 2021, titled "AUTOMATED DIAGNOSTICS OF ELECTRONIC INSTRUMENTATION IN A SYSTEM FOR FRACTURING A WELL AND ASSOCIATED METHODS," now U.S. Pat. No. 11,220,895, issued Jan. 11, 2022, which claims priority to and the benefit of, under 35 U.S.C. § 119(e), U.S. Provisional Application No. 62/705,375, filed Jun. 24, 2020, titled "AUTOMATED DIAGNOSTICS OF ELECTRONIC INSTRUMENTATION IN A SYSTEM FOR FRACTURING A WELL AND ASSOCIATED METHODS," the disclosures of which are incorporated herein by reference in their entireties.

TECHNOLOGICAL FIELD

This disclosure relates generally to fracturing operations for oil and gas wells, and in particular, to controls for and diagnostics of electronic instrumentation in a system for fracturing a well and associated methods.

BACKGROUND

Fracturing is an oilfield operation that stimulates production of hydrocarbons, such that the hydrocarbons may more easily or readily flow from a subsurface formation to a well. For example, a fracturing system may be configured to fracture a formation by pumping a fracking fluid into a well at high pressure and high flow rates. Some fracking fluids may take the form of a slurry including water, proppants (e.g., sand), and/or other additives, such as thickening agents and/or gels. The slurry may be forced via one or more pumps into the formation at rates faster than can be accepted by the existing pores, fractures, faults, or other spaces within the formation. As a result, pressure builds rapidly to the point where the formation fails and begins to fracture.

By continuing to pump the fracking fluid into the formation, existing fractures in the formation are caused to expand and extend in directions farther away from a well bore, thereby creating flow paths to the well bore. The proppants may serve to prevent the expanded fractures from closing when pumping of the fracking fluid is ceased or may reduce the extent to which the expanded fractures contract when pumping of the fracking fluid is ceased. Once the formation is fractured, large quantities of the injected fracking fluid are allowed to flow out of the well, and the production stream of hydrocarbons may be obtained from the formation.

Hydraulic fracturing units are often equipped with analog sensors reading voltage or current values and converting them into an accurate variable measurement. The raw values are used through system logic to perform pumping operations, alert of faulty equipment and detect harmful conditions. The sensors are therefore stringently monitored for accuracy to ensure all related controls are being carried out to the operator's intent. In some cases, electric instruments such as discharge pressure transducers are equipped with a calibration function that can be performed by the operator to ensure than the accuracy of the transducer is the same. This cannot be done while operating the equipment as this would disrupt the use of the transducer.

BRIEF SUMMARY

Example implementations of the present disclosure provide a supervisory control unit and associated method for performing automated diagnostics of physical components and/or electronic instrumentation, such as one or more of transducers onboard one or more hydraulic fracturing units or otherwise distributed throughout a system for fracturing a well. The diagnostics may facilitate equipment maintenance, maintenance schedules and troubleshooting, and may ensure operational accuracy of the electronic instrumentation. The present disclosure includes, without limitation, the following example implementations.

In some embodiments, a supervisory control unit may receive measurements of conditions of hydraulic drive equipment onboard one or more hydraulic fracturing units. Each hydraulic fracturing unit may also include a reciprocating plunger pump configured to pump a fracturing fluid, a powertrain configured to power the reciprocating plunger pump, and auxiliary equipment driven by the hydraulic drive equipment to support operation of the hydraulic fracturing unit including the reciprocating plunger pump and the powertrain. The supervisory control unit may determine health of the hydraulic drive equipment from the measurements, and control the auxiliary equipment to start when the health of the hydraulic drive equipment is sufficient to drive the auxiliary equipment.

The health of the hydraulic drive equipment may refer to a status of the hydraulic drive equipment based on various conditions of the equipment. The health or status of the hydraulic drive equipment may be based on detrimental conditions endured by the hydraulic drive equipment, the severity of the detrimental conditions, and if the hydraulic drive equipment has been placed on a reduced power output due to the detrimental conditions. One detrimental condition may include high vibration on a fracturing pump during a fracturing stage. For example, the supervisory controller and/or local controller for the fracturing pump may include a vibration threshold. If the threshold is exceeded during a fracturing stage, the supervisory controller may determine that a detrimental condition has occurred and that the health of the fracturing pump is poor or some other various state, as will be understood by those skilled in the art. Other detrimental conditions may be considered for all the equipment at the wellsite, as will be understood by those skilled in the art.

In additional embodiments, the supervisory control unit may receive measurements of conditions of lubrication and cooling equipment onboard one or more hydraulic fracturing units. In these examples, the auxiliary equipment of each hydraulic fracturing unit may also include the lubrication and cooling equipment. The supervisory control unit may monitor temperature of process fluid in the lubrication and cooling equipment from the measurements. In some further examples, the supervisory control unit may receive at least some of the measurements from inlet and outlet ports of a radiator of a heat exchanger assembly for the reciprocating plunger pump, the engine, the powertrain or the auxiliary equipment. In some of these further examples, the supervisory control unit may monitor an extent to which the process fluid is cooled by the radiator.

In further embodiments, the supervisory control unit may receive measurements of pressure from a wellhead pressure transducer configured to measure pressure of fracturing fluid at a wellhead, or pump output pressure transducers configured to measure pressure of fracturing fluid discharged by reciprocating plunger pumps of hydraulic fracturing units. In some of these examples, the supervisory control unit may compare the measurements to an average of the measurements, and determine if a measurement of pressure at the wellhead or any of the reciprocating plunger pumps is outside an allowable calibration range. The supervisory control unit may flag the measurement when the measurement of pressure is outside the allowable calibration range.

In some embodiments, a diagnostic control assembly to identify a status associated with components of a plurality of hydraulic fracturing units including a prime mover positioned to drive a hydraulic fracturing pump to pump fracturing fluid into a wellhead via a manifold, may include a plurality of sensors positioned to generate sensor signals indicative of operating parameters associated with one or more of at least one of the plurality of hydraulic fracturing units or the manifold, and a supervisory control unit. The supervisory control unit may be configured to receive the plurality of sensor signals and determine whether one or more of the plurality of sensors is generating signals outside a calibration range, and when one or more of the plurality of sensors is generating signals outside the calibration range, generate a calibration signal indicative of the one or more of the plurality of sensors generating signals outside the calibration range. The supervisory control unit may also, or alternatively, be configured to receive the plurality of sensor signals and determine whether a fluid parameter associated with an auxiliary system of one or more of the plurality of hydraulic fracturing units is indicative of a fluid-related problem, and when the fluid parameter is indicative of a fluid-related problem, generate a fluid signal indicative of the fluid-related problem. The supervisory control unit may also, or alternatively, be configured to receive the plurality of sensor signals and determine whether lubrication associated with one or more of the prime mover, the hydraulic fracturing pump, or a transmission associated with one or more of the plurality of hydraulic fracturing units has a lubrication fluid temperature greater than a maximum lubrication temperature, and when one or more of the plurality of hydraulic fracturing units has a lubrication fluid temperature greater than the maximum lubrication temperature, generate a lubrication temperature signal indicative of the lubrication fluid temperature greater than the maximum lubrication temperature. The supervisory control unit may also, or alternatively, be configured to receive the plurality of sensor signals and determine an extent to which a heat exchanger assembly associated with one or more of the plurality of hydraulic fracturing units is cooling fluid passing through the heat exchanger assembly, and when the extent to which the heat exchanger assembly is cooling fluid is below a minimum cooling effectiveness, generate a cooling signal indicative of the heat exchanger assembly operating with a low effectiveness.

In some embodiments, a supervisory control unit to monitor a status associated with components of a plurality of hydraulic fracturing units including a prime mover positioned to drive a hydraulic fracturing pump to pump fracturing fluid into a wellhead via a manifold may include a memory having computer-readable instructions stored therein, and a processor configured to access the memory, and execute the computer-readable instructions. The computer-readable instructions may cause the supervisory control unit to receive a plurality of sensor signals and determine whether one or more of the plurality of sensor signals is indicative of a sensor generating sensor signals outside a calibration range, and when a sensor is generating signals outside the calibration range, generate a calibration signal indicative of the sensor generating signals outside the calibration range. The computer-readable instructions may also, or alternatively, cause the supervisory control unit to receive a plurality of sensor signals and determine whether a fluid parameter associated with an auxiliary system of one or more of the plurality of hydraulic fracturing units is indicative of a fluid-related problem, and when the fluid parameter is indicative of a fluid-related problem, generate a fluid signal indicative of the fluid-related problem. The computer-readable instructions may also, or alternatively, cause the supervisory control unit to receive a plurality of sensor signals and determine whether lubrication associated with one or more of the prime mover, the hydraulic fracturing pump, or a transmission associated with one or more of the plurality of hydraulic fracturing units has a lubrication fluid temperature greater than a maximum lubrication temperature, and when one or more of the plurality of hydraulic fracturing units has a lubrication fluid temperature greater than the maximum lubrication temperature, generate a lubrication temperature signal indicative of the lubrication fluid temperature greater than the maximum lubrication temperature. The computer-readable instructions may also, or alternatively, cause the supervisory control unit to receive a plurality of sensor signals and determine an extent to which a heat exchanger assembly associated with one or more of the plurality of hydraulic fracturing units is cooling fluid passing through the heat exchanger assembly, and when the extent to which the heat exchanger assembly is cooling fluid is below a minimum cooling effectiveness, generate a cooling signal indicative of the heat exchanger assembly operating with a low effectiveness.

In some embodiments, a method to identify a status associated with components of a plurality of hydraulic fracturing units including a prime mover positioned to drive a hydraulic fracturing pump to pump fracturing fluid into a wellhead via a manifold, may include receiving a plurality of sensor signals, the plurality of sensor signals being indicative of operating parameters associated with one or more of at least one of the plurality of hydraulic fracturing units or the manifold. The method also may include determining whether one or more of the plurality of sensors is generating signals outside a calibration range, and when one or more of the plurality of sensors is generating signals outside the calibration range, generating a calibration signal indicative of the one or more of the plurality of sensors generating signals outside the calibration range. The method also, or alternatively, may include determining whether a fluid parameter associated with an auxiliary system of one or more of the plurality of hydraulic fracturing units is indicative of a fluid-related problem, and when the fluid parameter is indicative of a fluid-related problem, generating a fluid signal indicative of the fluid-related problem. The method further, or alternatively, may include determining whether lubrication associated with one or more of the prime mover, the hydraulic fracturing pump, or a transmission associated with one or more of the plurality of hydraulic fracturing units has a lubrication fluid temperature greater than a maximum lubrication temperature, and when one or more of the plurality of hydraulic fracturing units has a lubrication fluid temperature greater than the maximum lubrication temperature, generating a lubrication temperature signal indicative of the lubrication fluid temperature greater than the maximum lubrication temperature. The method also, or alternatively, may include determining an extent to which a heat exchanger assembly associated with one or more of the plurality of hydraulic fracturing units is cooling fluid passing through the heat exchanger assembly, and when the extent to which the heat exchanger assembly is cooling fluid is below a minimum cooling effectiveness, generating a cooling signal indicative of the heat exchanger assembly operating with a low effectiveness.

In some embodiments, a method to identify inaccuracies of a plurality of pressure sensors configured to generate signals indicative of fluid pressure associated with operation of components of a plurality of hydraulic fracturing units including a prime mover positioned to drive a hydraulic fracturing pump to pump fracturing fluid into a wellhead via a manifold, may include receiving a plurality of unit pressure signals generated by a plurality of respective unit pressure sensors, the plurality of unit pressure signals being indicative of respective output pressures of the plurality of hydraulic fracturing units. The method also may include receiving a manifold pressure signal generated by a manifold pressure sensor, the manifold pressure signals being indicative of pressure associated with fluid flowing in the manifold. The method further may include, based at least in part on the plurality of unit pressure signals and the manifold pressure signal, determining whether one or more of the manifold pressure sensor or one or more of the plurality of unit pressure sensors is generating signals outside a calibration range.

In some embodiments, a method to determine a status of an auxiliary system associated with a hydraulic fracturing unit including a prime mover positioned to drive a hydraulic fracturing pump to pump fracturing fluid into a wellhead via a manifold, may include receiving a fluid level signal indicative of a level of fluid in a fluid reservoir. The method also may include, when the fluid level signal is indicative of a fluid level below a minimum fluid level, generating a low level signal indicative of the fluid level being below the minimum fluid level. The method further may include, based at least in part on the low level signal, preventing the hydraulic fracturing unit from commencing a hydraulic fracturing operation, and/or causing generation of a maintenance signal indicative of initiating maintenance associated with the fluid.

In some embodiments, a method to determine a cooling effectiveness of a heat exchanger assembly associated with a hydraulic fracturing unit including a prime mover positioned to drive a hydraulic fracturing pump to pump fracturing fluid into a wellhead via a manifold, may include receiving an inlet temperature signal indicative of an inlet temperature of fluid flowing through an inlet of the heat exchanger assembly, and receiving an outlet temperature signal indicative of an outlet temperature of fluid flowing through an outlet of the heat exchanger assembly. The method also may include determining the inlet temperature associated with fluid flowing through the inlet of the heat exchanger assembly, and determining the outlet temperature associated with the fluid flowing out of an outlet of the heat exchanger assembly. The method further may include determining a temperature difference between the inlet temperature and the outlet temperature, and comparing the temperature difference to historical data associated with operation of the heat exchanger assembly during prior operation. The method still further may include, based at least in part on the comparing, determining the cooling effectiveness of the heat exchanger assembly.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURES

Figure 1:
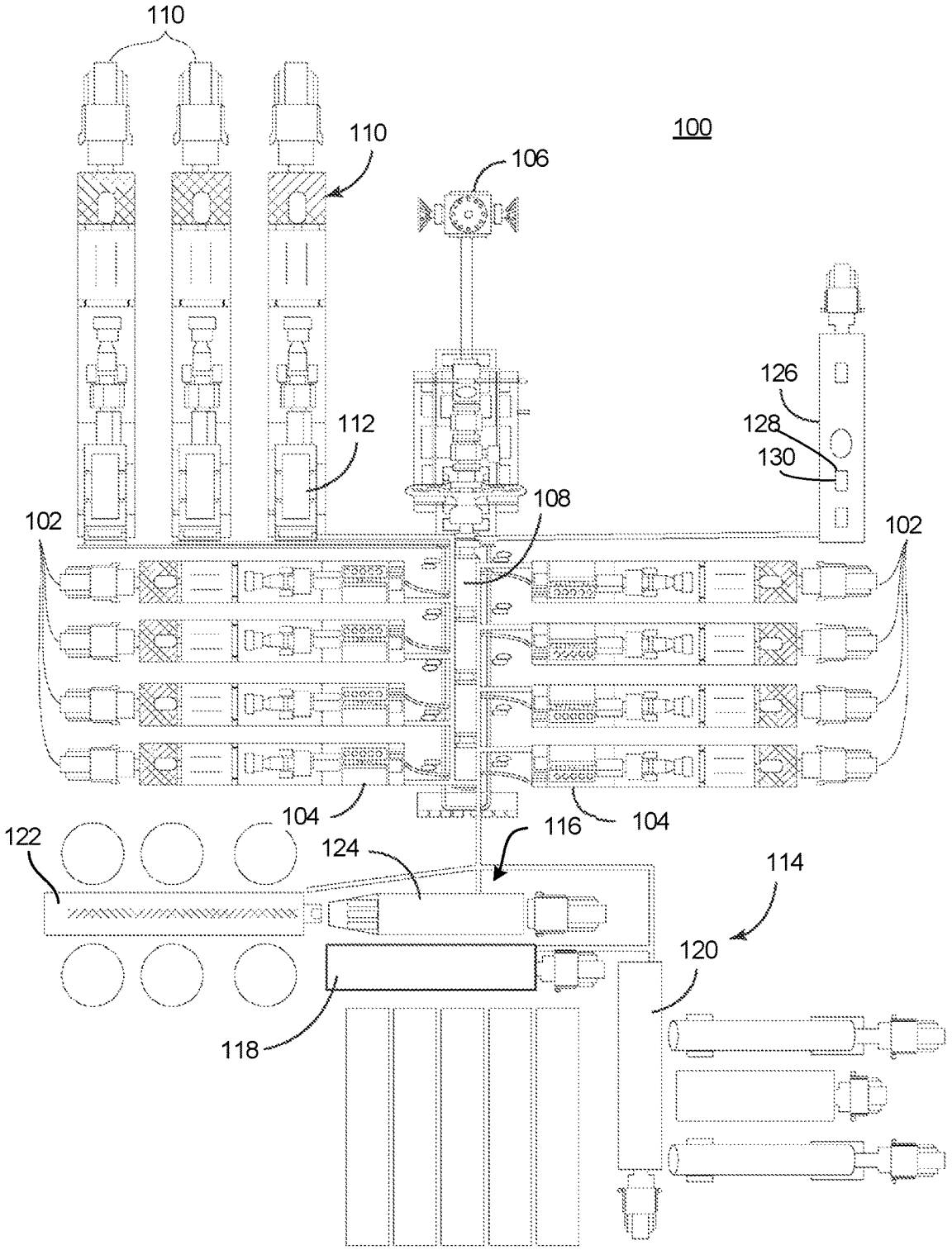
Figure 2:
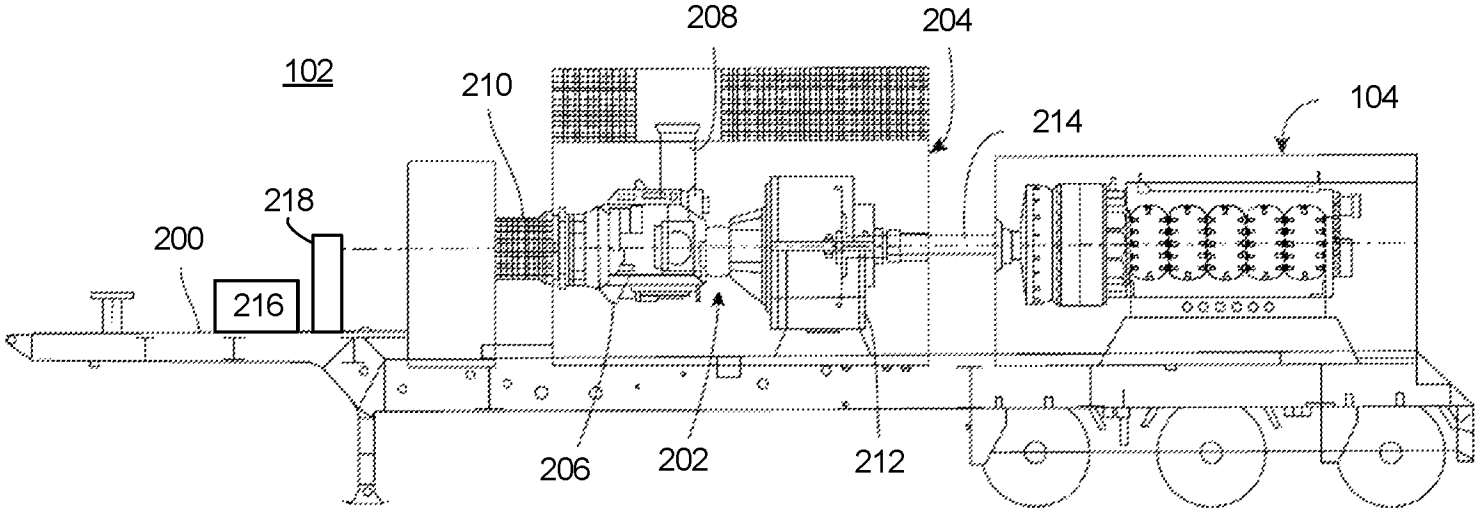
Figure 3:
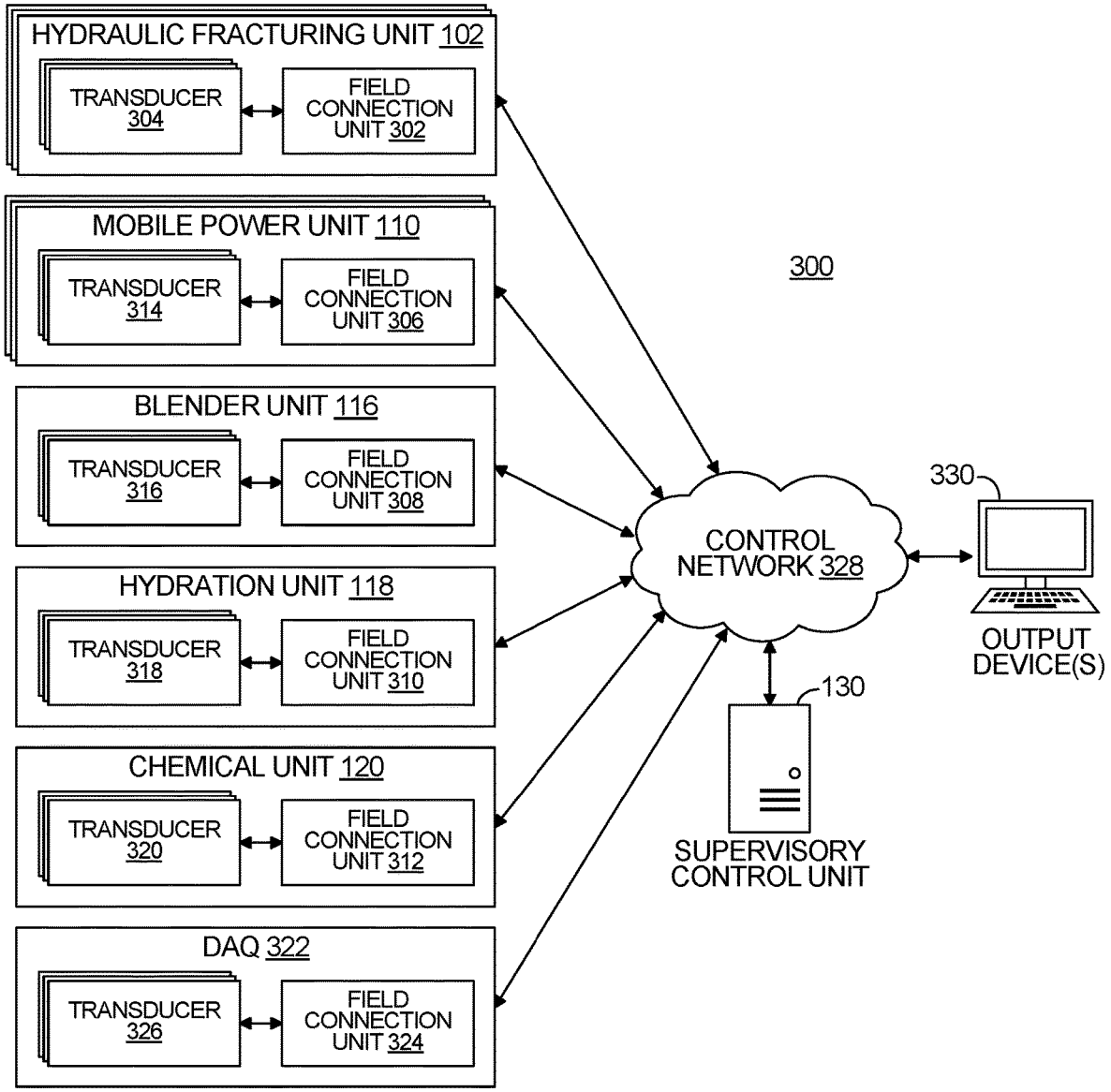

Having thus described aspects of the disclosure in the foregoing general terms, reference will now be made to the accompanying figures, which are not necessarily drawn to scale, and wherein:

FIG. 1 illustrates a system for fracturing a well according to some embodiments of the disclosure;

FIG. 2 illustrates a hydraulic fracturing unit of the system, according to some embodiments of the disclosure; and FIG. 3 illustrates a network architecture for the system according to some embodiments of the disclosure.

Figure 4:
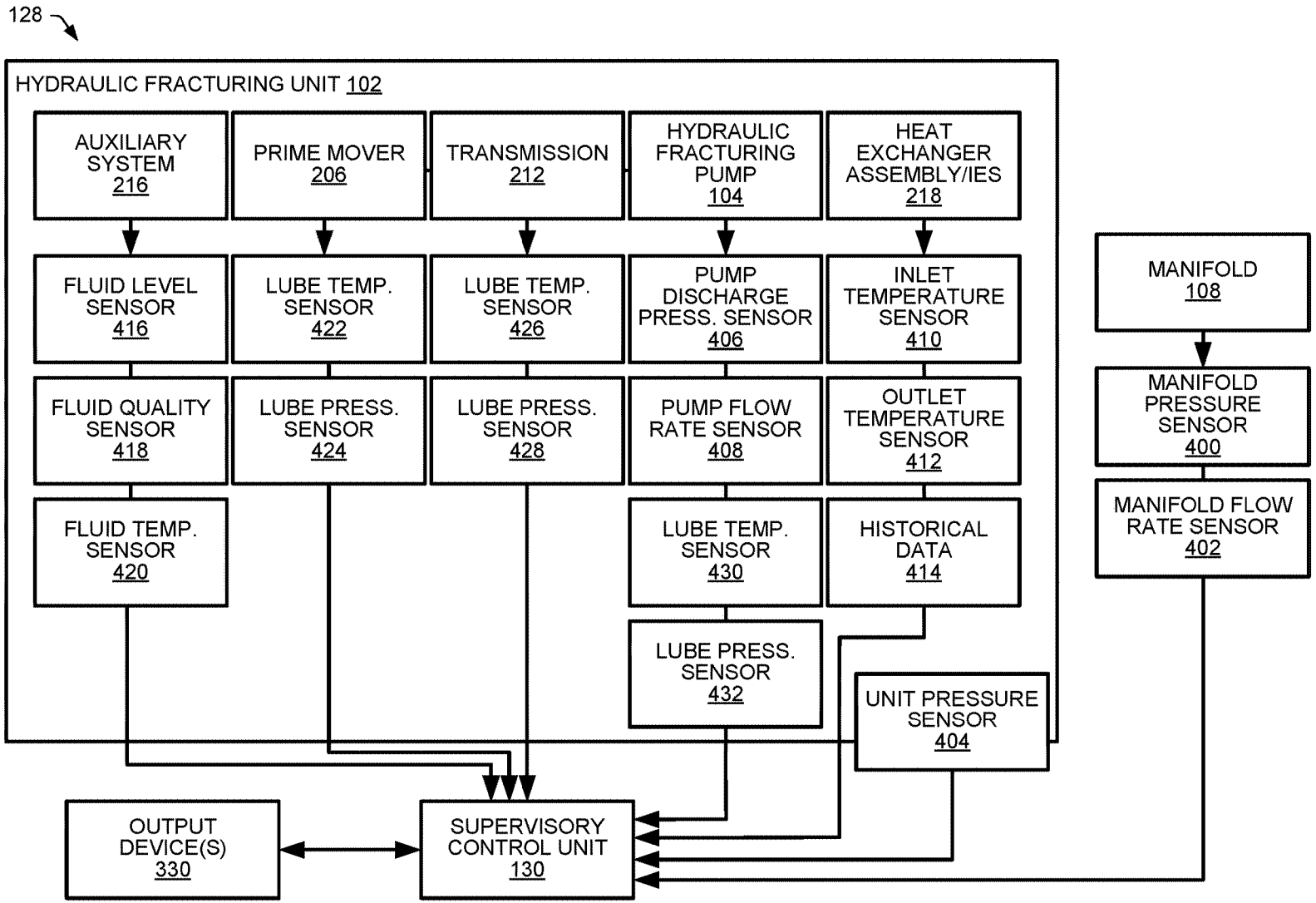

FIG. 4 schematically illustrates an example diagnostic control assembly including a supervisory control unit associated with an example hydraulic fracturing unit including example sensors, according to some embodiments of the disclosure.

Figure 5:
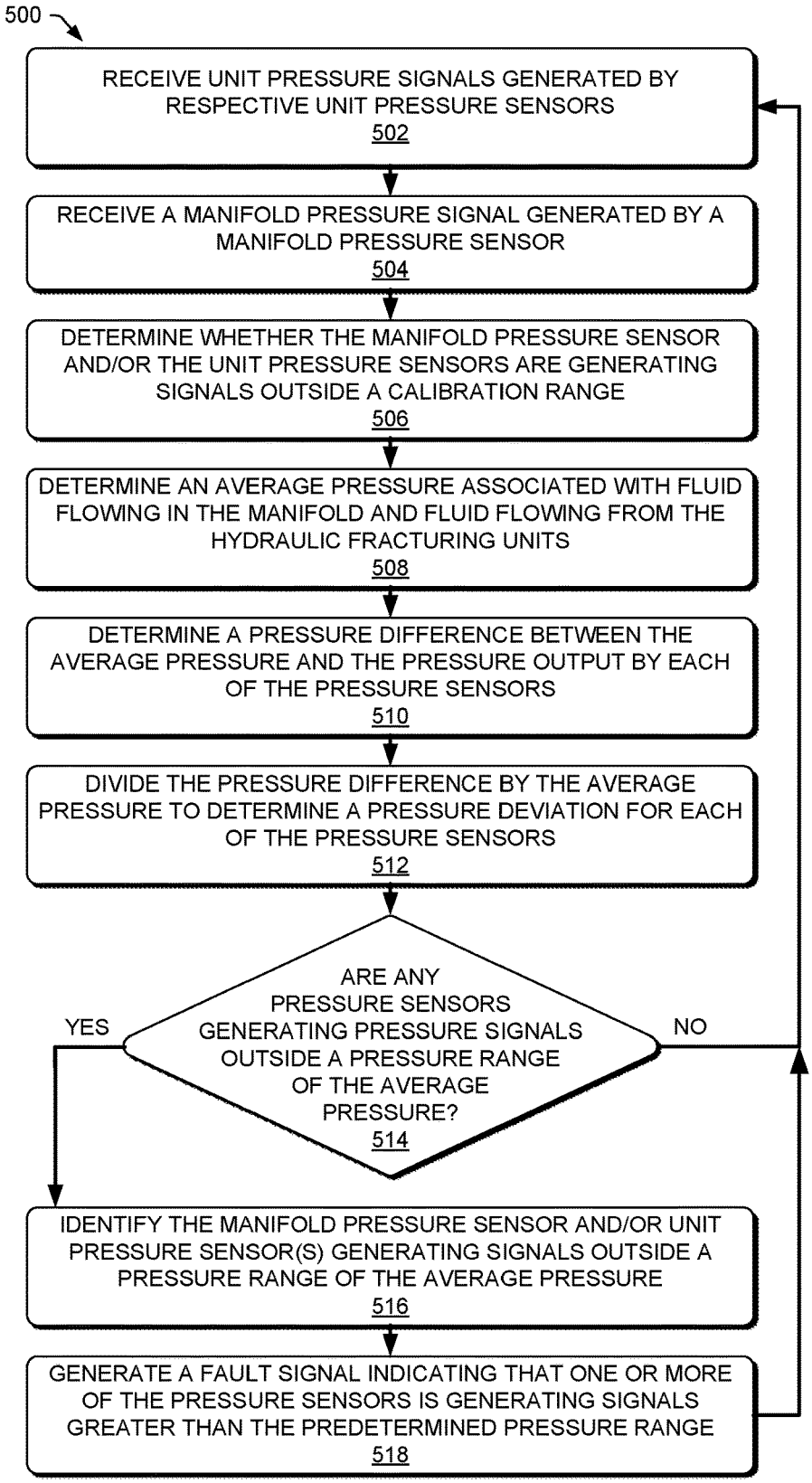

FIG. 5 is a block diagram of an example method to identify inaccuracies of a plurality of pressure sensors configured to generate signals indicative of fluid pressure associated with operation of components of a plurality of hydraulic fracturing units, according to embodiments of the disclosure.

Figure 6A:
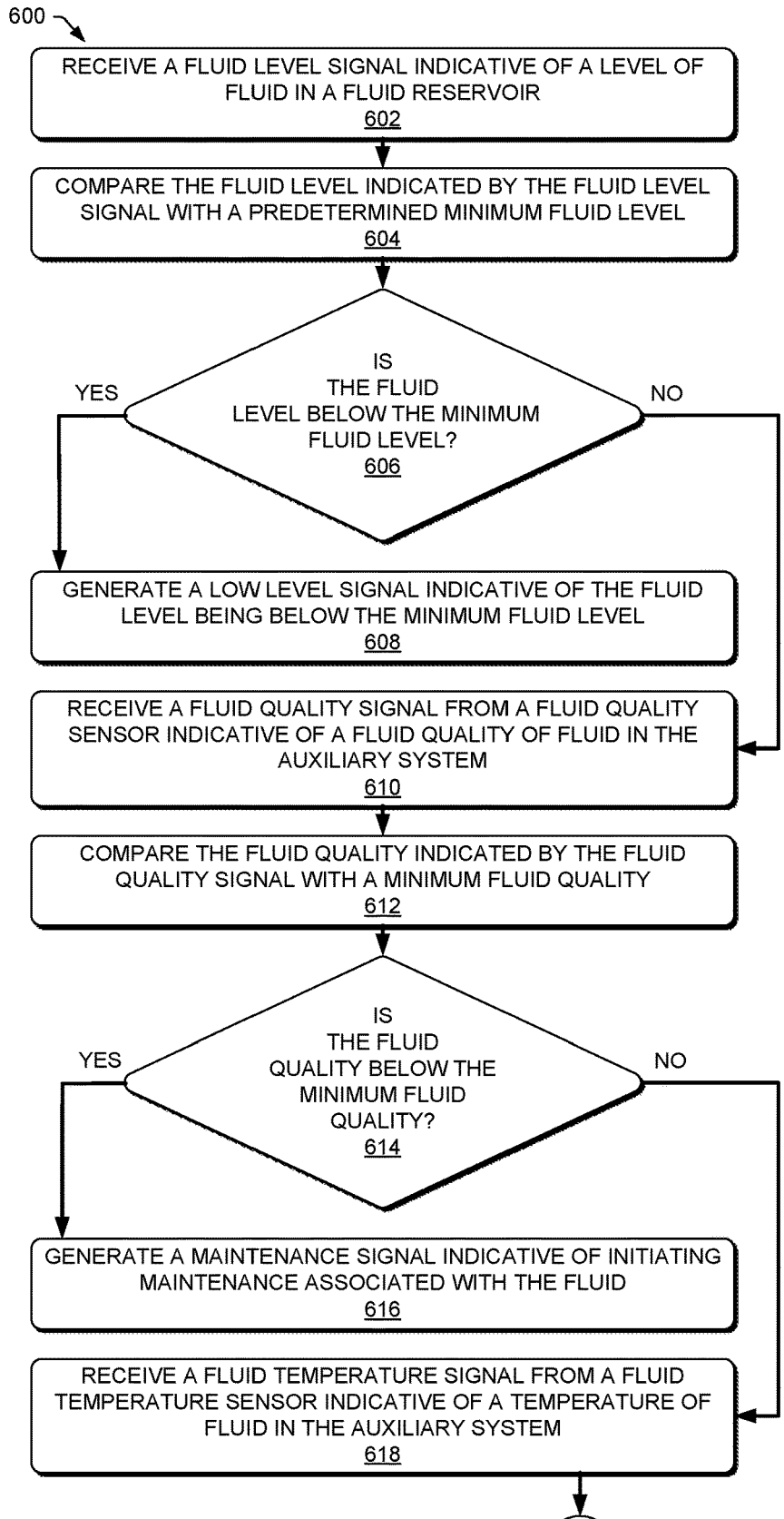

FIG. 6A is a block diagram of an example method to determine a status of an auxiliary system associated with a hydraulic fracturing unit, according to embodiments of the disclosure.

Figure 6B:
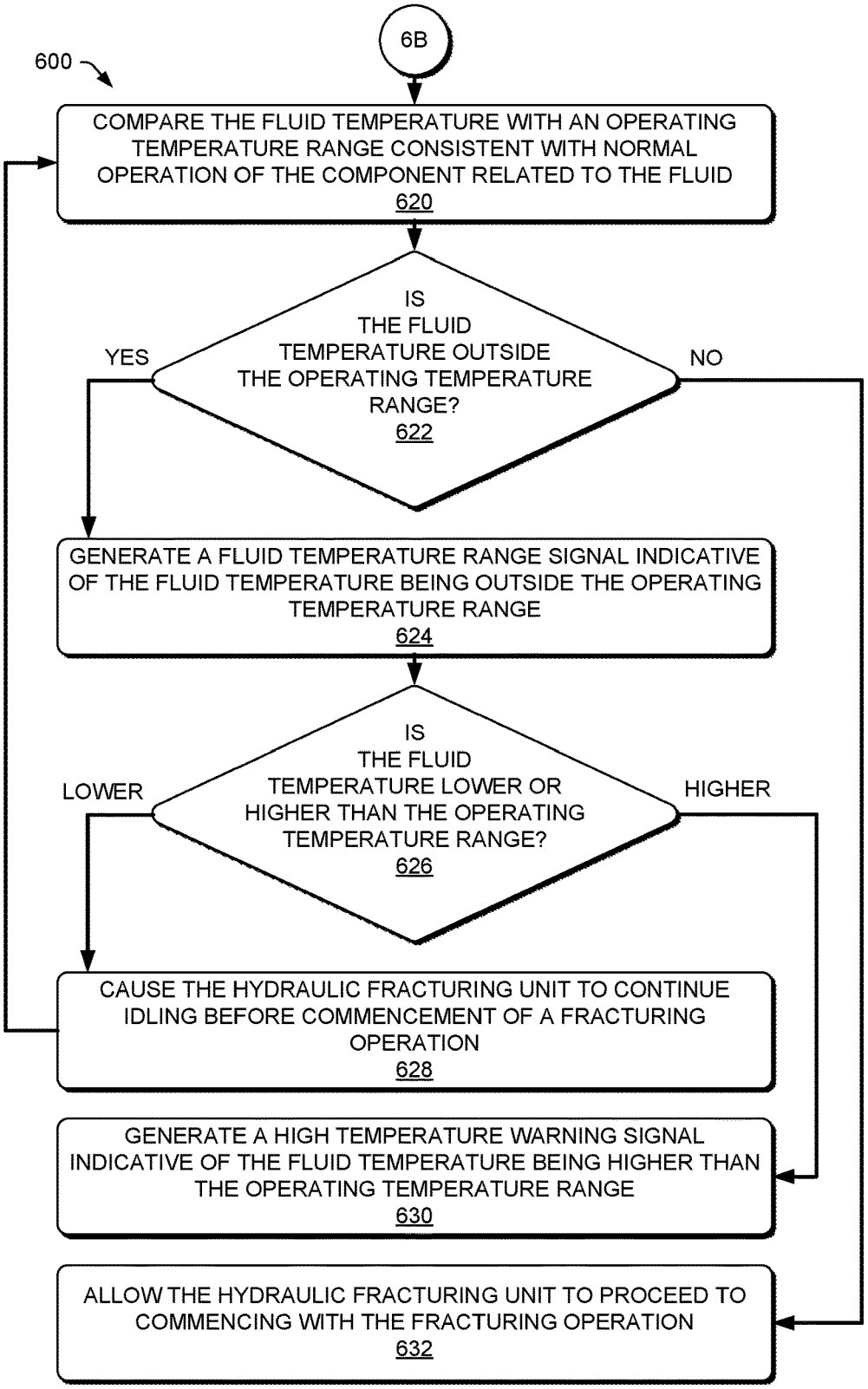

FIG. 6B is a continuation of the block diagram of the example method to determine a status of an auxiliary system shown in FIG. 6A, according to embodiments of the disclosure.

Figure 7A:
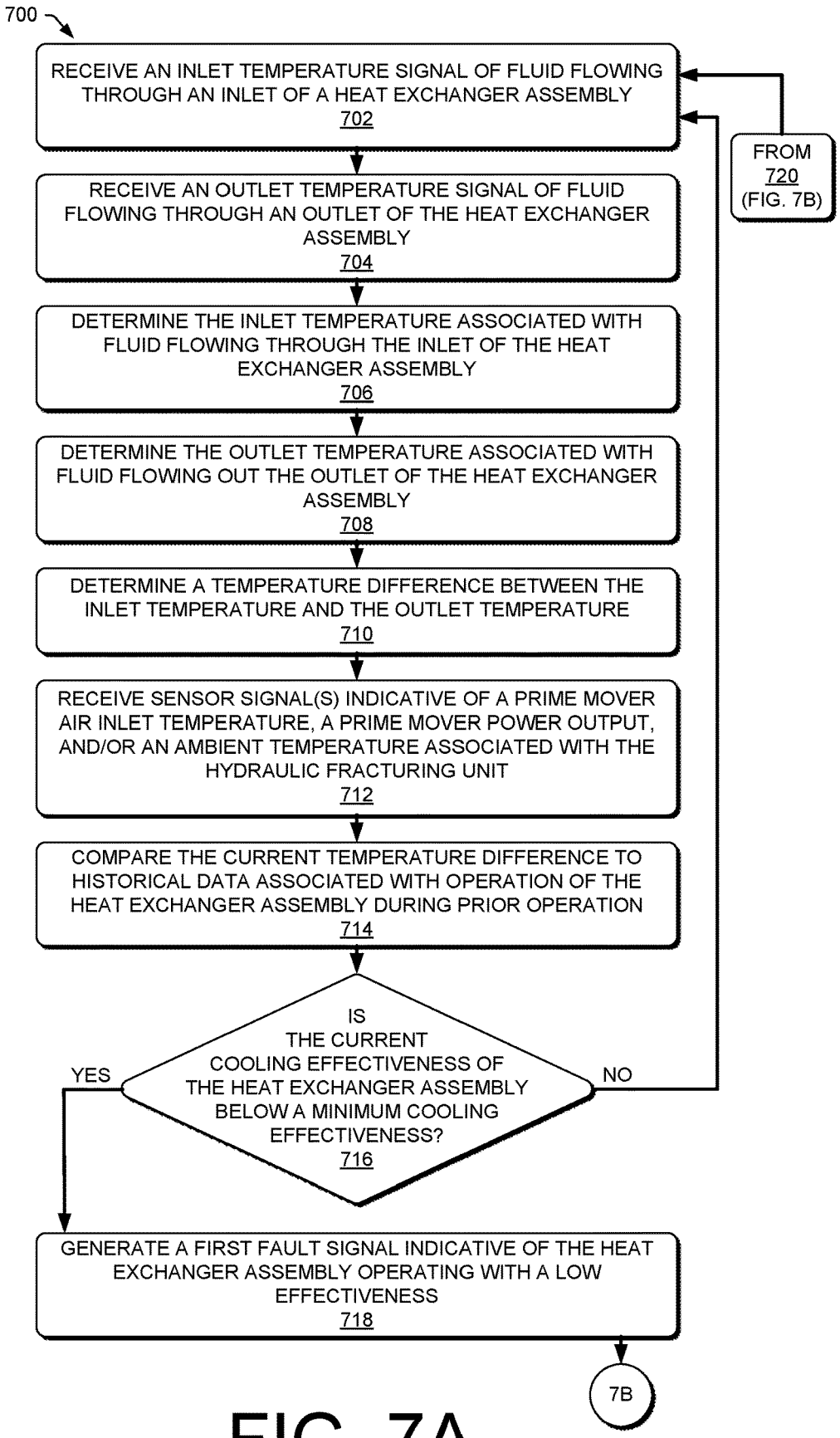

FIG. 7A is a block diagram of an example method to determine a cooling effectiveness of a heat exchanger assembly associated with a hydraulic fracturing unit, according to embodiments of the disclosure.

Figure 7B:
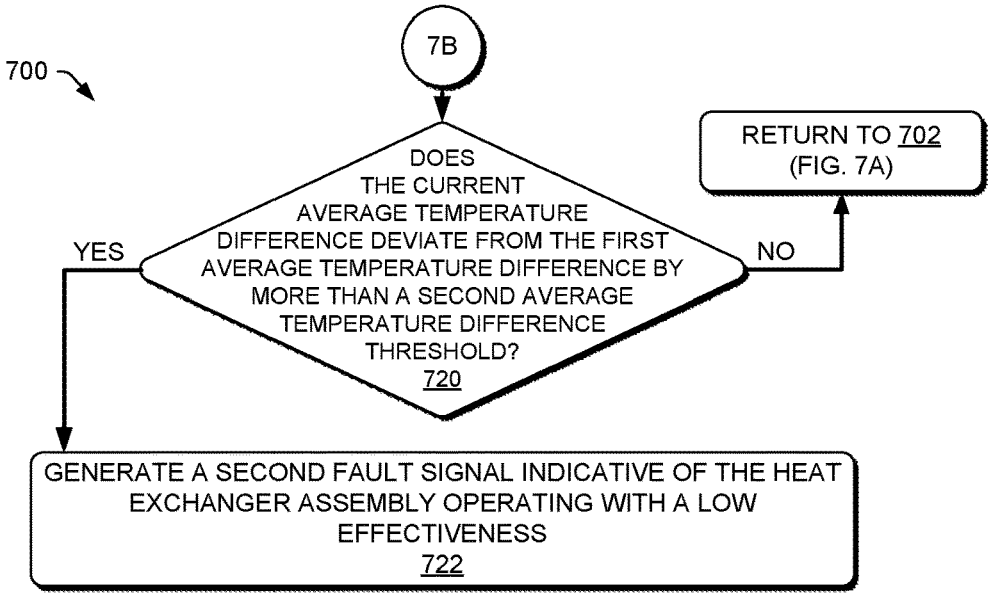

FIG. 7B is a continuation of the block diagram of the example method to determine a cooling effectiveness shown in FIG. 7A, according to embodiments of the disclosure.

Figure 8:
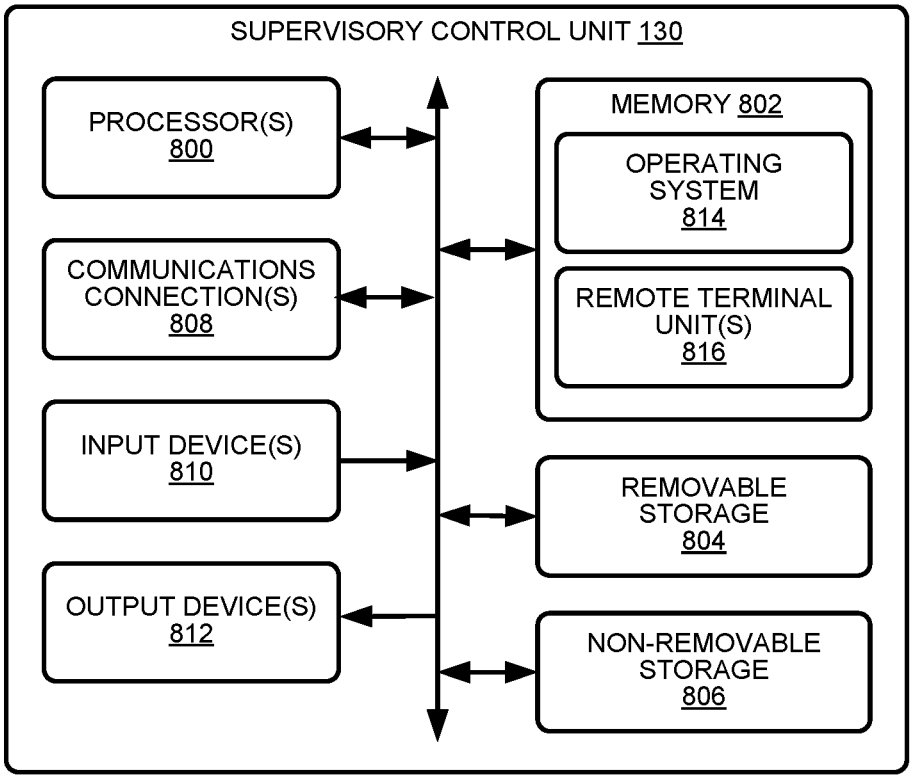

FIG. 8 is a schematic diagram of an example supervisory control unit configured to semi- or fully-autonomously perform diagnostics of components and/or electronic instrumentation onboard hydraulic fracturing units or otherwise distributed throughout a hydraulic fracturing system, according to embodiments of the disclosure.

DETAILED DESCRIPTION

Some implementations of the present disclosure will now be described more fully hereinafter with reference to the accompanying figures, in which some, but not all, implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second, or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships, or the like, unless otherwise stated, any one or more, if not all, of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form.

FIG. 1 illustrates a system 100 for fracturing a well according to some example implementations of the present disclosure. As shown, the system 100 generally includes a plurality of hydraulic fracturing units 102 and respective hydraulic fracturing pumps 104. The hydraulic fracturing units 102 may be arranged around a wellhead 106 to supply the wellhead 106 with high-pressure fracturing fluids and recover oil and/or gas from the wellhead 106 as will be understood by those skilled in the art. As shown, the hydraulic fracturing units 102 may be positioned and configured to discharge high-pressure fluid to a manifold 108, such that the high-pressure fluid is provided to the wellhead 106. In some examples, the system 100 also includes one or more mobile power units 110 with respective electrical generators 112 configured to provide electrical power to the system 100.

As also shown, the system 100 may include backside equipment 114, such as a blender unit 116, a hydration unit 118, and/or a chemical unit 120. The blender unit 116 may be positioned and configured to provide a flow of fluid to the fracturing pumps 104, which is pressurized by and discharged from the fracturing pumps 104 into the manifold 108. The blender unit 116 may include one or more screw conveyors 122 positioned and configured to provide proppant to a mixer 124 of the blender unit 116. The blender unit 116 may also include a discharge pump configured to draw fluid from the mixer 124, such that a flow of fluid is provided from the blender unit 116 to the fracturing pumps 104. The fluid from the mixer 124 may include proppant provided by the screw conveyors and/or chemicals for the fluid of the fracturing pumps 116. When blender unit 116 provides proppant to the fracturing pumps 104, the proppant is in a slurry, which may be considered a fluid, as will be understood by those skilled in the art.

The system 100 may include a data center 126, including a diagnostic control assembly 128, which may include (or be a component of) a supervisory control unit 130 that provides facilities for communication with and/or control of the hydraulic fracturing units 102, the mobile power units 110, and the backside equipment 114, such as by wired or wireless data links directly or across one or more networks. The data center may be a mobile control unit in the form of a trailer or a van, as will be understood by those skilled in the art. As used herein, the term "fracturing pump" may be used to refer to one or more of the hydraulic fracturing pumps 104 of the system 100. In some embodiments, all of the hydraulic fracturing pumps 104 may be controlled by the supervisory control unit 130, such that to an operator or user of the supervisory control unit 130, the hydraulic fracturing pumps 104 may be controlled as a single pump or pumping system.

FIG. 2 illustrates a hydraulic fracturing unit 102, according to some embodiments of the present disclosure. The hydraulic fracturing unit 102 may include a fracturing pump 104, such as a reciprocating pump, connected to a chassis 200 and positioned and configured to pump a fracturing fluid into the wellhead 106 via the manifold 108. In some embodiments, the chassis 200 may include a trailer (e.g., a flat-bed trailer) and/or a truck body, to which one or more of the components of the hydraulic fracturing unit 102 may be connected. For example, the components may be carried by trailers and/or incorporated into trucks, so that they may be easily transported between well sites, assembled, used during a fracturing operation, as least partially disassembled, and transported to another wellsite.

In some embodiments, the fracturing pump 104 may be reciprocating plunger pump, including a power end and a fluid end. The power end may be configured to transform rotational motion and energy from a powertrain 202 into the reciprocating motion that drives plungers in the fluid end. In the fluid end, the plungers force fluid into a pressure chamber that is used to create high pressure for well servicing. The fluid end may also include a discharge valve assembly and a suction valve assembly.

The hydraulic fracturing unit 102 may include an enclosure assembly 204 onboard the chassis 200, and housing the powertrain 202 configured to power the fracturing pump 104. For example, the powertrain 202 may include a prime mover 206 and a drivetrain. In some embodiments, the hydraulic fracturing unit 102 may be a direct drive turbine (DDT) unit in which the prime mover 206 is, or includes, a gas turbine engine (GTE), which may be operatively connected to an air intake duct 208 and an exhaust duct 210. As also shown, the drivetrain may include a reduction transmission 212 (e.g., gearbox) connected to a drive shaft 214, which, in turn, is connected to the fracturing pump 104, such as via an input shaft or input flange of the fracturing pump 104. Other types of GTE-to-pump arrangements are contemplated.

In some examples, the prime mover 206 may be a direct drive GTE. The GTE may be a dual-fuel or bi-fuel GTE, for example, operable using of two or more different types of fuel, such as natural gas and diesel fuel, although other types of fuel are contemplated. For example, a dual-fuel or bi-fuel GTE may be capable of being operated using a first type of fuel, a second type of fuel, and/or a combination of the first type of fuel and the second type of fuel. For example, the fuel may include compressed natural gas (CNG), natural gas, field gas, pipeline gas, methane, propane, butane, and/or liquid fuels, such as, for example, diesel fuel (e.g., #2 Diesel), bio-diesel fuel, bio-fuel, alcohol, gasoline, gasohol, aviation fuel, etc. Gaseous fuels may be supplied by CNG bulk vessels, a gas compressor, a liquid natural gas vaporizer, line gas, and/or well-gas produced natural gas. Other types and sources of fuel are contemplated. The prime mover 206 may be operated to provide horsepower to drive the fracturing pump 104 via the reduction transmission 212 to safely and successfully fracture a formation during a fracturing operation, such as a well stimulation project.

As schematically shown in FIG. 2, the hydraulic fracturing unit 102 also may include an auxiliary system 216 including auxiliary equipment located onboard the chassis 200, and configured to support operation of the hydraulic fracturing unit 102, including the fracturing pump 104 and the powertrain 202, as will be understood by those skilled in the art. The auxiliary equipment onboard the hydraulic fracturing unit 102 may include lubrication and cooling equipment, and at least some of the auxiliary equipment may be hydraulically driven by hydraulic drive equipment. The hydraulic drive equipment may include hydraulic pumps configured to pump hydraulic or other working fluid from one or more reservoirs through hydraulic lines to hydraulic motors. The hydraulic motors may be configured and positioned to receive the fluid as hydraulic power, which the hydraulic motors may use to drive various components of the auxiliary system 216. In some embodiments, the auxiliary system 216 may include electrically-powered components. Additionally, the hydraulic fracturing unit 104 may include an auxiliary fracturing pump.

During various operations, the hydraulic fracturing unit 102 may generate heat, for example, resulting from frictional engagement of pistons, bores or other components of the hydraulic fracturing unit 102. The lubrication and cooling equipment onboard the hydraulic fracturing unit 102 may therefore employ a fluid heat transfer medium, such as a natural or synthetic lubrication oil to reduce friction and/or absorb heat generated by the hydraulic fracturing unit 102. For example, the lubrication and/or cooling equipment may employ a fluid heat transfer medium to absorb heat from the fracturing pump 104, the prime mover 206, and/or the transmission 212, which may reduce heat associated with operation of the hydraulic fracturing unit 102. Even further, the hydraulically-driven auxiliary equipment may generate heat that may be absorbed by the hydraulic or other working fluid that provides and/or distributes hydraulic power. As described herein, this fluid heat transfer media, hydraulic fluid, working fluid, or other thermally-conductive fluid may be more generally referred to as process fluid.

The lubrication and cooling equipment onboard the hydraulic fracturing unit 102 may further include one or more heat exchanger assemblies 218 for cooling or transferring heat from in the aforementioned process fluids. In some embodiments, these heat exchanger assemblies 218 may include heat exchanger assemblies 218 for cooling process fluid from one or more of the fracturing pump 104, the prime mover 206, the transmission 212, and/or the auxiliary system 216. Even further, in some embodiments, the heat exchanger assemblies 218 may include separate heat exchanger assemblies for cooling process fluid from respective low-pressure and high-pressure portions of the power end of the fracturing pump 104.

The heat exchanger assemblies 218 may include fan-driven heat exchangers, tube and shell heat exchangers, or other suitable heat exchangers. In some embodiments, a suitable heat exchanger assembly may include one or more of each of a number of components, such as an intake fan motor configured to rotate a fan to cool process fluid carried through a radiator. In some examples, the radiator may be configured as a tube-and-shell heat exchanger in which conduits between inlet and outlet ports route the process fluid over a sufficient surface area to cause cooling of the process fluid. The radiator may be positioned in an airflow path at least partially provided by the fan to remove heat from the process fluid running through the conduits.

As shown in FIG. 1, as explained above, in some embodiments, the system 100 may include the supervisory control unit 130 configured and positioned to communicate with and/or assist with control of one or more of the hydraulic fracturing units 102, the mobile power units 110, and the backside equipment 114 (e.g., blender unit 116, the hydration unit 118, and/or the chemical unit 120), such as by wired or wireless data links directly or across one or more networks. FIG. 3 illustrates an example network architecture 300 for the system 100 according to some example embodiments. In some embodiments, the network architecture 300 may be implemented as an industrial control system (ICS), such as a supervisory control and data acquisition (SCADA) system, a distributed control system (DCS), or the like.

As shown in FIG. 3, the hydraulic fracturing units 102 may include respective field connection units 302 configured to enable the supervisory control unit 130 to communicate with the hydraulic fracturing units 102, and in particular transducers 304, which may include sensors, controllers, and/or actuators onboard the hydraulic fracturing units 102. Similarly, one or more of the mobile power units 110, the blender unit 116, the hydration unit 118, or and the chemical unit 120 may include respective field connection units 306, 308, 310, 312, transducers such as sensors 314, 316, 318, 320, and/or controllers. Further, in some embodiments, the system 100 may include a data acquisition (DAQ) arrangement 322 with a field connection unit 324 and/or one or more transducers 326 configured to provide measurements or data with respect to the fracturing operation. In some embodiments, the field connection units 302, 306, 308, 310, 312, and/or 324 may be or include local controllers. The backside equipment 114 and/or the hydraulic fracturing units 102 may each include one or more field connection units (e.g., local controllers) for various components or related to the backside equipment 114 and/or the hydraulic fracturing units 102.

The supervisory control unit 130 and one or more of the respective field connection units 302, 306, 310, 314, 318, or 322 may be configured to communicate by wired or wireless data links directly or across one or more networks, such as a control network 328. In some embodiments, the supervisory control unit 130 may be implemented as a supervisory computer, and the respective field connection units may be implemented as remote terminal units (RTUs), programmable logic controllers (PLCs), or some combination of RTUs and PLCs. The supervisory control unit 130 may be configured to communicate with one or more output devices 330, such as a terminal configured to provide a human-to-machine interface (HMI) to the supervisory control unit 130.

The supervisory control unit 130 may be integrated, co-located, or communicate by wired or wireless data links directly or across the control network 328.

In some embodiments, the supervisory control unit 130 may be configured to communicate with the transducers 304, 314, 316, 318, 320, and/or 326 for communication and/or control of the system 100, such as to enable the supervisory control unit 130 to control performance of pumping operations, provide alerts of faulty equipment, and/or detect harmful conditions. In some embodiments, the at least some of the transducers 304 onboard the hydraulic fracturing units 102 may include one or more transducers configured to generate signals indicative of conditions of the hydraulic drive equipment, which may be communicated to the supervisory control unit 130. These transducers 304 may include, for example, one or more pressure transducers or sensors, temperature transducers or sensors, flow meters, fluid condition meters, fluid level sensors, or the like.

In some embodiments, the transducers 304 onboard the hydraulic fracturing units 102 may include one or more transducers configured to generate signals indicative of conditions of the lubrication and/or cooling equipment for the fracturing pump 104, the prime mover 206, the transmission 212, and/or the auxiliary system 216. These transducers 304 may include, for example, temperature transducers and/or fluid quality sensors. For example, the temperature transducers may include temperature transducers at the inlet and outlet ports of a heat exchanger (e.g., a radiator) of one or more of the heat exchanger assemblies 218.

Other examples of suitable transducers include the one or more transducers 326 of the DAQ arrangement 322. For example, such transducers may include one or more pressure transducers, such as one or more wellhead pressure transducers, one or more pump output pressure transducers, and/or one or more flow rate transducers. The one or more wellhead pressure transducers may be disposed at the wellhead 106 to generate signals indicative of pressure of the fluid at the wellhead. The one or more pump output pressure transducers may be disposed adjacent an output of one of the fracturing pumps 104 that is in fluid communication with the manifold 108. The one or more flow rate transducers may be disposed anywhere in the system 100 through which the fracturing fluid flows, such as at the blender unit 116, the output of the fracturing pumps 104, the manifold 108, and/or the wellhead 106. The fluid pressure at the output of the fracturing pumps 104 may be substantially the same as the fluid pressure in the manifold 108 and/or the wellhead 106. One or more of the fracturing pumps 104 may include a pump output pressure transducer, and the supervisory control unit 130 may be configured to calculate the fluid pressure provided to the wellhead 106, for example, as an average of the fluid pressure measured by each of the pump output pressure transducers.

According to embodiments, the supervisory control unit 130 may be configured to perform automated diagnostics of electronic instrumentation, such as one or more of the transducers 304, 314, 316, 318, 320, or 326. The diagnostics may facilitate equipment maintenance, maintenance schedules and troubleshooting, and may improve the operational accuracy of the electronic instrumentation.

For example, the supervisory control unit 130 may be configured to receive signals from the transducers 304 onboard the hydraulic fracturing units 102 indicative of conditions of the hydraulic drive equipment, and determine the health of the hydraulic drive equipment prior to starting auxiliary equipment. The supervisory control unit 130 may thereby improve the likelihood that hydraulic pumps 104 of the hydraulic drive equipment are not operated with an insufficient amount of process fluid (e.g., in their reservoir(s)). The supervisory control unit 130 may be configured to determine whether the quality of the process fluid is acceptable and/or that its temperature is within an acceptable operating range.

In some embodiments, the supervisory control unit 130 may be configured to receive signals from the transducers 304 onboard the hydraulic fracturing units 102 indicative of conditions of the lubrication and cooling equipment, and monitor temperature of the process fluid to determine whether the temperature is within an acceptable operating range and/or monitor fluid levels to determine whether the fluid levels are not below a minimum level. For example, the efficiency or effectiveness of a heat exchanger assembly may become reduced with operation by dirt or debris, reducing the effectiveness of the heat exchange process for cooling the fluid (e.g., coolant). Temperature transducers may be positioned at the inlet port and outlet port of the heat exchanger and generate signals indicative of the temperature of the fluid at the inlet port and the outlet port, and the supervisory control unit may be configured to receive the signals and monitor determine the effectiveness of the heat exchange between the hot cooling fluid and heat exchanger. In some embodiments, the supervisory control unit 130 may be configured to compare the effectiveness and/or thermal efficiency of the heat exchanger to the effectiveness and/or thermal efficiency of the heat exchanger during a prior operation, to determine whether the heat exchanger should be serviced prior to beginning a fracturing operation, for example, by removing dirt and debris from the heat exchanger. The supervisory control unit 130 may be configured to utilize an analog input into the supervisory control unit 130. For example, the analog input may be configured to communicate an electrical current based on the fluid level (for example, a 4 milliamp (mA) current for 0% full and 20 mA for 100% full). In such embodiments, the supervisory control unit 130 may be configured to calibrate the electrical current to a fluid level relationship. In some embodiments, the supervisory control unit 130 may be configured to activate interlocks, for example, to prevent one or more of the hydraulic fracturing units 102 from operating at a fluid level below a minimum fluid level and to generate a notification or prompt to an operator or user of the system 100, notifying the operator or user of the low fluid level. The supervisory control unit 130 may be configured to prevent start-up of an engine (a GTE, an auxiliary engine, etc.) based on fluid level determination, for example, when fluid levels are below the minimum fluid level.

In some embodiments, the supervisory control unit 130 may be configured to receive diagnostic signals related to the system 100. For example, the supervisory control unit 130 may be configured to monitor sensor signal strength and/or connection for backside equipment 114 and/or the hydraulic fracturing units 102. For example, if a sensor fails to send an update, if a sensor sends an update at a longer than expected time, if the supervisory control unit 130 fails to obtain an update from the sensor, and/or if the supervisory control unit 130 does not obtain an update from the sensor at a longer than an expected time, the supervisory control unit 130 may be configured to communicate one or more signals indicative of the sensor issue. The signal(s) may include a prompt that may include information related to the status of the sensor and/or a corresponding error message (for example, "sensor data not received"). In some embodiments, the supervisory control unit 130 may be configured to calibrate or recalibrate one or more of the sensors. For example, the supervisory control unit 130 may define a sensor output based at least in part on signals generated by the sensors and communicated to the supervisory control unit 130 and/or to the location of the sensor (e.g., to the component of the hydraulic fracturing unit 102 one which the sensor).

In some embodiments, the supervisory control unit 130 may be configured to receive signals from transducers 326 of the DAQ arrangement 322 that generate signals indicative of pressure, such as, the wellhead pressure transducer and/or the pump output pressure transducer and based at least in part on the signals, determine the pressure associated with the fluid at the DAQ arrangement 322. In some embodiments, the supervisory control unit 130 may be configured to compare the determined pressure to an average of the pressures determined based on other transducers of the system 100. From this comparison, the supervisory control unit 130 may be configured to determine whether the measurement of pressure at the wellhead 106 and/or at any of the fracturing pumps 104 is outside an allowable calibration range (e.g., from about 1% to about 8%, for example, from about 2% to about 4%); and if so, generate a signal indicative of the sensor generating signals outside of an acceptable range, which may be communicated to an operator or user, so that the operator or user may investigate the condition of the sensor. For example, the pressure level outside the calibration range may be indicative of a closed valve in a discharge line and/or suction line. During pumping, a closed suction valve may result in failure and possible removal of a hydraulic fracturing unit 102 from the system 100 before or during a fracturing operation. In some embodiments, pressure measurements may be utilized on a line providing fluid flow from the blender unit 116 to the hydraulic fracturing pump 104. Tolerances may be allowed for the pressure differential in the line. A threshold may be set at 20%. Such a threshold may indicate a collapsed hose or line. A pressure differential of 100% may indicate that a suction valve is closed.

In another example, the supervisory control unit 130 may be configured to collect and/or store the health data for one, some, or all of the components associated with the system 100. For example, the supervisory control unit 130 may be configured to generate and/or communicate the health data to the output device(s) 330. In some embodiments, the health data may be presented as a dashboard. For example, the health data may be shown as a color-coded status (for example, red for poor health and/or green for good health). The supervisory control unit 130 may be configured to present the health data as a dashboard on the output device(s) 330. Such a dashboard may be presented as a series of tabs, for example, per each of the components of the system 100. Each tab may include various data points, as well as the health data or health status for the component(s) that correspond to the tab. The supervisory control unit 130 may be configured to generate and/or communicate signals indicative of prompts or notifications to the output device(s) 330, such as critical health events.

FIG. 4 schematically illustrates an example diagnostic control assembly 128 including (or be a component of) a supervisory control unit 130 associated with an example hydraulic fracturing unit 102 including example sensors, according to some embodiments of the disclosure. Although FIG. 4 only depicts a single hydraulic fracturing unit 102 and associated components, the diagnostic control assembly 128 may be configured to monitor, interact with, and/or at least partially control operation of a plurality of hydraulic fracturing units 102 and associated components and sensors. In some embodiments, the diagnostic control assembly 128 may be configured to identify a status associated with components of one or more hydraulic fracturing units 102, which may include, for example, a prime mover 206 positioned to drive, via a transmission 212, a hydraulic fracturing pump 104 to pump fracturing fluid into a wellhead 106 via a manifold 108, for example, as previously described herein.

As shown in FIG. 4, the diagnostic control assembly 128 may include a plurality of sensors configured to generate one or more sensor signals indicative of operating parameters associated with one or more of the hydraulic fracturing units 102 and/or the manifold 108. In some embodiments, one or more of the sensors may be incorporated into the diagnostic control assembly 128, and in some embodiments, the sensors may be separate from the diagnostic control assembly 128 and may be configured to communicate with the diagnostic control assembly 128, for example, via the control network 328 (FIG. 3). One or more of the sensors shown in FIG. 4 may generally correspond to one or more of the transducers shown in FIG. 3.

In some embodiments, the diagnostic control assembly 128 may include a supervisory control unit 130, for example, as described herein. The supervisory control unit 130 may be configured to receive the plurality of sensor signals associated with operation of the system 100. Based at least in part on one or more the sensor signals received from one or more of the sensors, the supervisory control unit 130 may be configured to determine whether one or more of the plurality of sensors is generating signals outside a calibration range due, for example, to being out of calibration, wear, or damage. In some embodiments, when one or more of the sensors is generating signals outside the calibration range, the supervisory control unit 130 may be configured to generate a calibration signal indicative of the one or more sensors generating signals outside the calibration range. For example, the supervisory control unit 130 may be configured to communicate one or more signals to the output device(s) 330 via the control network 328 (FIG. 3). For example, the output device(s) 330 may provide a warning that one or more of the sensors is operating outside a calibration range. The warning may be visual, audible, and/or tactile (e.g., a vibration).

For example, the supervisory control unit 130, when determining whether one or more of the plurality of sensors is generating signals outside the calibration range, may be configured to receive a manifold pressure signal from a manifold pressure sensor 400 associated with the manifold 108 indicative of pressure associated with fluid flowing in the manifold 108. In some embodiments, the supervisory control unit 130 may also, or alternatively, be configured to receive a manifold flow rate signal from a manifold flow rate sensor 402 associated with the manifold 108. The supervisory control unit 130 may further be configured to receive unit pressure signals from a unit pressure sensor 404 (e.g., a unit pressure sensor 404 associated with the output of a respective one or more hydraulic fracturing units 102) indicative of pressure associated with fluid flowing from the respective hydraulic fracturing unit 102. In some embodiments, a unit flow rate sensor configured to generate signals indicative of flow rate from each of the respective hydraulic fracturing units may be used as an alternative or supplement to the unit pressure sensors.

In some embodiments, based at least in part on one or more of the manifold pressure signals or the unit pressure signals, the supervisory control unit 130 may be configured to determine whether the manifold pressure sensor 400 and/or one or more of the plurality of unit pressure sensors 404 is generating signals outside the calibration range. In some embodiments, the unit pressure sensors 404 may take the form of pump discharge pressure sensors 406, each of which may be associated with an output of a respective hydraulic fracturing pump 104 and may be configured to generate one or more pressure signals indicative of the pressure of fracturing fluid being discharged from the respective hydraulic fracturing pump 104. In some embodiments, the pump discharge pressure sensors 406 may be substituted with, or supplemented by, a respective pump flow rate sensor 408.

In some embodiments, the supervisory control unit 130 may be configured to determine whether the manifold pressure sensor 400 and/or one or more of the unit pressure sensors 404 (and/or pump discharge pressure sensors 406) is generating signals outside the calibration range by determining an average pressure associated with fluid flowing in the manifold 108 and fluid flowing from the hydraulic fracturing units 102. The supervisory control unit 130 may use the average pressure to identify the manifold pressure sensor 400 or the unit pressure sensors 404 as generating signals indicative of a pressure outside a pressure range of the average pressure. For example, in some embodiments, the manifold pressure sensor 400 and the unit pressure sensors 404 of the respective hydraulic fracturing units 102 should be generating sensor signals indicative of generally same pressure. In some embodiments, the supervisory control unit 130 may be configured to identify pressure sensors that are generating sensor signals outside a pressure range as needing calibration, recalibration, service, or replacement. In some embodiments, a pressure range of deviation from the average pressure may range from about 1% to about 10%, for example, from about 2% to about 8%, from about 2% to about 6%, from about 2% to about 4%, or from about 3% to about 5%.

In some embodiments, the supervisory control unit 130 may be configured to identify pressure sensors (and/or other types of sensors) as needing calibration, recalibration, service, or replacement by selecting two of the pressure sensors and determining whether one of the two pressure sensors is generating pressure signals indicative of the need to calibrate, recalibrate, service, or replace the pressure sensor. For example, the supervisory control unit 130 may be configured to select two pressure sensors for evaluation and thereafter identify the pressure sensors generating sensor signals indicative of the highest and lowest pressures associated with fluid flowing in the manifold 108 and fluid flowing from the one or more of the plurality of hydraulic fracturing units 102. Once the highest and lowest pressures are identified, the supervisory control unit 130 may be configured to determine a pressure difference by subtracting the lowest pressure from the highest pressure, and thereafter determine a pressure deviation by dividing the pressure difference by the highest pressure. Once the pressure deviation is determined, the supervisory control unit 130 may be configured to identify, based at least in part on the pressure deviation, the manifold pressure sensor and/or the unit pressure sensors (and/or the pump discharge pressure sensors) as generating signals outside a calibration range if the pressure deviation is greater than a threshold pressure deviation. The threshold pressure deviation may range from about 1% to about 10%, for example, from about 2% to about 8%, from about 3% to about 7%, from about 4% to about 6%, or about 5%.

In some embodiments, the supervisory control unit 130 may be configured to determine an extent to which a heat exchanger assembly 218 associated with one or more of the plurality of hydraulic fracturing units 102 is cooling fluid passing through the heat exchanger assembly 218. The hydraulic fracturing units 102 may include multiple heat exchanger assemblies 218. For example, the heat exchanger assemblies 218 may be associated with one or more of the prime mover 206 (e.g., with the intake air, the coolant, and/or the lubricant), the transmission 212 (e.g., with the transmission coolant and/or lubricant), the hydraulic fracturing pump 104 (e.g., with the pump lubricant), or any of the fluids of the auxiliary system 216 (e.g., with the inlet air, hydraulic fluid, coolant, and/or lubricant). In some such embodiments, the supervisory control unit 130, when it has been determined that the extent to which one or more of the heat exchanger assemblies 218 is cooling fluid is below a minimum cooling effectiveness, may be configured to generate a cooling signal indicative of the one or more heat exchanger assemblies 218 operating with a low effectiveness.

For example, the supervisory control unit 130 may be configured to determine a current inlet temperature associated with fluid flowing into an inlet of a given heat exchanger assembly 218. For example, an inlet temperature sensor 410 associated with the heat exchanger assembly 218 may be configured to generate signals indicative of the temperature of fluid flowing into the inlet of the heat exchanger assembly 218. The supervisory control unit 130 also may be configured to determine a current outlet temperature associated with the fluid flowing through an outlet of the heat exchanger assembly 218. For example, an outlet temperature sensor 412 associated with the heat exchanger assembly 218 may be configured to generate signals indicative of the temperature of fluid flowing through the outlet of the heat exchanger assembly 218. The supervisory control unit 130 may further be configured to compare one or more of the current inlet temperature or the current outlet temperature to historical data 414 associated with operation of the heat exchanger assembly 218 during prior operation. Based at least in part on the comparison, the supervisory control unit 130 may further be configured to determine the cooling effectiveness of the heat exchanger assembly 218, and/or whether the effectiveness indicates a degradation of its cooling capacity, for example, due to debris partially or fully blocking the inlet, heat transfer surfaces, and/or outlet of the heat exchanger assembly 218.

In some embodiments, the historical data 414 may include correlations between the cooling effectiveness of the heat exchanger assembly 218 (e.g., a particular one of the heat exchanger assemblies 218) and the inlet temperature of the heat exchanger assembly 218, the outlet temperature of the heat exchanger assembly 218, a prime mover air inlet temperature, a prime mover power output, and/or an ambient temperature (e.g., the temperature of the environment in which the fracturing operation is occurring). In some embodiments, the prime mover air inlet temperature may be used to approximate the ambient air temperature. For example, the historical data 414 may include correlations between the cooling effectiveness of the heat exchanger assembly 218 and the prime mover power output and/or prime mover air inlet temperature (and/or the ambient temperature). Thus, in some embodiments, the historical data 414 may include a look-up table that provides the historical cooling effectiveness for a heat exchanger assembly 218 for a given prime mover power output (or range of power outputs) and the ambient temperature (or a range of ambient temperatures), which may be approximated by the prime mover inlet temperature. In some embodiments, the supervisory control unit 130 may be configured to determine the prime mover power output and the ambient temperature and, based at least in part on these values, determine from the look-up table an expected cooling effectiveness of the heat exchanger assembly 218, for example, based on the historical data 414.

In some embodiments, the supervisory control unit 130 may be configured to update the historical data 414 during operation of the hydraulic fracturing unit 102, for example, periodically or intermittently. For example, while the hydraulic fracturing unit 102 is operating, the supervisory control unit 130 may collect and store data related to the current inlet and outlet temperature of the heat exchanger assembly 218, the ambient temperature (or the prime mover air inlet temperature), and the prime mover power output, and add the collected data to the look-up table to add to the historical data 414. In some embodiments, the supervisory control unit 130 may calculate the temperature difference between inlet and outlet temperatures of the heat exchanger assembly 218 and the cooling effectiveness (e.g., the cooling efficiency) for each set of data.

In some embodiments, the supervisory control unit 130 may be configured generate a fault signal indicative of the heat exchanger assembly 218 operating with a low effectiveness, for example, when the heat exchanger 218 is cooling fluid below a minimum cooling effectiveness. In some embodiments, the minimum cooling effectiveness may be predetermined or determined in real-time. For example, the minimum cooling effectiveness may be predetermined as a threshold below which the supervisory control unit 130 will generate a fault signal. In some embodiments, the supervisory control unit 130 will compare the current cooling effectiveness with historical cooling effectiveness from the historical data, and when the current cooling effectiveness drops below a certain threshold relative to the historical cooling effectiveness, the supervisory control unit 130 may generate a fault signal. With respect to real-time minimum cooling effectiveness, the supervisory control unit 130 may be configured to monitor the inlet and/or outer temperatures and/or determine the cooling effectiveness, and when changes in the inlet and/or outlet temperatures and/or the cooling effectiveness are indicative of a rate of degradation of cooling effectiveness greater than a threshold maximum rate of degradation, the supervisory control unit 130 may generate a fault signal.

In some embodiments, the supervisory control unit 130 may be configured to generate a first fault signal when the current cooling effectiveness drops below a first minimum cooling effectiveness, and a second fault signal when the current cooling effectiveness drops below a second minimum cooling effectiveness. The first fault signal may provide a warning to an operator or user via the output device 330 indicating a need to service the heat exchanger assembly 218 soon (e.g., at the next scheduled maintenance event). The second fault signal may provide a warning to an operator or user via the output device 330 indicating an urgent need to service the heat exchanger assembly 218, for example, to clean a radiator of the heat exchanger assembly 218 (e.g., prior to the next scheduled maintenance event).

In some embodiments, the supervisory control unit 130 may be configured to calculate an average temperature difference between the inlet temperature and the outlet temperature for the heat exchanger assembly 218, for example, based on a summation of temperature differences over time divided by the number of temperature differences used in the summation. In some embodiments, these average temperature differences may be updated with each data set collected during operation of the hydraulic fracturing unit 102 and added to the historical data. With each new (current) average temperature difference, the current average temperature difference, within a given range of prime mover power outputs and a corresponding given range of ambient temperatures, the current average temperature difference may be compared to the first average temperature difference calculated and stored in the historical data 414. In some embodiments, when the current average temperature difference deviates from the first average temperature difference by more than a first average temperature difference threshold, the supervisory control unit 130 may be configured to generate the first fault signal. When the current average temperature difference deviates from the first average temperature difference by more than a second average temperature difference threshold (e.g., greater than the first average temperature difference threshold), the supervisory control unit 130 may be configured to generate the second fault signal.

For example, the first average temperature difference between the inlet and the outlet of the heat exchanger assembly 218, for a given prime mover power output range and/or a given ambient temperature range, may equal a first temperature difference. During operation of the hydraulic fracturing unit 102, the supervisory control unit 130 may continue to collect and determine multiple average temperature differences. In some embodiments, every time (or periodically or intermittently) a new average temperature difference is determined, the supervisory control unit 130 may compare the newly determined average temperature difference between the inlet and the outlet of the heat exchanger assembly 218. If the supervisory control unit 130 determines that the newly determined average temperature difference has deviated from the first average temperature difference by more than the first average temperature difference threshold, the supervisory control unit 130 may be configured to generate the first fault signal. If the supervisory control unit 130 determines that the newly determined average temperature difference has deviated from the first average temperature difference by more than the second average temperature difference threshold, the supervisory control unit 130 may be configured to generate the second fault signal. This example process may be performed for one or more (e.g., each) of the heat exchanger assemblies 218 on one or more (e.g., each) of the hydraulic fracturing units 102 of the hydraulic fracturing system 100.

In some embodiments, the fault signals may be communicated to the output device(s) 330 (FIG. 3), and the output device(s) 330 may provide an operator or user with a warning that the heat exchanger assembly 218 is not operating according to normal effectiveness due, for example, to dirt or debris partially or fully obstructing the cooling surfaces. The warning may be visual, audible, and/or tactile (e.g., a vibration).

As shown in FIG. 4, some embodiments of the supervisory control unit 130 may be configured to determine whether a fluid parameter associated with the auxiliary system 216 associated with one or more (e.g., each) of the hydraulic fracturing units 102 is indicative of a fluid-related problem, and when the fluid parameter is indicative of a fluid-related problem, generate a fluid signal indicative of the fluid-related problem. For example, the supervisory control unit 130 may be configured to receive a fluid level signal from a fluid level sensor 416 indicative of a level of fluid in a fluid reservoir. For example, the auxiliary system 218 may include an engine (e.g., a diesel engine) to generate mechanical power for operating components of the auxiliary system 218, and the fluid level sensor may be configured to generate signals indicative a fuel level in a fuel tank and/or signals indicative of the level of hydraulic fluid in a hydraulic fluid reservoir. In some embodiments, when the fluid level signal is indicative of a fluid level below a minimum fluid level, the supervisory control unit 130 may be configured to generate a low level signal indicative of the fluid level being below the minimum fluid level. In some embodiments, this may prevent commencement or completion of performance of a fracturing operation until the fluid level is increase.

In some embodiments, determining whether a fluid parameter is indicative of a fluid-related problem may include determining whether the quality of fluid associated with the auxiliary system 218 is below a minimum fluid quality. The fluid may be fuel, coolant, lubricant, and/or hydraulic fluid. For example, the supervisory control unit 218 may be configured to receive a fluid quality signal from a fluid quality sensor 418 indicative of a fluid quality of fluid in the auxiliary system 218, and when the fluid quality signal is indicative of a fluid quality below a minimum fluid quality, the supervisory control unit 130 may be configured to generate a low fluid quality signal indicative of the fluid quality being below the minimum fluid quality. For example, the supervisory control unit 130 may be configured to generate a fault signal indicative of the low fluid quality, and the fault signal may be communicated to the output device(s) 330 (FIG. 3). The output device(s) 330 may provide an operator or user with a warning that the fluid associated with the auxiliary system 218 is low and needs to be changed. The warning may be visual, audible, and/or tactile (e.g., a vibration). In some embodiments, the supervisory control unit 130 may be further configured to prevent a hydraulic fracturing unit 102 associated with the low fluid quality signal from commencing or completing performance of a hydraulic fracturing operation, or generate a maintenance signal indicative of initiating maintenance associated with the fluid.

In some embodiments, determining whether a fluid parameter is indicative of a fluid-related problem may include receiving a fluid temperature signal from a fluid temperature sensor 420 indicative of a temperature of fluid associated with the auxiliary system 218. When the fluid temperature signal is indicative of a fluid temperature outside an operating temperature range, the supervisory control unit 130 may be configured to generate a fluid temperature range signal indicative of the fluid temperature being outside the operating temperature range. For example, the supervisory control unit 130 may be configured to generate a fault signal indicative of either a low temperature or a high temperature, depending on whether the temperature is too low or too high (e.g., either below a low threshold temperature or above a high threshold temperature). The fault signal may be communicated to the output device(s) 330 (FIG. 3). The output device(s) 330 may provide an operator or user with a warning that the fluid associated with the auxiliary system 218 not within an operating temperature range. The warning may be visual, audible, and/or tactile (e.g., a vibration). In some embodiments, the supervisory control unit 130 may be further configured to prevent a hydraulic fracturing unit 102 associated with the low or high temperature from commencing or completing performance of a hydraulic fracturing operation.

In some embodiments, the supervisory control unit 130 may be configured to determine whether lubrication associated with the prime mover 206, the hydraulic fracturing pump 104, and/or the transmission 212 associated with one or more of the hydraulic fracturing units 102 has a lubrication fluid temperature greater than a maximum lubrication temperature (and/or outside an operating temperature range) and/or has a lubrication pressure outside an operational lubrication pressure range. For example, the supervisory control unit 130 may be configured to receive signals from one or more of a lubrication temperature sensor 422 and/or a lubrication pressure sensor 424 of the prime mover 206, a lubrication temperature sensor 426 and/or a lubrication pressure sensor 428 of the transmission 212, and/or a lubrication temperature sensor 430 and/or a lubrication pressure sensor 432 of the hydraulic fracturing pump 104. When one or more components of one or more of the of hydraulic fracturing units 102 has a lubrication fluid temperature greater than the maximum lubrication temperature and/or a lubrication pressure outside the operational lubrication pressure range, the supervisory control unit 130 may be configured to generate a lubrication temperature signal and/or a lubrication pressure signal indicative of the lubrication fluid temperature greater than the maximum lubrication temperature (and/or outside an operational temperature range) and/or a lubrication pressure outside the lubrication operational pressure range. The signal(s) may include a fault signal communicated to the output device(s) 330 (FIG. 3). The output device(s) 330 may provide an operator or user with a warning that one or more components of one or more of the of hydraulic fracturing units 102 has a lubrication fluid temperature greater than the maximum lubrication temperature and/or a lubrication pressure outside the operational lubrication pressure range. The warning may be visual, audible, and/or tactile (e.g., a vibration). In some embodiments, the supervisory control unit 130 may be further configured to prevent a hydraulic fracturing unit 102 associated with the fault signal from commencing or completing performance of performing a hydraulic fracturing operation.

FIGS. 5, 6A, 6B, 7A, and 7B are block diagrams of example methods 500, 600, and 700 to identify inaccuracies of a plurality of pressure sensors associated with operating one or more hydraulic fracturing units, to determine a status of an auxiliary system associated with a hydraulic fracturing unit, and to determine a cooling effectiveness of a heat exchanger assembly associated with a hydraulic fracturing unit, respectively, according to embodiments of the disclosure, illustrated as a collection of blocks in logical flow graphs, which represent sequences of operations. In some embodiments, at least some portions of the methods 500, 600, and/or 700 may be combined into, for example, a combined and/or coordinated method, which may occur concurrently and/or substantially simultaneously during, or prior to, operation of one or more hydraulic fracturing units. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular data types. The order in which the operations are described is not intended to be construed as a limitation, and any number of the described blocks may be combined in any order and/or in parallel to implement the methods.

FIG. 5 depicts a flow diagram of an embodiment of an example method 500 to identify inaccuracies of a plurality of pressure sensors configured to generate signals indicative of fluid pressure associated with operation of components of a plurality of hydraulic fracturing units including a prime mover positioned to drive a hydraulic fracturing pump to pump fracturing fluid into a wellhead via a manifold, according to embodiments of the disclosure. For example, the method 500 may be configured to semi- or fully-autonomously identify inaccuracies of one or more pressure sensors associated with operation of a hydraulic fracturing system during a fracturing operation involving a plurality of hydraulic fracturing units, for example, as previously described herein.

The example method 500, at 502, may include receiving a plurality of unit pressure signals generated by a plurality of respective unit pressure sensors. The unit pressure signals may be indicative of respective output pressures of each of the plurality of hydraulic fracturing units. For example, a supervisory control unit may be configured to receive the pressure signals from pressure sensors associated with the fracturing fluid output of each of the hydraulic fracturing units during a fracturing operation, for example, as previously described herein. In some embodiments, the pressure sensors may be associated with the hydraulic fracturing pumps of each of the hydraulic fracturing units, for example, at the fracturing fluid discharge. In some embodiments, receipt of the unit pressure signals may occur during the hydraulic fracturing operation, enabling the identification of the inaccuracies during the fracturing operation.

At 504, the example method 500 may include receiving a manifold pressure signal generated by a manifold pressure sensor. The manifold pressure signals may be indicative of pressure associated with fluid flowing in the manifold of the hydraulic fracturing system. In some embodiments, the supervisory control unit may be configured to receive the manifold pressure signals, for example, as described previously herein.

The example method 500, at 506, may further include determining, based at least in part on the unit pressure signals and the manifold pressure signal, whether the manifold pressure sensor and/or one or more of the unit pressure sensors is generating signals outside a calibration range. In some embodiments, the supervisory control unit may be configured to make such a determination, for example, as described previously herein.

For example, at 508, the example method 500 may include determining an average pressure associated with fluid flowing in the manifold of the hydraulic fracturing system and fluid flowing from the hydraulic fracturing units (e.g., the fracturing fluid exiting the discharge of the hydraulic fracturing pumps). For example, the supervisory control unit may be configured to add the pressures output by each of the pressure sensors to determine a pressure summation and thereafter divide the pressure summation by the number of pressure sensors to determine the average pressure.

At 510, the example method 500 may include determining a pressure difference between the average pressure and the pressure output by each of the pressure sensors (e.g., the manifold pressure sensor and the unit pressure sensors). For example, for each of the pressure sensors, the supervisory control unit may be configured to determine a pressure difference between the average pressure and the pressure output by each of the pressure sensors, for example, as previously described herein.

The example method 500, at 512, may further include dividing the pressure difference by the average pressure to determine a pressure deviation for each of the pressure sensors. For example, the supervisory control unit may be configured to divide the pressure difference by the average pressure to determine a pressure deviation for each of the pressure sensors, for example, as previously described herein.

At 514, the example method 500 may further include determining whether any of the pressure sensors is generating pressure signals indicative of pressure outside a pressure range of the average pressure. For example, the supervisory control unit may be configured to determine, for each pressure sensor, whether the respective pressure deviation is greater than a predetermined pressure range representative of an acceptable difference between the average pressure and the actual pressure as measured by each of the pressure sensors. In some embodiments, pressure range of deviation from the average pressure may range from about 1% to about 10%, for example, from about 2% to about 8%, from about 2% to about 6%, from about 2% to about 4%, or from about 3% to about 5%.

If, at 514, it is determined that none of the pressure sensors is generating pressure signals indicative of pressure outside the pressure range, the example method 500 may include returning to 502 to continue monitoring the pressure sensor signals to identify any pressure sensors generating pressure signals indicative of a pressure outside the pressure range.

If, at 514, it is determined that any of the pressure sensors is generating pressure signals indicative of pressure outside the pressure range of the average pressure, at 516, the example method 500 may further include identifying the manifold pressure sensor and/or unit pressure sensors as generating signals indicative of a pressure outside a pressure range of the average pressure. For example, the supervisory control unit may be configured to, for each of the pressure sensors exhibiting a respective pressure deviation greater than the predetermined pressure range representative of an acceptable difference between the average pressure and the actual pressure, as measured by each of the pressure sensors, identify the manifold pressure sensor and/or unit pressure sensors as generating signals indicative of a pressure outside a pressure range.

At 518, the example method 500 may further include generating a fault signal providing an indication that one or more of the pressure sensors is generating signals indicative of a pressure greater than the predetermined pressure range. For example, the supervisory control unit may be configured to generate a fault indicative of the inaccuracy of the one or more pressure sensors, and in some embodiments, identify the one or more pressure sensors exhibiting the in accuracy, so that the source or problem associated with the inaccuracy may be identified and/or corrected. For example, fault signal(s) may be communicated to the output device(s), for example, as previously described herein. The output device(s) may provide an operator or user with a warning that one or more of the pressure sensors is generating inaccurate pressure signals. The warning may be visual, audible, and/or tactile (e.g., a vibration). Thereafter, the example method 500 may return to 502 to continue to monitor pressure signals generated by the pressure sensors from the sensors to identify inaccurate pressure readings.

In some embodiments, the method 500 may include identifying pressure sensors (and/or other types of sensors) as needing calibration, recalibration, service, or replacement by selecting two of the pressure sensors and determining whether one of the two pressure sensors is generating pressure signals indicative of the need to calibrate, recalibrate, service, or replace the pressure sensor. For example, the method may include selecting two pressure sensors for evaluation and thereafter identifying the pressure sensor generating sensor signals indicative of the highest and lowest pressures associated with fluid flowing in the manifold and fluid flowing from the hydraulic fracturing units.

The method 500 may also include determining a pressure difference by subtracting the lowest pressure from the highest pressure, and determining a pressure deviation by dividing the pressure difference by the highest pressure. The method further may include identifying, based at least in part on the pressure deviation, the manifold pressure sensor and/or the unit pressure sensor (and/or the pump discharge pressure sensors) as generating signals outside a calibration range if the pressure deviation is greater than a threshold pressure deviation. For example, the threshold pressure deviation may range from about 1% to about 10%, for example, from about 2% to about 8%, from about 3% to about 7%, from about 4% to about 6%, or about 5%.

FIG. 6 depicts a flow diagram of an embodiment of an example method 600 to determine a status of an auxiliary system associated with a hydraulic fracturing unit according to embodiments of the disclosure. For example, the auxiliary system may include one or more components that are powered by a liquid fuel, such as an engine (e.g., a diesel engine), cooled by coolant, lubricated by lubricant, and/or that use a fluid (e.g., hydraulic fluid) to activate and/or control operation of fluid-powered actuators (e.g., hydraulic motors and/or hydraulic cylinders), for example, as described previously herein. In some embodiments, the method 600 may determine whether a fluid parameter associated with the auxiliary system of one or more of the hydraulic fracturing units associated with a hydraulic fracturing system is indicative of a fluid-related problem, and when the fluid parameter is indicative of a fluid-related problem, generate a fluid signal indicative of the fluid-related problem.

For example, at 602, the example method 600 may include receiving a fluid level signal indicative of a level of fluid in a fluid reservoir. For example, the supervisory control unit may be configured to receive a fluid level signal from a fluid level sensor, the fluid level signal being indicative of a fluid level in, for example, a reservoir containing a supply of fluid, such as a fuel tank or a hydraulic fluid reservoir.

At 604, the example method 600 may include, based at least in part of the fluid level signal, comparing the fluid level indicated by the fluid level signal with a predetermined minimum fluid level. For example, the supervisory control unit may be configured to receive a signal indicative of the minimum fluid level from an operator or user, for example, communicated to the supervisory control unit via a terminal including a graphic user interface prompting and/or facilitating selection or entry of a minimum fluid level.

At 606, the example method 600 may include determining whether the fluid level is below the minimum fluid level. For example, based on the comparison, the supervisory control unit may be configured to determine whether the fluid level is below the minimum fluid level.

If, at 606, it is determined that one or more of the fluids of the auxiliary system has a fluid level below the minimum fluid level, the example method 600, at 608, may include generating a low level signal indicative of the fluid level being below the minimum fluid level. For example, if the fluid level is the level of fuel in the fuel tank of an engine for powering the auxiliary system, and the minimum fluid level is one-third full, for example, the supervisory control unit may be configured to generate a low level signal indicative of the fluid level being below the minimum fluid level. The fuel level signal, in turn, may cause generation of a warning signal for the operator or user, for example, at the output device. For example, warning signal may be communicated to the output device, for example, as previously described herein. The output device may provide an operator or user with a warning that the fuel level is too low to commence or complete a hydraulic fracturing operation (e.g., a fracturing stage). The warning may be visual, audible, and/or tactile (e.g., a vibration). In some embodiments, the warning signal may cause an interlock associated with the hydraulic fracturing unit and/or the hydraulic fracturing system to prevent commencement of the fracturing operation or shut-down a fracturing operation that has already started. In some embodiments, the warning signal may cause generation of a maintenance signal indicative of initiating maintenance associated with the fluid, such as refilling the fluid reservoir (e.g., refueling the auxiliary system).

In some embodiments, if at 606, it is determined that the fluid level is not below the minimum fluid level, the example method 600 may include advancing to 610. In some embodiments, at 610, the example method 600 may include receiving a fluid quality signal from a fluid quality sensor indicative of a fluid quality of fluid in the auxiliary system. For example, the fluid may include fuel, coolant, lubricant, or hydraulic fluid, and the fluid quality signal may be indicative a condition of the fluid, such as the presence of particulates, a need to replace the fluid, a lack of viscosity of a lubricant, or a lack of coolant capability for a coolant. In some embodiments, fluid quality may refer to one or more of many fluid characteristics, depending, for example, on the type of fluid.

At 612, the example method 600 may include comparing the fluid quality indicated by the fluid quality signal with a minimum fluid quality. For example, the supervisory control unit may be configured to determine the fluid quality based at least in part on the fluid quality signal and compare the determined fluid quality with a minimum fluid quality. In some embodiments, the minimum fluid quality associated with the different fluids of the auxiliary system may be stored in memory, and the supervisory control unit may be configured to access the stored minimum fluid quality and compare fluid quality indicated by the fluid quality signal with the minimum fluid quality.

At 614, the example method 600 may include determining whether the fluid quality is below the minimum fluid quality. For example, based on the comparison at 612, the supervisory control unit may be configured to determine whether the fluid quality is below the minimum fluid quality.

If, at 614, it is determined that one or more of the fluids of the auxiliary system has a fluid quality below the minimum fluid quality, the example method 600, at 616, may include generating a maintenance signal indicative of initiating maintenance associated with the fluid. For example, the supervisory control unit may be configured to generate a maintenance signal, so that maintenance (e.g., replacement) associated with the fluid may be scheduled or performed. In some embodiments, the supervisory control unit may be configured to generate a low fluid quality warning signal indicative of the fluid quality being below the minimum fluid quality. The low fluid quality signal, in turn, may cause generation of a warning signal for the operator or user, for example, at the output device. For example, the warning signal may be communicated to the output device, as previously described herein. The output device may provide an operator or user with a warning that the fluid quality low. The warning may be visual, audible, and/or tactile (e.g., a vibration). In some embodiments, the warning signal may cause an interlock associated with the hydraulic fracturing unit and/or the hydraulic fracturing system to prevent commencement of the fracturing operation or shut-down a fracturing operation that has already started. In some embodiments, the warning signal may cause generation of a maintenance signal indicative of initiating maintenance associated with the fluid, such as replacing the fluid and/or a filter for filtering the fluid.

In some embodiments, if at 614, it is determined that the fluid quality is not below the minimum fluid quality, the example method 600 may include advancing to 618. In some embodiments, at 618, the example method 600 may include receiving a fluid temperature signal from a fluid temperature sensor indicative of a temperature of fluid in the auxiliary system. For example, the fluid temperature signal may be indicative the temperature of the fluid.

At 620 (FIG. 6B), the example method 600 may include comparing the temperature of the fluid with an operating temperature range consistent with normal operation of the component of the auxiliary system related to the fluid. For example, the supervisory control unit may be configured to determine the fluid temperature based at least in part on the fluid temperature signal and compare the determined fluid temperature with an operating temperature range. In some embodiments, the operating temperature range associated with the different fluids of the auxiliary system may be stored in memory, and the supervisory control unit may be configured to access the stored operating temperature range and compare determined temperature with the operating temperature range.

At 622, the example method 600 may include determining whether the fluid temperature is outside the operating temperature range (e.g., either below or above the operating temperature range). For example, based on the comparison at 620, the supervisory control unit may be configured to determine whether the temperature is outside the operating temperature range.

If, at 622, it is determined that the fluid temperature is outside the operating temperature range, at 624, the example method 600 may include generating a fluid temperature range signal indicative of the fluid temperature being outside the operating temperature range. For example, the supervisory control unit may be configured to generate a fluid temperature range signal indicative of the fluid temperature being outside the operating temperature range. For example, fluid temperature range signal may be communicated to the output device, for example, as previously described herein. The output device may provide an operator or user with a warning that the temperature is outside the operating range. The warning may be visual, audible, and/or tactile (e.g., a vibration). In some embodiments, the warning signal may cause an interlock associated with the hydraulic fracturing unit and/or the hydraulic fracturing system to prevent commencement of the fracturing operation or shut-down a fracturing operation that has already started.

At 626, the example method 600 may include determining whether the fluid temperature is lower than the operating temperature range or higher than the operating temperature range. For example, based at least in part on the comparison at 620, the supervisory control unit may be configured to determine whether the fluid temperature is lower than the operating temperature range or higher than the operating temperature range.

If, at 626, it is determined that the fluid temperature is lower than the operating temperature range, at 628, the example method 600 may include causing the hydraulic fracturing unit to continue idling before commencement of a fracturing operation to provide the component or components associated with the fluid to heat the fluid to the operating temperature range. In some embodiments, the example method 600 may thereafter return to 620 to continue to compare the fluid temperature with the operating temperature range until the fluid temperature reaches the operating temperature range.

If, at 626, it is determined that the fluid temperature is higher than the operating temperature range, at 630, the example method 600 may include generating a high temperature warning signal indicative of the fluid temperature being higher than the operating temperature range. For example, the supervisory control unit may be configured to generate a high temperature warning signal indicative of the fluid temperature being higher than the operating temperature range. The high temperature warning signal may be communicated to the output device, for example, as previously described herein. The output device may provide an operator or user with a warning that the fluid temperature is higher than the operating temperature range. The warning may be visual, audible, and/or tactile. In some embodiments, the warning signal may cause an interlock associated with the hydraulic fracturing unit and/or the hydraulic fracturing system to prevent commencement of the fracturing operation (if not already started) or shut-down a fracturing operation that has already started. In some embodiments, the warning signal may cause generation of a maintenance signal indicative of initiating maintenance associated with the hydraulic fracturing unit, for example, to determine the cause of the high temperature and/or provide an appropriate correction.

If, at 622, it is determined that the fluid temperature is within the operating temperature range, at 632, and the fracturing operation has not commenced, the example method 600 may include allowing the hydraulic fracturing unit to proceed to commencing with the fracturing operation, barring other conditions with the hydraulic fracturing system that may prevent commencement of the fracturing operation. If the fracturing operation has already commenced, the example method 600 may allow the fracturing operation to continue, barring other conditions that may cause shut-down of the fracturing operation.

FIG. 7 depicts a flow diagram of an embodiment of an example method 700 to determine a cooling effectiveness of a heat exchanger assembly associated with a hydraulic fracturing unit according to embodiments of the disclosure. For example, the hydraulic fracturing units may each include one or more heat exchanger assemblies configured to cool fluid, such as air or liquids associated with operation of the hydraulic fracturing units. For example, heat exchanger assemblies may be configured to cool coolant, hydraulic fluid, lubricant, fuel, and/or air used for operation of the hydraulic fracturing units. In some embodiments, the example method 700 may determine the cooling effectiveness of one or more of the heat exchanger assemblies.

At 702, the example method 700 may include receiving an inlet temperature signal indicative of an inlet temperature of fluid flowing through an inlet of a heat exchanger assembly. For example, the supervisory control unit may be configured to receive inlet temperature signals from an inlet temperature sensor associated with the inlet of the heat exchanger assembly, for example, as previously described herein.

The example method 700, at 704, may include receiving an outlet temperature signal indicative of an outlet temperature of fluid flowing through an outlet of the heat exchanger assembly. For example, the supervisory control unit may be configured to receive outlet temperature signals from an outlet temperature sensor associated with the outlet of the heat exchanger assembly, for example, as previously described herein.

At 706, the example method 700 may include determining the inlet temperature associated with fluid flowing through the inlet of the heat exchanger assembly. For example, based at least in part on the inlet temperature signals, the supervisory control unit may be configured to determine the inlet temperature associated with fluid flowing through the inlet of the heat exchanger assembly.

At 708, the example method 700 may include determining the outlet temperature associated with fluid flowing through the outlet of the heat exchanger assembly. For example, based at least in part on the outlet temperature signals, the supervisory control unit may be configured to determine the outlet temperature associated with fluid flowing out the outlet of the heat exchanger assembly.

The example method 700, at 710, may include determining a temperature difference between the inlet temperature and the outlet temperature. For example, the supervisory control unit may be configured to subtract the outlet temperature from the inlet temperature to determine the temperature difference.

At 712, the example method 700 may include receiving one or more sensor signals indicative of a prime mover air inlet temperature, a prime mover power output, and/or an ambient temperature associated with the hydraulic fracturing unit associated with the heat exchanger assembly. For example, an air inlet temperature sensor associated with the prime mover may generate air inlet temperature signals indicative of the air inlet temperature of the prime mover, and the air inlet temperature signals may be communicated to the supervisory control unit. A power output sensor and/or calculation may be associated with the prime mover, and the power output sensor and/or calculation may be communicated to the supervisory control unit. An ambient temperature sensor associated with the hydraulic fracturing system, and the ambient temperature sensor may be configured to generate ambient temperature signals indicative of the ambient temperature of the surroundings of the hydraulic fracturing unit or system. The supervisory control unit may be configured to receive air inlet temperature signals, the power output sensor and/or calculation, and/or ambient temperature signals.

At 714, the example method 700 may include comparing the current temperature difference between the inlet and outlet of the heat exchanger assembly to historical data associated with operation of the heat exchanger assembly during prior operation. For example, the historical data may include correlations between the cooling effectiveness and the ambient temperature (or the prime mover air inlet temperature) and the prime mover power output, and the temperature difference between the inlet and outlet temperatures of the heat exchanger assembly. Using the historical data, for example, by accessing historical data stored in memory, the supervisory control unit may be configured to compare the current cooling effectiveness with the historical data, which may include cooling effectiveness as a function of the ambient temperature (or range thereof) and the current power output of the prime mover (or range thereof). The supervisory control unit may be configured to compare the current temperature difference to the temperature difference in the correlations of the historical data having similar or substantially matching characteristics of prime mover air inlet temperature, prime mover power output, and/or ambient temperature.

The example method 700, at 716, may include determining, based at least in part on the comparison, whether the current cooling effectiveness of the heat exchanger assembly is below a minimum cooling effectiveness. For example, under similar conditions, during prior fracturing operations, the heat exchanger assembly may have exhibited a cooling effectiveness corresponding to a temperature drop of the fluid being cooled between the inlet and the outlet of the heat exchanger assembly. The supervisory control unit may be configured to determine whether, based at least in part on the cooling effectiveness, the heat exchanger is cooling fluid below a minimum cooling effectiveness. For example, if during prior operation, under similar conditions, the heat exchanger assembly was able to reduce the temperature of the fluid passing through it by about twenty degrees Celsius (e.g., corrected for deviations from the current conditions) and during the current measurement, the heat exchanger assembly is only reducing the temperature by about five degrees, this may be an indication that the cooling effectiveness of the heat exchanger assembly has dropped below a minimum cooling effectiveness.

In some embodiments, comparing the current temperature difference between the inlet and outlet of the heat exchanger assembly to historical data associated with operation of the heat exchanger assembly during prior operation may include calculating a current average temperature difference between the inlet temperature and the outlet temperature for the heat exchanger assembly, for example, based on a summation of temperature differences over time divided by the number of temperature differences used in the summation. In some embodiments, these average temperature differences may be updated with each data set collected during operation of the hydraulic fracturing unit and added to the historical data. With each new (current) average temperature difference, the current average temperature difference, within a given range of prime mover power outputs and a corresponding given range of ambient temperatures, the current average temperature difference may be compared to the first average temperature difference calculated and stored in the historical data.

If at 716, it is determined that the current cooling effectiveness of the heat exchanger assembly is below a minimum cooling effectiveness, at 718, the example method 700 may include generating a first fault signal indicative of the heat exchanger assembly operating with a low effectiveness. For example, in some embodiments, when the current average temperature difference deviates from the first average temperature difference by more than a first average temperature difference threshold, the supervisory control unit may be configured to generate the first fault signal. In some embodiments, if the supervisory control unit determines that the cooling effectiveness of the heat exchanger assembly has dropped below the minimum cooling effectiveness, the supervisory control unit may be configured to generate a fault signal indicative of the heat exchanger assembly operating with a low effectiveness. The fault signal may be communicated to the output device(s), and the output device(s) may provide an operator or user with a warning that the heat exchanger assembly is not operating according to normal effectiveness due, for example, to dirt or debris partially or fully obstructing the cooling surfaces. The warning may be visual, audible, and/or tactile (e.g., a vibration).

At 720 (FIG. 7B), the example method 700 may include determining whether the current average temperature difference deviates from the first average temperature difference by more than a second average temperature difference threshold (e.g., greater than the first average temperature difference threshold).

If, at 720, it is determined that the current average temperature difference deviates from the first average temperature difference by more than a second average temperature difference threshold (e.g., greater than the first average temperature difference threshold), the example method 700, at 722, may include generating a second fault signal, for example, as previously described herein.

If, at 720, it is determined that the current average temperature difference does not deviate from the first average temperature difference by more than a second average temperature difference threshold, the example method 700 may include returning to 702 and continuing to monitor the effectiveness of the heat exchanger assembly.

If, at 716, it is determined that the current cooling effectiveness of the heat exchanger assembly is above the minimum cooling effectiveness, the example method 700 may include returning to 702 and continuing to monitor the effectiveness of the heat exchanger assembly.

It should be appreciated that subject matter presented herein may be implemented as a computer process, a computer-controlled apparatus, a computing system, or an article of manufacture, such as a computer-readable storage medium. While the subject matter described herein is presented in the general context of program modules that execute on one or more computing devices, those skilled in the art will recognize that other implementations may be performed in combination with other types of program modules. Generally, program modules include routines, programs, components, data structures, and other types of structures that perform particular tasks or implement particular abstract data types.

Those skilled in the art will also appreciate that aspects of the subject matter described herein may be practiced on or in conjunction with other computer system configurations beyond those described herein, including multiprocessor systems, microprocessor-based or programmable consumer electronics, minicomputers, mainframe computers, handheld computers, mobile telephone devices, tablet computing devices, special-purposed hardware devices, network appliances, and the like.

FIG. 8 illustrates an example supervisory control unit 130 configured for implementing certain systems and methods for detecting cavitation and/or pulsation associated with operating a hydraulic fracturing unit, according to embodiments of the disclosure, for example, as described herein. The supervisory control unit 130 may include one or more processor(s) 800 configured to execute certain operational aspects associated with implementing certain systems and methods described herein. The processor(s) 800 may communicate with a memory 802. The processor(s) 800 may be implemented and operated using appropriate hardware, software, firmware, or combinations thereof. Software or firmware implementations may include computer-executable or machine-executable instructions written in any suitable programming language to perform the various functions described. In some examples, instructions associated with a function block language may be stored in the memory 802 and executed by the processor(s) 800.

The memory 802 may be used to store program instructions that are loadable and executable by the processor(s) 800, as well as to store data generated during the execution of these programs. Depending on the configuration and type of the supervisory control unit 130, the memory 802 may be volatile (such as random access memory (RAM)) and/or non-volatile (such as read-only memory (ROM), flash memory, etc.). In some examples, the memory devices may include additional removable storage 804 and/or non-removable storage 806 including, but not limited to, magnetic storage, optical disks, and/or tape storage. The disk drives and their associated computer readable media may provide non-volatile storage of computer-readable instructions, data structures, program modules, and other data for the devices. In some implementations, the memory 802 may include multiple different types of memory, such as static random access memory (SRAM), dynamic random access memory (DRAM), or ROM.

The memory 802, the removable storage 804, and the non-removable storage 806 are all examples of computer-readable storage media. For example, computer-readable storage media may include volatile and non-volatile, removable and non-removable media implemented in any method or technology for storage of information such as computer-readable instructions, data structures, program modules or other data. Additional types of computer storage media that may be present may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tapes, magnetic disk storage or other magnetic storage devices, or any other medium which may be used to store the desired information and which may be accessed by the devices. Combinations of any of the above should also be included within the scope of computer-readable media.

The supervisory control unit 130 may also include one or more communication connection(s) 808 that may facilitate a control device (not shown) to communicate with devices or equipment capable of communicating with the supervisory control unit 130. The supervisory control unit 130 may also include a computer system (not shown). Connections may also be established via various data communication channels or ports, such as USB or COM ports to receive cables connecting the supervisory control unit 130 to various other devices on a network. In some examples, the supervisory control unit 130 may include Ethernet drivers that enable the supervisory control unit 130 to communicate with other devices on the network. According to various examples, communication connections 808 may be established via a wired and/or wireless connection on the network.

The supervisory control unit 130 may also include one or more input devices 810, such as a keyboard, mouse, pen, voice input device, gesture input device, and/or touch input device. It may further include one or more output devices 812, such as a display, printer, speakers and/or vibration devices. The one or more output devices may generally correspond to the output device(s) 330 shown in FIG. 3. In some examples, computer-readable communication media may include computer-readable instructions, program modules, or other data transmitted within a data signal, such as a carrier wave or other transmission. As used herein, however, computer-readable storage media may not include computer-readable communication media.

Turning to the contents of the memory 802, the memory 802 may include, but is not limited to, an operating system (OS) 814 and one or more application programs or services for implementing the features and embodiments disclosed herein. Such applications or services may include remote terminal units 816 for executing certain systems and methods for controlling operation of the hydraulic fracturing units 102 (e.g., semi- or full-autonomously controlling operation of the hydraulic fracturing units 102), for example, upon receipt of one or more control signals generated by the supervisory control unit 130. In some embodiments, each of the hydraulic fracturing units 102 may include one or more remote terminal units 816. The remote terminal unit(s) 816 may reside in the memory 802 or may be independent of the supervisory control unit 130. In some examples, the remote terminal unit(s) 816 may be implemented by software that may be provided in configurable control block language and may be stored in non-volatile memory. When executed by the processor(s) 800, the remote terminal unit(s) 816 may implement the various functionalities and features associated with the supervisory control unit 130 described herein.

As desired, embodiments of the disclosure may include a supervisory control unit 130 with more or fewer components than are illustrated in FIG. 8. Additionally, certain components of the example supervisory control unit 130 shown in FIG. 8 may be combined in various embodiments of the disclosure. The supervisory control unit 130 of FIG. 8 is provided by way of example only.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They may also be practiced with other computer system configurations, including handheld devices, multiprocessor systems, microprocessor-based or programmable consumer electronics, mini-computers, mainframe computers, and the like.

Application programs that are components of the systems and methods described herein may include routines, programs, components, data structures, etc. that may implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks can be performed by remote processing devices linked through a communications network.

This is a continuation of U.S. Non-Provisional application Ser. No. 17/551,359, filed Dec. 15, 2021, titled "AUTOMATED DIAGNOSTICS OF ELECTRONIC INSTRUMENTATION IN A SYSTEM FOR FRACTURING A WELL AND ASSOCIATED METHODS," which is a continuation of U.S. Non-Provisional application Ser. No. 17/395,298, filed Aug. 5, 2021, titled "AUTOMATED DIAGNOSTICS OF ELECTRONIC INSTRUMENTATION IN A SYSTEM FOR FRACTURING A WELL AND ASSOCIATED METHODS," now U.S. Pat. No. 11,255,174, issued Feb. 22, 2022, which is a continuation of U.S. Non-Provisional application Ser. No. 17/301,247, filed Mar. 30, 2021, titled "AUTOMATED DIAGNOSTICS OF ELECTRONIC INSTRUMENTATION IN A SYSTEM FOR FRACTURING A WELL AND ASSOCIATED METHODS," now U.S. Pat. No. 11,220,895, issued Jan. 11, 2022, which claims priority to and the benefit of, under 35 U.S.C. § 119(e), U.S. Provisional Application No. 62/705,375, filed Jun. 24, 2020, titled "AUTOMATED DIAGNOSTICS OF ELECTRONIC INSTRUMENTATION IN A SYSTEM FOR FRACTURING A WELL AND ASSOCIATED METHODS," the disclosures of which are incorporated herein by reference in their entireties.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims.

What is claimed is:

1. A diagnostic control assembly associated with one or more hydraulic fracturing units, the diagnostic control assembly comprising:

one or more sensors positioned to generate sensor signals indicative of operating parameters associated with one or more of: (a) the one or more hydraulic fracturing units, or (b) a manifold associated with the one or more hydraulic fracturing units; and a supervisory control unit configured to receive the one or more sensor signals and operate to perform one or more steps of:

(1) determine when the one or more sensors is generating a signal outside of a calibration range, thereby to generate a calibration signal indicative of the one or more sensors generating the signal outside the calibration range, the supervisory control unit being further configured to:

receive a manifold pressure signal indicative of pressure associated with fluid flowing in a manifold associated with the one or more hydraulic fracturing units from at least one manifold sensor, the at least one manifold sensor being at least one of the one or more sensors, receive unit pressure signals indicative of pressure associated with fluid flowing from at least one unit pressure sensor associated with the one or more hydraulic fracturing units, the at least one pressure sensor being at least one of the one or more sensors, and determine, based at least in part on the one or more of the manifold pressure signals or the unit pressure signals, whether one or more of the manifold pressure sensor or the at least one unit pressure sensor is generating a signal outside the calibration range, the determine of whether one or more of the manifold pressure sensor or the at least one unit pressure sensor is generating a signal outside the calibration range comprises:

determine an average pressure associated with fluid flowing in the manifold and fluid flowing from the one or more hydraulic fracturing units; and identify one or more of the manifold pressure sensor or the at least one pressure sensor as generating a signal indicative of a pressure outside a pressure range of the average pressure;

(2) determine when a fluid parameter associated with an auxiliary system of one or more of the hydraulic fracturing units is indicative of a fluid-related problem, thereby to generate a fluid signal indicative of the fluid-related problem;

(3) determine when lubrication associated with the one or more hydraulic fracturing units has a lubrication fluid temperature greater than a maximum lubrication temperature, thereby to generate a lubrication temperature signal indicative of the lubrication fluid temperature greater than the maximum lubrication temperature; or (4) determine when a heat exchanger assembly associated with one or more of the hydraulic fracturing units is cooling fluid passing through the heat exchanger assembly below a minimum cooling effectiveness, thereby to generate a cooling signal indicative of the heat exchanger assembly operating with a low effectiveness.

2. The diagnostic control assembly of claim 1, wherein the pressure range ranges from about 2% to about 4%.

3. The diagnostic control assembly of claim 1, wherein the step of determine when a fluid parameter is indicative of a fluid-related problem comprises:

receive a fluid level signal indicative of a level of fluid in a fluid reservoir; and when the fluid level signal is indicative of a fluid level below a minimum fluid level, generate a low level signal indicative of the fluid level being below the minimum fluid level.

4. The diagnostic control assembly of claim 3, wherein the supervisory control unit is further configured to prevent a hydraulic fracturing unit, of the one or more hydraulic fracturing units and associated with the low level signal, from performing a hydraulic fracturing operation until the fluid level is above the minimum fluid level.

5. The diagnostic control assembly of claim 1, wherein the step of determine whether a fluid parameter is indicative of a fluid-related problem comprises:

receive a fluid quality signal indicative of a fluid quality of fluid in the auxiliary system; and when the fluid quality signal is indicative of a fluid quality below a minimum fluid quality, generate a low fluid quality signal indicative of the fluid quality being below the minimum fluid quality.

6. The diagnostic control assembly of claim 5, wherein the supervisory control unit is further configured to one or more of: (a) prevent a hydraulic fracturing unit, of the one or more hydraulic fracturing units, associated with the low fluid quality signal, from performing a hydraulic fracturing operation, or (b) generate a maintenance signal indicative of initiating maintenance associated with the fluid.

7. The diagnostic control assembly of claim 1, wherein the step of determine whether a fluid parameter is indicative of a fluid-related problem comprises:

receive a fluid temperature signal indicative of a temperature of fluid in the auxiliary system; and when the fluid temperature signal is indicative of a fluid temperature outside an operating temperature range, generate a fluid temperature range signal indicative of the fluid temperature being outside the operating temperature range.

8. A supervisory control unit to monitor a status associated with components of one or more hydraulic fracturing units, the supervisory control unit comprising:

(A) memory having computer-readable instructions stored therein; and (B) one or more processors configured to access the memory, and execute the computer-readable instructions to cause the supervisory control unit to at least:

(i) receive one or more sensor signals and one or more of:

(w) determine when one or more of the sensor signals is indicative of a sensor generating a sensor signal outside a calibration range, thereby to generate a calibration signal indicative of the sensor generating a sensor signal outside the calibration range, the supervisory control unit being caused to:

receive one or more manifold pressure signals indicative of pressure associated with fluid flowing in the manifold from a manifold pressure sensor, receive one or more unit pressure signals indicative of pressure associated with fluid flowing from one or more pressure sensors associated with the one or more hydraulic fracturing units, and determine, based at least in part on the one or more of the manifold pressure signals or the one or more unit pressure signals, whether one or more of (a) the manifold pressure sensor, or (b) one or more of the plurality of unit pressure sensors is generating a signal outside the calibration range, the determine of whether one or more of the manifold pressure sensor or one or more of the unit pressure sensors is generating signals outside the calibration range comprises:

determine an average pressure associated with fluid flowing in the manifold and fluid flowing from the one or more of the hydraulic fracturing units; and identify one or more of the manifold pressure sensors or the one or more unit pressure sensors as generating signals indicative of a pressure outside a pressure range of the average pressure;

(x) determine when a fluid parameter associated with an auxiliary system of one or more of the hydraulic fracturing units is indicative of a fluid-related problem, thereby to generate a fluid signal indicative of the fluid-related problem;

(y) determine when lubrication associated with one or more of the hydraulic fracturing units has a lubrication fluid temperature greater than a maximum lubrication temperature, thereby to generate a lubrication temperature signal indicative of the lubrication fluid temperature greater than the maximum lubrication temperature; or (z) determine when an extent to which a heat exchanger assembly associated with one or more of the hydraulic fracturing units is cooling fluid passing through the heat exchanger assembly is cooling fluid below a minimum cooling effectiveness, thereby to generate a cooling signal indicative of the heat exchanger assembly operating with a low effectiveness.

9. The supervisory control unit of claim 8, wherein the pressure range ranges from about 2% to about 4%.

10. The supervisory control unit of claim 8, wherein the step of determine when a fluid parameter is indicative of a fluid-related problem comprises:

receive a fluid level signal indicative of a level of fluid in a fluid reservoir; and when the fluid level signal is indicative of a fluid level below a minimum fluid level, generate a low level signal indicative of the fluid level being below the minimum fluid level.

11. The supervisory control unit of claim 10, wherein the supervisory control unit is further configured to prevent a hydraulic fracturing unit, of the one or more hydraulic fracturing units associated with the low level signal, from performing a hydraulic fracturing operation until the fluid level is above the minimum fluid level.

12. The supervisory control unit of claim 8, wherein the step of determine when a fluid parameter is indicative of a fluid-related problem comprises:

receive a fluid quality signal indicative of a fluid quality of fluid in the auxiliary system; and when the fluid quality signal is indicative of a fluid quality below a minimum fluid quality, generate a low fluid quality signal indicative of the fluid quality being below the minimum fluid quality.

13. The supervisory control unit of claim 12, wherein the supervisory control unit is further configured to one or more of: (a) prevent a hydraulic fracturing unit, of the one or more hydraulic fracturing units, associated with the low fluid quality signal from performing a hydraulic fracturing operation, or (b) generate a maintenance signal indicative of initiating maintenance associated with the fluid.

14. The supervisory control unit of claim 8, wherein the step of determine when a fluid parameter is indicative of a fluid-related problem comprises:

receive a fluid temperature signal indicative of a temperature of fluid in the auxiliary system; and when the fluid temperature signal is indicative of a fluid temperature outside an operating temperature range, generate a fluid temperature range signal indicative of the fluid temperature being outside the operating temperature range.

15. A supervisory control unit to monitor a status associated with one or more hydraulic fracturing units, the supervisory control unit comprising:

(A) memory having computer-readable instructions stored therein; and (B) one or more processors configured to access the memory, and execute the computer-readable instructions to cause the supervisory control unit to one at least:

(i) receive one or more sensor signals and one or more of:

(w) determine when the one or more of the sensor signals is indicative of a sensor generating a sensor signal outside a calibration range, thereby to generate a calibration signal indicative of the sensor generating a signal outside the calibration range, the supervisory control unit being caused to:

receive one or more manifold pressure signals indicative of pressure associated with fluid flowing in the manifold from a manifold pressure sensor, receive one or more unit pressure signals indicative of pressure associated with fluid flowing from one or more unit pressure sensors associated with the one or more of the hydraulic fracturing units, and determine, based at least in part on the one or more of the manifold pressure signals or the one or more unit pressure signals, whether one or more of the manifold pressure sensor or the one or more of the unit pressure sensors is generating signals outside the calibration range;

(x) determine when a fluid parameter associated with an auxiliary system of the one or more of the hydraulic fracturing units is indicative of a fluid-related problem, thereby to generate a fluid signal indicative of the fluid-related problem, the determine when a fluid parameter is indicative of a fluid-related problem comprises determine when the extent to which a heat exchanger assembly is cooling fluid below the minimum cooling effectiveness, which comprises:

determine an inlet temperature associated with fluid flowing into an inlet of the heat exchanger assembly;

determine an outlet temperature associated with the fluid flowing out of an outlet of the heat exchanger assembly;

determine a temperature difference between the inlet temperature and the outlet temperature; and compare the temperature difference to historical data associated with operation of the heat exchanger assembly during prior operation;

(y) determine when lubrication associated with one or more of the plurality of hydraulic fracturing units has a lubrication fluid temperature greater than a maximum lubrication temperature, thereby to generate a lubrication temperature signal indicative of the lubrication fluid temperature greater than the maximum lubrication temperature; or (z) determine when an extent to which a heat exchanger assembly associated with the one or more of the hydraulic fracturing units is cooling fluid passing through the heat exchanger assembly is cooling fluid below a minimum cooling effectiveness, thereby to generate a cooling signal indicative of the heat exchanger assembly operating with a low effectiveness.

16. The supervisory control unit of claim 15, wherein the historical data comprises correlations between cooling effectiveness and one or more of ambient air temperature, a prime mover air inlet temperature, or a prime mover power output.

17. The supervisory control unit of claim 16, wherein the one or more processors further determine a current inlet temperature and a current outlet temperature, and add the current inlet temperature and the current outlet temperature to the historical data.

18. A method to control one or more hydraulic fracturing units, the method comprising:

(A) receiving, at one or more controllers, one or more sensor signals from one or more sensors indicative of operating parameters associated with one or more of: (1) at least one of the hydraulic fracturing units or (2) the manifold;

(B) generating, from the one or more controllers, a calibration signal indicative of the one or more sensor signals being outside the calibration range when one or more of: (1) a manifold pressure sensor or (2) one or more unit pressure sensors generates signals outside the calibration range;

(C) generating, from the one or more controllers, a fluid signal indicative of a fluid-related problem when a fluid parameter associated with an auxiliary system of the one or more hydraulic fracturing units is indicative of the fluid-related problem;

(D) generating, from the one or more controllers, a lubrication temperature signal indicative of a lubrication fluid temperature being greater than a maximum lubrication temperature when one or more of the plurality of hydraulic fracturing units has a lubrication fluid temperature greater than the maximum lubrication temperature; and (E) generating, from the one or more controllers, a cooling signal indicative of a heat exchanger assembly operating with a low effectiveness when which the heat exchanger assembly is cooling fluid below a minimum cooling effectiveness.

* * * * *